US011734983B1

(12) United States Patent
Gordon et al.

(10) Patent No.: US 11,734,983 B1
(45) Date of Patent: Aug. 22, 2023

(54) BANKNOTE TRANSPORT MECHANISMS AND METHODS

(71) Applicant: Cummins-Allison Corp., Mt. Prospect, IL (US)

(72) Inventors: Glenn S. Gordon, Cameron Park, CA (US); Douglas U. Mennie, Barrington, IL (US); Ricky Newsom, Bolingbrook, IL (US); Roy C. Schoon, Glenview, IL (US); Joey D. Newsom, Justice, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 198 days.

(21) Appl. No.: 16/719,345

(22) Filed: Dec. 18, 2019

Related U.S. Application Data

(60) Provisional application No. 62/781,129, filed on Dec. 18, 2018.

(51) Int. Cl.
*B65H 5/06* (2006.01)
*G07D 11/16* (2019.01)
*B65H 5/02* (2006.01)

(52) U.S. Cl.
CPC ..... *G07D 11/16* (2019.01); *B65H 5/025* (2013.01); *B65H 5/068* (2013.01)

(58) Field of Classification Search
CPC ..... B65H 5/068; B65H 2404/61; B65H 2301/5122; B65H 2405/1412
See application file for complete search history.

(56) References Cited

U.S. PATENT DOCUMENTS

| | | | | |
|---|---|---|---|---|
| 3,683,681 | A | 8/1972 | Taylor | 73/78 |
| 3,771,783 | A | 11/1973 | McInerny | |
| 4,463,607 | A | 8/1984 | Hilton | 73/587 |
| 5,163,672 | A | 11/1992 | Mennie | 271/187 |
| 5,207,788 | A | 5/1993 | Geib et al. | 271/122 |
| 5,295,196 | A | 3/1994 | Raterman et al. | 382/7 |

(Continued)

FOREIGN PATENT DOCUMENTS

| | | | |
|---|---|---|---|
| CA | 2684159 A1 | 4/2010 | G07D 11/00 |
| DK | 145455 B | 11/1982 | |

(Continued)

OTHER PUBLICATIONS

U.S. Appl. No. 10/996,693: Office Action, 19 pgs. (Apr. 5, 2006).

*Primary Examiner* — Howard J Sanders

(57) ABSTRACT

A banknote transport mechanism comprising a plurality of driven roller shafts spaced apart in a direction of banknote transport along a transport path, wherein a plurality of driven rollers are positioned on each driven roller shaft, wherein each driven roller shaft rotates about a respective driven roller axis. The banknote transport mechanism further comprises a plurality of low friction rails, each low friction rail having and upper surface and a longitudinal axis generally parallel to a direction of banknote transport. The plurality of driven roller axes are oriented generally perpendicular to the direction of banknote transport along the transport path. The plurality of driven roller axes generally lie in a first plane and the upper surfaces of the low friction rails generally lie in a second plane parallel to the first plane. The driven rollers of each driven roller shaft are offset laterally in a direction transverse to the direction of banknote transport from the lateral location of each rail. The driven rollers cooperate with the rails to transport a banknote in the direction of banknote transport with the banknote being corrugated in a direction generally transverse to the direction of banknote transport.

19 Claims, 29 Drawing Sheets

(56) References Cited

U.S. PATENT DOCUMENTS

| | | | | |
|---|---|---|---|---|
| 5,467,405 | A | 11/1995 | Raterman et al. | 382/135 |
| 5,467,406 | A | 11/1995 | Graves et al. | 382/135 |
| D369,984 | S | 5/1996 | Larsen | D10/97 |
| 5,633,949 | A | 5/1997 | Graves et al. | 382/135 |
| 5,640,463 | A | 6/1997 | Csulits | 382/135 |
| 5,652,802 | A | 7/1997 | Graves et al. | 382/135 |
| 5,687,963 | A | 11/1997 | Mennie | 271/119 |
| 5,692,067 | A | 11/1997 | Raterman et al. | 382/135 |
| 5,704,491 | A | 1/1998 | Graves | 209/534 |
| 5,724,438 | A | 3/1998 | Graves | 382/135 |
| 5,751,840 | A | 5/1998 | Raterman et al. | 382/135 |
| 5,790,693 | A | 8/1998 | Graves et al. | 382/135 |
| 5,790,697 | A | 8/1998 | Munro et al. | 382/135 |
| 5,806,650 | A | 9/1998 | Mennie et al. | 194/206 |
| 5,815,592 | A | 9/1998 | Mennie et al. | 382/135 |
| 5,822,448 | A | 10/1998 | Graves et al. | 382/135 |
| 5,832,104 | A | 11/1998 | Graves et al. | 382/135 |
| 5,867,589 | A | 2/1999 | Graves et al. | 382/135 |
| 5,870,487 | A | 2/1999 | Graves et al. | 382/135 |
| 5,875,259 | A | 2/1999 | Mennie et al. | 382/135 |
| 5,905,810 | A | 5/1999 | Jones et al. | 382/135 |
| 5,909,502 | A | 6/1999 | Mazur | 382/135 |
| 5,909,503 | A | 6/1999 | Graves et al. | 382/135 |
| 5,912,982 | A | 6/1999 | Munro et al. | 382/135 |
| 5,938,044 | A | 8/1999 | Weggesser | 209/534 |
| 5,943,655 | A | 8/1999 | Jacobson | 705/30 |
| 5,960,103 | A | 9/1999 | Graves et al. | 382/135 |
| 5,966,456 | A | 10/1999 | Jones et al. | 382/135 |
| 5,982,918 | A | 11/1999 | Mennie et al. | 382/135 |
| 5,992,601 | A | 11/1999 | Mennie et al. | 194/207 |
| 6,012,565 | A | 1/2000 | Mazur | 194/207 |
| 6,021,883 | A | 2/2000 | Casanova et al. | 197/217 |
| 6,026,175 | A | 2/2000 | Munro et al. | 382/135 |
| 6,028,951 | A | 2/2000 | Raterman et al. | 382/135 |
| 6,068,194 | A | 5/2000 | Mazur | 235/492 |
| 6,072,896 | A | 6/2000 | Graves et al. | 382/135 |
| 6,073,744 | A | 6/2000 | Raterman et al. | 194/207 |
| 6,074,334 | A | 6/2000 | Mennie et al. | 493/438 |
| 6,128,402 | A | 10/2000 | Jones et al. | 382/135 |
| 6,220,419 | B1 | 4/2001 | Mennie | 194/207 |
| 6,237,739 | B1 | 5/2001 | Mazur et al. | 194/207 |
| 6,241,069 | B1 | 6/2001 | Mazur et al. | 194/207 |
| 6,256,407 | B1 | 7/2001 | Mennie et al. | 382/135 |
| 6,278,795 | B1 | 8/2001 | Anderson et al. | 382/135 |
| 6,311,819 | B1 | 11/2001 | Stromme et al. | 194/207 |
| 6,318,537 | B1 | 11/2001 | Jones et al. | 194/346 |
| 6,325,370 | B1 | 12/2001 | Crotti et al. | |
| 6,351,551 | B1 | 2/2002 | Munro et al. | 382/135 |
| 6,363,164 | B1 | 3/2002 | Jones et al. | 382/135 |
| 6,371,303 | B1 | 4/2002 | Klein et al. | 209/534 |
| 6,378,683 | B2 | 4/2002 | Mennie | 194/207 |
| 6,381,354 | B1 | 4/2002 | Mennie et al. | 382/135 |
| 6,398,000 | B1 | 6/2002 | Jenrick et al. | 194/200 |
| 6,459,806 | B1 | 10/2002 | Raterman et al. | 382/135 |
| 6,460,705 | B1 | 10/2002 | Hallowell | 209/534 |
| 6,493,461 | B1 | 12/2002 | Mennie et al. | 382/135 |
| 6,539,104 | B1 | 3/2003 | Raterman et al. | 382/135 |
| 6,560,355 | B2 | 5/2003 | Graves et al. | 382/135 |
| 6,588,569 | B1 | 7/2003 | Jenrick et al. | 194/206 |
| 6,601,687 | B1 | 8/2003 | Jenrick et al. | 194/206 |
| 6,603,872 | B2 | 8/2003 | Jones et al. | 382/135 |
| 6,621,919 | B2 | 9/2003 | Mennie et al. | 382/135 |
| 6,628,816 | B2 | 9/2003 | Mennie et al. | 382/135 |
| 6,636,624 | B2 | 10/2003 | Raterman et al. | 382/135 |
| 6,647,136 | B2 | 11/2003 | Jones et al. | 382/137 |
| 6,650,767 | B2 | 11/2003 | Jones et al. | 382/135 |
| 6,654,486 | B2 | 11/2003 | Jones et al. | 382/135 |
| 6,661,910 | B2 | 12/2003 | Jones et al. | 382/135 |
| 6,665,431 | B2 | 12/2003 | Jones et al. | 382/135 |
| 6,678,401 | B2 | 1/2004 | Jones et al. | 382/135 |
| 6,678,402 | B2 | 1/2004 | Jones et al. | 382/135 |
| 6,705,470 | B2 | 3/2004 | Klein et al. | 209/534 |
| 6,721,442 | B1 | 4/2004 | Mennie et al. | 382/135 |
| 6,724,926 | B2 | 4/2004 | Jones et al. | 382/135 |
| 6,724,927 | B2 | 4/2004 | Jones et al. | 382/135 |
| 6,731,785 | B1 | 5/2004 | Mennie et al. | 382/135 |
| 6,731,786 | B2 | 5/2004 | Jones et al. | 382/135 |
| 6,748,101 | B1 | 6/2004 | Jones et al. | 382/135 |
| 6,778,693 | B2 | 8/2004 | Jones et al. | 382/135 |
| 6,798,899 | B2 | 9/2004 | Mennie et al. | 382/135 |
| 6,810,137 | B2 | 10/2004 | Jones et al. | 382/135 |
| 6,843,418 | B2 | 1/2005 | Jones et al. | 235/462.01 |
| 6,860,375 | B2 | 3/2005 | Hallowell et al. | 194/328 |
| 6,866,134 | B2 | 3/2005 | Stromme et al. | 194/207 |
| 6,868,954 | B2 | 3/2005 | Stromme et al. | 194/207 |
| 6,880,692 | B1 | 4/2005 | Mazur et al. | 194/207 |
| 6,913,130 | B1 | 7/2005 | Mazur et al. | 194/207 |
| 6,913,260 | B2 | 7/2005 | Maier et al. | 271/265.04 |
| 6,915,893 | B2 | 7/2005 | Mennie | 194/207 |
| 6,929,109 | B1 | 8/2005 | Klein et al. | 194/206 |
| 6,955,253 | B1 | 10/2005 | Mazur et al. | 194/207 |
| 6,957,733 | B2 | 10/2005 | Mazur et al. | 194/215 |
| 6,959,800 | B1 | 11/2005 | Mazur et al. | 194/207 |
| 6,962,247 | B2 | 11/2005 | Maier et al. | 194/207 |
| 6,980,684 | B1 | 12/2005 | Munro et al. | 382/135 |
| 6,994,200 | B2 | 2/2006 | Jenrick et al. | 194/206 |
| 6,996,263 | B2 | 2/2006 | Jones et al. | 382/135 |
| 7,000,828 | B2 | 2/2006 | Jones | 235/379 |
| 7,016,767 | B2 | 3/2006 | Jones et al. | 700/224 |
| 7,036,651 | B2 | 5/2006 | Tam et al. | 194/217 |
| 7,082,216 | B2 | 7/2006 | Jones et al. | 382/137 |
| 7,092,560 | B2 | 8/2006 | Jones et al. | 382/135 |
| 7,103,206 | B2 | 9/2006 | Graves et al. | 382/135 |
| 7,103,438 | B2 | 9/2006 | Hallowell et al. | 700/116 |
| 7,146,245 | B2 | 12/2006 | Jones et al. | 700/224 |
| 7,149,336 | B2 | 12/2006 | Jones et al. | 382/135 |
| 7,158,662 | B2 | 1/2007 | Chiles | 382/135 |
| 7,171,032 | B2 | 1/2007 | Jones et al. | 382/135 |
| 7,187,795 | B2 | 3/2007 | Jones et al. | 382/135 |
| 7,191,657 | B2 | 3/2007 | Maier et al. | 73/587 |
| 7,197,173 | B2 | 3/2007 | Jones et al. | 382/135 |
| 7,200,255 | B2 | 4/2007 | Jones et al. | 382/135 |
| 7,201,320 | B2 | 4/2007 | Csulits et al. | 235/462.01 |
| 7,232,024 | B2 | 6/2007 | Mazur et al. | 194/207 |
| 7,248,731 | B2 | 7/2007 | Raterman et al. | 382/135 |
| 7,256,874 | B2 | 8/2007 | Csulits et al. | 356/71 |
| 7,269,279 | B2 | 9/2007 | Chiles | 382/135 |
| 7,349,566 | B2 | 3/2008 | Jones et al. | 382/139 |
| 7,362,891 | B2 | 4/2008 | Jones et al. | 382/135 |
| 7,366,338 | B2 | 4/2008 | Jones et al. | 382/135 |
| 7,391,897 | B2 | 6/2008 | Jones et al. | 382/135 |
| 7,505,831 | B2 | 3/2009 | Jones et al. | 700/224 |
| 7,536,046 | B2 | 5/2009 | Raterman et al. | 382/135 |
| 7,542,598 | B2 | 6/2009 | Jones et al. | 382/135 |
| 7,551,764 | B2 | 6/2009 | Chiles et al. | 382/135 |
| 7,590,274 | B2 | 9/2009 | Raterman et al. | 382/135 |
| 7,591,428 | B2 | 9/2009 | Freeman et al. | 235/449 |
| 7,599,543 | B2 | 10/2009 | Jones et al. | 382/137 |
| 7,600,626 | B2 | 10/2009 | Hallowell et al. | 194/206 |
| 7,602,956 | B2 | 10/2009 | Jones et al. | 382/135 |
| 5,909,503 | C1 | 11/2009 | Graves et al. | 382/135 |
| 7,619,721 | B2 | 11/2009 | Jones et al. | 356/71 |
| 7,620,231 | B2 | 11/2009 | Jones et al. | 382/137 |
| 5,966,456 | C1 | 12/2009 | Jones et al. | 596/645.6 |
| 6,381,354 | C1 | 12/2009 | Mennie et al. | 382/135 |
| 7,628,326 | B2 | 12/2009 | Freeman et al. | 235/449 |
| 7,635,082 | B2 | 12/2009 | Jones | 235/379 |
| 7,647,275 | B2 | 1/2010 | Jones | 705/40 |
| 7,650,980 | B2 | 1/2010 | Jenrick et al. | 194/206 |
| 7,672,499 | B2 | 3/2010 | Raterman et al. | 382/135 |
| 7,686,151 | B2 | 3/2010 | Renz et al. | 194/206 |
| 7,726,457 | B2 | 6/2010 | Maier et al. | 194/206 |
| 7,735,621 | B2 | 6/2010 | Hallowell et al. | 194/206 |
| 7,753,189 | B2 | 7/2010 | Maier et al. | 194/206 |
| 7,762,380 | B2 | 7/2010 | Freeman et al. | 194/210 |
| 7,778,456 | B2 | 8/2010 | Jones et al. | 382/135 |
| 7,779,982 | B2 | 8/2010 | Fitzgerald et al. | 194/206 |
| 6,459,806 | C1 | 9/2010 | Raterman et al. | 382/135 |
| 7,817,842 | B2 | 10/2010 | Mennie | 382/137 |
| 7,849,994 | B2 | 12/2010 | Klein et al. | 194/206 |
| 7,873,576 | B2 | 1/2011 | Jones et al. | 705/43 |
| 7,881,519 | B2 | 2/2011 | Jones et al. | 382/135 |
| 7,882,000 | B2 | 2/2011 | Jones | 705/35 |
| 7,903,863 | B2 | 3/2011 | Jones et al. | 382/135 |
| 7,929,749 | B1 | 4/2011 | Jones et al. | 382/135 |
| 7,938,245 | B2 | 5/2011 | Jenrick et al. | 194/206 |
| 7,949,582 | B2 | 5/2011 | Mennie et al. | 705/35 |
| 7,978,899 | B2 | 7/2011 | Jenrick et al. | 382/135 |

(56) References Cited

U.S. PATENT DOCUMENTS

| | | | | |
|---|---|---|---|---|
| 8,023,715 | B2 | 9/2011 | Jones et al. | 382/135 |
| 8,041,098 | B2 | 10/2011 | Jones et al. | 382/137 |
| 8,042,732 | B2 | 10/2011 | Blake et al. | 235/375 |
| 8,103,084 | B2 | 1/2012 | Jones et al. | 382/140 |
| 8,125,624 | B2 | 2/2012 | Jones et al. | 356/71 |
| 8,126,793 | B2 | 2/2012 | Jones | 705/35 |
| 8,162,125 | B1 | 4/2012 | Csulits et al. | 194/206 |
| 8,169,602 | B2 | 5/2012 | Jones et al. | 356/71 |
| 8,204,293 | B2 | 6/2012 | Csulits et al. | 382/135 |
| 8,229,821 | B2 | 7/2012 | Mennie et al. | 705/35 |
| 7,536,046 | C1 | 8/2012 | Raterman et al. | 382/135 |
| 8,297,428 | B2 | 10/2012 | Renz et al. | 194/206 |
| 7,672,499 | C1 | 11/2012 | Raterman et al. | 382/135 |
| 8,322,505 | B2 | 12/2012 | Freeman et al. | 194/210 |
| 8,331,643 | B2 | 12/2012 | Yacoubian et al. | 382/135 |
| 8,339,589 | B2 | 12/2012 | Jones et al. | 356/71 |
| 8,346,610 | B2 | 1/2013 | Mennie et al. | 705/16 |
| 8,352,322 | B2 | 1/2013 | Mennie et al. | 705/16 |
| 8,380,573 | B2 | 2/2013 | Jones et al. | 705/16 |
| 8,391,583 | B1 | 3/2013 | Mennie et al. | 382/135 |
| 8,396,278 | B2 | 3/2013 | Jones et al. | 382/135 |
| 8,396,586 | B2 | 3/2013 | Klein et al. | 700/224 |
| 8,401,268 | B1 | 3/2013 | Yacoubian et al. | 382/135 |
| 5,692,067 | C1 | 4/2013 | Raterman et al. | 382/135 |
| 8,413,888 | B2 | 4/2013 | Jones | 235/379 |
| 8,417,017 | B1 | 4/2013 | Beutel et al. | 382/135 |
| 8,428,332 | B1 | 4/2013 | Csulits et al. | 382/135 |
| 8,433,123 | B1 | 4/2013 | Csulits et al. | 382/135 |
| 8,433,126 | B2 | 4/2013 | Jones et al. | 382/137 |
| 8,437,528 | B1 | 5/2013 | Csulits et al. | 382/135 |
| 8,437,529 | B1 | 5/2013 | Mennie et al. | 382/135 |
| 8,437,530 | B1 | 5/2013 | Mennie et al. | 382/135 |
| 8,437,531 | B2 | 5/2013 | Jones et al. | 382/137 |
| 8,437,532 | B1 | 5/2013 | Jones et al. | 382/138 |
| 8,442,296 | B2 | 5/2013 | Jones et al. | 382/137 |
| 8,443,958 | B2 | 5/2013 | Blake et al. | 194/215 |
| 8,453,820 | B2 | 6/2013 | Hallowell et al. | 194/207 |
| 8,459,436 | B2 | 6/2013 | Jenrick et al. | 194/206 |
| 8,467,591 | B1 | 6/2013 | Csulits et al. | 382/135 |
| 8,478,019 | B1 | 7/2013 | Csulits et al. | 382/135 |
| 8,478,020 | B1 | 7/2013 | Jones et al. | 382/137 |
| 8,514,379 | B2 | 8/2013 | Jones et al. | 356/71 |
| 8,538,123 | B1 | 9/2013 | Csulits et al. | 382/135 |
| 8,542,904 | B1 | 9/2013 | Beutel et al. | 382/133 |
| 8,544,656 | B2 | 10/2013 | Mennie et al. | 209/534 |
| 8,559,694 | B2 | 10/2013 | Jenrick et al. | 382/135 |
| 8,559,695 | B1 | 10/2013 | Csulits et al. | 382/135 |
| 8,594,414 | B1 | 11/2013 | Jones et al. | 382/135 |
| 8,625,875 | B2 | 1/2014 | Csulits et al. | 382/135 |
| 8,627,939 | B1 | 1/2014 | Jones et al. | 194/207 |
| 8,639,015 | B1 | 1/2014 | Mennie et al. | 382/135 |
| 8,644,583 | B1 | 2/2014 | Mennie et al. | 382/135 |
| 8,644,584 | B1 | 2/2014 | Mennie et al. | 382/135 |
| 8,644,585 | B1 | 2/2014 | Mennie et al. | 382/135 |
| 8,655,045 | B2 | 2/2014 | Jones et al. | 382/135 |
| 8,655,046 | B1 | 2/2014 | Csulits et al. | 382/135 |
| 8,684,157 | B2 | 4/2014 | Freeman et al. | 194/210 |
| 8,701,857 | B2 | 4/2014 | Jenrick et al. | 194/206 |
| 7,672,499 | C2 | 5/2014 | Raterman et al. | 382/135 |
| 8,714,335 | B2 | 5/2014 | Hallowell et al. | 194/206 |
| 8,714,336 | B2 | 5/2014 | Csulits et al. | 194/206 |
| 8,725,289 | B2 | 5/2014 | Klein et al. | 700/224 |
| 8,781,206 | B1 | 7/2014 | Yacoubian et al. | 382/135 |
| 8,783,685 | B2 | 7/2014 | Reinhard et al. | |
| 8,787,652 | B1 | 7/2014 | Jones et al. | 382/135 |
| 8,929,640 | B1 | 1/2015 | Mennie et al. | 382/135 |
| 8,944,234 | B1 | 2/2015 | Csulits et al. | 194/206 |
| 8,948,490 | B1 | 2/2015 | Jones et al. | 382/135 |
| 8,958,626 | B1 | 2/2015 | Mennie et al. | 382/135 |
| 8,973,817 | B1 | 3/2015 | Daniel, III et al. | 235/379 |
| 8,978,864 | B2 | 3/2015 | Jones et al. | 194/206 |
| 9,004,255 | B2 | 4/2015 | Mennie et al. | 194/206 |
| 7,536,046 | C2 | 5/2015 | Raterman et al. | G07D 7/128 |
| 9,044,785 | B2 | 6/2015 | Mennie et al. | 194/206 |
| 9,045,309 | B2 | 6/2015 | Hashimoto | G06K 9/60 |
| 9,129,271 | B2 | 9/2015 | Jenrick et al. | 194/205 |
| 9,141,876 | B1 | 9/2015 | Jones et al. | G06K 9/60 |
| 9,142,075 | B1 | 9/2015 | Csulits et al. | 382/100 |
| 9,189,780 | B1 | 11/2015 | Jones et al. | G06Q 20/1085 |
| 9,195,889 | B2 | 11/2015 | Klein et al. | G06K 9/00469 |
| 9,296,573 | B2 | 3/2016 | Daniel, III et al. | B65H 1/027 |
| 9,355,295 | B1 | 5/2016 | Jones et al. | G06K 9/00 |
| 9,390,574 | B2 | 7/2016 | Jones et al. | G07D 7/12 |
| 9,477,896 | B1 | 10/2016 | Mennie et al. | G06K 9/03 |
| 9,495,808 | B2 | 11/2016 | Jenrick et al. | G07B 11/02 |
| 9,558,418 | B2 | 1/2017 | Jones et al. | 382/135 |
| 9,971,935 | B1 | 5/2018 | Mennie et al. | G06K 9/00 |
| 9,972,156 | B1 | 5/2018 | Mennie et al. | G06K 9/00 |
| 10,163,023 | B2 | 12/2018 | Jones et al. | |
| 10,452,906 | B1 | 10/2019 | Mennie et al. | G06Q 10/00 |
| 2001/0006556 | A1 | 7/2001 | Graves et al. | 382/135 |
| 2001/0006557 | A1 | 7/2001 | Mennie et al. | 382/135 |
| 2001/0015311 | A1 | 8/2001 | Mennie | 194/207 |
| 2001/0019624 | A1 | 9/2001 | Raterman et al. | 382/135 |
| 2001/0035603 | A1 | 11/2001 | Graves et al. | 271/265.01 |
| 2002/0001393 | A1 | 1/2002 | Jones et al. | 382/100 |
| 2002/0020603 | A1 | 2/2002 | Jones et al. | 194/346 |
| 2002/0056605 | A1 | 5/2002 | Mazur et al. | 194/207 |
| 2002/0085245 | A1 | 7/2002 | Mennie et al. | 358/498 |
| 2002/0085745 | A1 | 7/2002 | Jones et al. | 382/135 |
| 2002/0103757 | A1 | 8/2002 | Jones et al. | 705/45 |
| 2002/0104785 | A1 | 8/2002 | Klein et al. | 209/534 |
| 2002/0107801 | A1 | 8/2002 | Jones et al. | 705/45 |
| 2002/0118871 | A1 | 8/2002 | Jones et al. | 382/137 |
| 2002/0122580 | A1 | 9/2002 | Jones et al. | 382/137 |
| 2002/0126885 | A1 | 9/2002 | Mennie et al. | 382/135 |
| 2002/0126886 | A1 | 9/2002 | Jones et al. | 382/135 |
| 2002/0131630 | A1 | 9/2002 | Jones et al. | 382/137 |
| 2002/0136442 | A1 | 9/2002 | Jones et al. | 382/135 |
| 2002/0145035 | A1 | 10/2002 | Jones | 235/379 |
| 2002/0154804 | A1 | 10/2002 | Jones et al. | 382/135 |
| 2002/0154805 | A1 | 10/2002 | Jones et al. | 382/135 |
| 2002/0154806 | A1 | 10/2002 | Jones et al. | 382/135 |
| 2002/0154807 | A1 | 10/2002 | Jones et al. | 382/135 |
| 2002/0154808 | A1 | 10/2002 | Jones et al. | 382/135 |
| 2002/0186876 | A1 | 12/2002 | Jones et al. | 382/135 |
| 2003/0009420 | A1 | 1/2003 | Jones | 705/39 |
| 2003/0015395 | A1 | 1/2003 | Hallowell et al. | 194/206 |
| 2003/0015396 | A1 | 1/2003 | Mennie | 194/206 |
| 2003/0059098 | A1 | 3/2003 | Jones et al. | 382/135 |
| 2003/0062242 | A1 | 4/2003 | Hallowell et al. | 194/302 |
| 2003/0081824 | A1 | 5/2003 | Mennie et al. | 382/135 |
| 2003/0108233 | A1 | 6/2003 | Raterman et al. | 382/135 |
| 2003/0121752 | A1 | 7/2003 | Stromme et al. | 194/207 |
| 2003/0121753 | A1 | 7/2003 | Stromme et al. | 194/207 |
| 2003/0132281 | A1 | 7/2003 | Jones et al. | 235/379 |
| 2003/0139994 | A1 | 7/2003 | Jones | 705/36 |
| 2003/0168308 | A1 | 9/2003 | Maier et al. | 194/207 |
| 2003/0174874 | A1 | 9/2003 | Raterman et al. | 382/135 |
| 2003/0182217 | A1 | 9/2003 | Chiles | 705/35 |
| 2003/0198373 | A1 | 10/2003 | Raterman et al. | 382/135 |
| 2003/0202690 | A1 | 10/2003 | Jones et al. | 382/139 |
| 2004/0003980 | A1 | 1/2004 | Hallowell et al. | 194/206 |
| 2004/0016621 | A1 | 1/2004 | Jenrick et al. | 194/206 |
| 2004/0016797 | A1 | 1/2004 | Jones et al. | 235/379 |
| 2004/0028266 | A1 | 2/2004 | Jones et al. | 382/135 |
| 2004/0083149 | A1 | 4/2004 | Jones | 705/35 |
| 2004/0145726 | A1 | 7/2004 | Csulits et al. | 356/71 |
| 2004/0149538 | A1 | 8/2004 | Sakowski | 194/207 |
| 2004/0153408 | A1 | 8/2004 | Jones et al. | 705/43 |
| 2004/0154964 | A1 | 8/2004 | Jones | 209/534 |
| 2004/0173432 | A1 | 9/2004 | Jones | 194/216 |
| 2004/0182675 | A1 | 9/2004 | Long et al. | 194/206 |
| 2004/0251110 | A1 | 12/2004 | Jenrick et al. | 194/207 |
| 2005/0029168 | A1 | 2/2005 | Jones et al. | 209/534 |
| 2005/0035034 | A1 | 2/2005 | Long et al. | 209/534 |
| 2005/0040225 | A1 | 2/2005 | Csulits et al. | 235/379 |
| 2005/0047642 | A1 | 3/2005 | Jones et al. | 382/137 |
| 2005/0060055 | A1 | 3/2005 | Hallowell et al. | 700/95 |
| 2005/0060059 | A1 | 3/2005 | Klein et al. | 700/213 |
| 2005/0060061 | A1 | 3/2005 | Jones et al. | 700/226 |
| 2005/0077142 | A1 | 4/2005 | Tam et al. | 194/217 |
| 2005/0086271 | A1 | 4/2005 | Jones et al. | 707/200 |
| 2005/0087422 | A1 | 4/2005 | Maier et al. | 194/207 |
| 2005/0108165 | A1 | 5/2005 | Jones et al. | 705/43 |
| 2005/0117791 | A2 | 6/2005 | Raterman et al. | 382/135 |
| 2005/0117792 | A2 | 6/2005 | Graves et al. | 382/135 |
| 2005/0150738 | A1 | 7/2005 | Hallowell et al. | 194/206 |

(56) References Cited

U.S. PATENT DOCUMENTS

| | | | | |
|---|---|---|---|---|
| 2005/0163361 | A1 | 7/2005 | Jones et al. | 382/135 |
| 2005/0163362 | A1 | 7/2005 | Jones et al. | 382/137 |
| 2005/0169511 | A1 | 8/2005 | Jones | 382/135 |
| 2005/0173221 | A1 | 8/2005 | Maier et al. | 194/207 |
| 2005/0183928 | A1 | 8/2005 | Jones et al. | 194/207 |
| 2005/0207634 | A1 | 9/2005 | Jones et al. | 382/135 |
| 2005/0213803 | A1 | 9/2005 | Mennie | 382/135 |
| 2005/0241909 | A1 | 11/2005 | Mazur et al. | 194/207 |
| 2005/0249394 | A1 | 11/2005 | Jones et al. | 382/135 |
| 2005/0265591 | A1 | 12/2005 | Jones et al. | 382/135 |
| 2005/0276458 | A1 | 12/2005 | Jones et al. | 382/135 |
| 2005/0278239 | A1 | 12/2005 | Jones et al. | 705/35 |
| 2006/0010071 | A1 | 1/2006 | Jones et al. | 705/42 |
| 2006/0078186 | A1 | 4/2006 | Freeman et al. | 382/135 |
| 2006/0182330 | A1 | 8/2006 | Chiles | 382/135 |
| 2006/0195567 | A1 | 8/2006 | Mody et al. | 709/224 |
| 2006/0210137 | A1 | 9/2006 | Raterman et al. | 382/135 |
| 2006/0237900 | A1* | 10/2006 | Sekiyama et al. | B65H 29/14 271/220 |
| 2006/0274929 | A1 | 12/2006 | Jones et al. | 382/135 |
| 2007/0071302 | A1 | 3/2007 | Jones et al. | 382/135 |
| 2007/0076939 | A1 | 4/2007 | Jones et al. | 382/135 |
| 2007/0078560 | A1 | 4/2007 | Jones et al. | 700/224 |
| 2007/0095630 | A1 | 5/2007 | Mennie et al. | 194/206 |
| 2007/0112674 | A1 | 5/2007 | Jones | 705/45 |
| 2007/0122023 | A1 | 5/2007 | Jenrick et al. | 382/135 |
| 2007/0172107 | A1 | 7/2007 | Jones et al. | 382/137 |
| 2007/0209904 | A1 | 9/2007 | Freeman et al. | 194/210 |
| 2007/0221470 | A1 | 9/2007 | Mennie et al. | 194/216 |
| 2007/0237381 | A1 | 10/2007 | Mennie et al. | 382/135 |
| 2007/0258633 | A1 | 11/2007 | Jones et al. | 382/135 |
| 2007/0269097 | A1 | 11/2007 | Chiles et al. | 382/135 |
| 2007/0278064 | A1 | 12/2007 | Hallowell et al. | 194/206 |
| 2008/0006505 | A1 | 1/2008 | Renz et al. | 194/206 |
| 2008/0033829 | A1 | 2/2008 | Mennie et al. | 705/16 |
| 2008/0044077 | A1 | 2/2008 | Mennie et al. | 382/135 |
| 2008/0060906 | A1 | 3/2008 | Fitzgerald et al. | 194/207 |
| 2008/0123932 | A1 | 5/2008 | Jones et al. | 382/135 |
| 2008/0133411 | A1 | 6/2008 | Jones et al. | 705/42 |
| 2008/0177420 | A1 | 7/2008 | Klein et al. | 700/224 |
| 2008/0219543 | A1 | 9/2008 | Csulits et al. | 382/135 |
| 2008/0285838 | A1 | 11/2008 | Jones et al. | 382/135 |
| 2009/0001661 | A1 | 1/2009 | Klein et al. | 271/258.01 |
| 2009/0022390 | A1 | 1/2009 | Yacoubian et al. | 382/135 |
| 2009/0087076 | A1 | 4/2009 | Jenrick et al. | 382/135 |
| 2009/0090779 | A1 | 4/2009 | Freeman et al. | 235/450 |
| 2009/0121415 | A1 | 5/2009 | Nireki | |
| 2009/0121422 | A1* | 5/2009 | Imoto | B65H 5/38 271/272 |
| 2009/0236201 | A1 | 9/2009 | Blake et al. | 194/215 |
| 2009/0310188 | A1 | 12/2009 | Jones et al. | 358/448 |
| 2009/0313159 | A1 | 12/2009 | Jones et al. | 705/35 |
| 2010/0034454 | A1 | 2/2010 | Jones et al. | 382/137 |
| 2010/0038419 | A1 | 2/2010 | Blake et al. | 235/375 |
| 2010/0051687 | A1 | 3/2010 | Jones et al. | 235/379 |
| 2010/0057617 | A1 | 3/2010 | Jones et al. | 705/44 |
| 2010/0063916 | A1 | 3/2010 | Jones et al. | 705/35 |
| 2010/0092065 | A1 | 4/2010 | Jones et al. | 382/135 |
| 2010/0108463 | A1 | 5/2010 | Renz et al. | 194/206 |
| 2010/0116619 | A1 | 5/2010 | Jones | 194/217 |
| 2010/0163366 | A1 | 7/2010 | Jenrick et al. | 194/206 |
| 2010/0236892 | A1 | 9/2010 | Jones et al. | 194/206 |
| 2010/0263984 | A1 | 10/2010 | Freeman et al. | 194/206 |
| 2010/0276485 | A1 | 11/2010 | Jones et al. | 235/379 |
| 2011/0087599 | A1 | 4/2011 | Jones | 705/45 |
| 2011/0099105 | A1 | 4/2011 | Mennie et al. | 705/41 |
| 2011/0206267 | A1 | 8/2011 | Jones et al. | 382/139 |
| 2011/0215034 | A1 | 9/2011 | Mennie et al. | 209/534 |
| 2011/0220717 | A1 | 9/2011 | Jones et al. | 235/380 |
| 2011/0255767 | A1 | 10/2011 | Jenrick et al. | 382/135 |
| 2011/0258113 | A1 | 10/2011 | Jones et al. | 705/39 |
| 2012/0008131 | A1 | 1/2012 | Jones et al. | 356/71 |
| 2012/0008850 | A1 | 1/2012 | Jones et al. | 382/135 |
| 2012/0013891 | A1 | 1/2012 | Jones et al. | 356/71 |
| 2012/0013892 | A1 | 1/2012 | Jones et al. | 356/71 |
| 2012/0150745 | A1 | 6/2012 | Csulits et al. | 705/45 |
| 2012/0185083 | A1 | 7/2012 | Klein et al. | 700/223 |
| 2012/0189186 | A1 | 7/2012 | Csulits et al. | 382/135 |
| 2012/0215689 | A1 | 8/2012 | Jones | 705/40 |
| 2012/0321170 | A2 | 12/2012 | Jones et al. | 382/135 |
| 2013/0068585 | A1 | 3/2013 | Freeman et al. | 194/210 |
| 2013/0098992 | A1 | 4/2013 | Jenrick et al. | 235/375 |
| 2013/0148874 | A1 | 6/2013 | Jones et al. | 382/135 |
| 2013/0193205 | A1 | 8/2013 | Jones | 235/379 |
| 2013/0213864 | A1 | 8/2013 | Mennie et al. | 209/534 |
| 2013/0327686 | A1 | 12/2013 | Mennie et al. | 209/534 |
| 2014/0175173 | A1 | 6/2014 | Jenrick et al. | 235/462.01 |
| 2015/0146963 | A1 | 5/2015 | Klein et al. | G06K 9/00469 |
| 2015/0183593 | A1 | 7/2015 | Daniel, III et al. | B65H 1/027 |
| 2015/0210495 | A1 | 7/2015 | Hayes et al. | |
| 2015/0325056 | A1 | 11/2015 | Jenrick et al. | G07B 11/02 |
| 2015/0356366 | A1 | 12/2015 | Jones et al. | G06K 9/20 |
| 2016/0368727 | A1* | 12/2016 | Yoshitsugu et al. | B65H 31/24 |
| 2017/0098134 | A1 | 4/2017 | Jones et al. | G06K 9/20 |
| 2018/0297803 | A1* | 10/2018 | Nishida et al. | B65H 5/025 |
| 2020/0209799 | A1* | 7/2020 | Isobe | G03G 15/6552 |

FOREIGN PATENT DOCUMENTS

| | | | | |
|---|---|---|---|---|
| EP | 1764751 | B1 | 10/2012 | |
| GB | 2464826 | A | 5/2010 | G07D 11/00 |
| KR | 10-2010-0083274 | A | 7/2010 | |
| WO | 91/11778 | A1 | 8/1991 | G06K 9/00 |
| WO | 92/07717 | A1 | 5/1992 | |
| WO | 92/17394 | A1 | 10/1992 | B65H 3/06 |
| WO | 93/23824 | A1 | 11/1993 | G06K 9/00 |
| WO | 95/24691 | A1 | 9/1995 | G06K 9/00 |
| WO | 96/10800 | A1 | 4/1996 | G06K 9/00 |
| WO | 96/36933 | A1 | 11/1996 | G06K 9/00 |
| WO | 96/41278 | A1 | 12/1996 | |
| WO | 97/30422 | A1 | 8/1997 | G07D 7/00 |
| WO | 97/43734 | A1 | 11/1997 | G06K 9/00 |
| WO | 97/45810 | A1 | 12/1997 | G07D 7/00 |
| WO | 98/12662 | A1 | 3/1998 | G06K 9/00 |
| WO | 98/13785 | A1 | 4/1998 | G06K 9/46 |
| WO | 98/24052 | A1 | 6/1998 | G06K 9/00 |
| WO | 98/24067 | A1 | 6/1998 | G07D 3/14 |
| WO | 98/35323 | A2 | 8/1998 | |
| WO | 98/40839 | A2 | 9/1998 | |
| WO | 98/47100 | A1 | 10/1998 | G06K 9/78 |
| WO | 98/50892 | A1 | 11/1998 | G07D 7/00 |
| WO | 99/09511 | A1 | 2/1999 | G06K 9/00 |
| WO | 99/14668 | A1 | 3/1999 | G06F 9/445 |
| WO | 99/23601 | A1 | 5/1999 | G06K 9/00 |
| WO | 99/41695 | A1 | 8/1999 | G06K 5/00 |
| WO | 99/48040 | A1 | 9/1999 | G06K 9/00 |
| WO | 99/48042 | A1 | 9/1999 | G06K 9/20 |
| WO | 00/024572 | A1 | 5/2000 | B31F 1/00 |
| WO | 00/065546 | A1 | 11/2000 | G07F 1/04 |
| WO | 01/008108 | A2 | 2/2001 | |
| WO | 01/059685 | A2 | 8/2001 | G06K 9/00 |
| WO | 01/059723 | A1 | 8/2001 | G07F 7/04 |
| WO | 02/029735 | A2 | 4/2002 | G07D 7/00 |
| WO | 02/054360 | A2 | 7/2002 | G07D 11/00 |
| WO | 03/005312 | A1 | 1/2003 | G07F 19/00 |
| WO | 03/028361 | A2 | 4/2003 | |
| WO | 03/029913 | A2 | 4/2003 | |
| WO | 03/030113 | A1 | 4/2003 | G07F 7/04 |
| WO | 03/067532 | A1 | 8/2003 | G07F 7/04 |
| WO | 03/107282 | A2 | 12/2003 | |
| WO | 04/010367 | A1 | 1/2004 | G06K 5/00 |
| WO | 04/027717 | A2 | 4/2004 | |
| WO | 04/036508 | A2 | 4/2004 | G07D 7/12 |
| WO | 04/038631 | A2 | 5/2004 | G06F 17/60 |
| WO | 04/068422 | A1 | 8/2004 | G07D 11/00 |
| WO | 05/013209 | A2 | 2/2005 | G07D 11/00 |
| WO | 05/017842 | A1 | 2/2005 | G07D 11/00 |
| WO | 05/028348 | A2 | 3/2005 | B65H 1/00 |
| WO | 05/029240 | A2 | 3/2005 | |
| WO | 05/036445 | A1 | 4/2005 | G06F 19/00 |
| WO | 05/041134 | A2 | 5/2005 | |
| WO | 05/076229 | A1 | 8/2005 | G07D 7/12 |
| WO | 06/039439 | A2 | 4/2006 | G06K 9/00 |
| WO | 06/076289 | A2 | 7/2006 | G07D 11/00 |
| WO | 06/076634 | A2 | 7/2006 | G06Q 90/00 |
| WO | 07/044570 | A2 | 4/2007 | G07D 11/00 |
| WO | 07/120825 | A2 | 10/2007 | G06K 9/00 |
| WO | 07/143128 | A2 | 12/2007 | B65H 29/12 |

(56) References Cited

FOREIGN PATENT DOCUMENTS

| | | | | |
|---|---|---|---|---|
| WO | 08/030356 | A1 | 3/2008 | G06K 7/00 |
| WO | 08/112132 | A1 | 9/2008 | G06K 9/00 |
| WO | 11/109569 | A1 | 9/2011 | G07D 11/00 |
| WO | 2015040901 | A1 | 3/2015 | |
| ZA | 200104395 | B | 12/2001 | |

* cited by examiner

BANKNOTE TRANSPORT MECHANISMS AND METHODS

CLAIM OF PRIORITY AND CROSS-REFERENCE TO RELATED APPLICATION

The present application claims the benefit of priority to U.S. Provisional Application Serial No. 62/781,129 filed Dec. 18, 2018, incorporated herein by reference in its entirety.

FIELD OF THE DISCLOSURE

The present disclosure relates generally to banknote or currency bill processing, and more particularly to apparatuses and systems for transporting banknotes within banknote processing devices and related methods.

BACKGROUND OF THE DISCLOSURE

Previous currency processing devices have various unrecognized shortcomings.

SUMMARY

According to some embodiments, a banknote transport mechanism comprises a plurality of driven rollers positioned on a driven roller shaft wherein the driven roller shaft rotates about a driven roller axis; and a plurality of low friction rails, each low friction rail having a longitudinal axis generally parallel to a direction of banknote transport. The driven roller axis is oriented generally perpendicular to the direction of banknote transport along a transport path. The driven rollers are offset laterally in a direction transverse to the direction of banknote transport from the lateral location of each rail. The driven rollers cooperate with the rails to transport a banknote in the direction of banknote transport with the banknote being corrugated in a direction generally transverse to the direction of banknote transport.

According to some embodiments, a banknote transport mechanism comprises a plurality of driven roller shafts spaced apart in a direction of banknote transport along a transport path, wherein a plurality of driven rollers are positioned on each driven roller shaft, wherein each driven roller shaft rotates about a respective driven roller axis. The banknote transport mechanism further comprises a plurality of low friction rails, each low friction rail having and upper surface and a longitudinal axis generally parallel to a direction of banknote transport. The plurality of driven roller axes are oriented generally perpendicular to the direction of banknote transport along the transport path. The plurality of driven roller axes generally lie in a first plane and the upper surfaces of the low friction rails generally lie in a second plane parallel to the first plane. The driven rollers of each driven roller shaft are offset laterally in a direction transverse to the direction of banknote transport from the lateral location of each rail. The driven rollers cooperate with the rails to transport a banknote in the direction of banknote transport with the banknote being corrugated in a direction generally transverse to the direction of banknote transport.

According to some embodiments, a method of transporting banknotes along a transport path using a banknote transport mechanism comprises transporting a banknote in a direction of banknote transport along the transport path with the banknote being corrugated in a lateral direction generally transverse to the direction of banknote transport while the banknote is generally flat in the direction of banknote transport at a plurality of lateral locations.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, which are considered to be inventive singly or in any combination, will be readily apparent from the following detailed description of representative embodiments and modes for carrying out the present inventions when taken in connection with the accompanying drawings and the appended claims.

Figure 1:
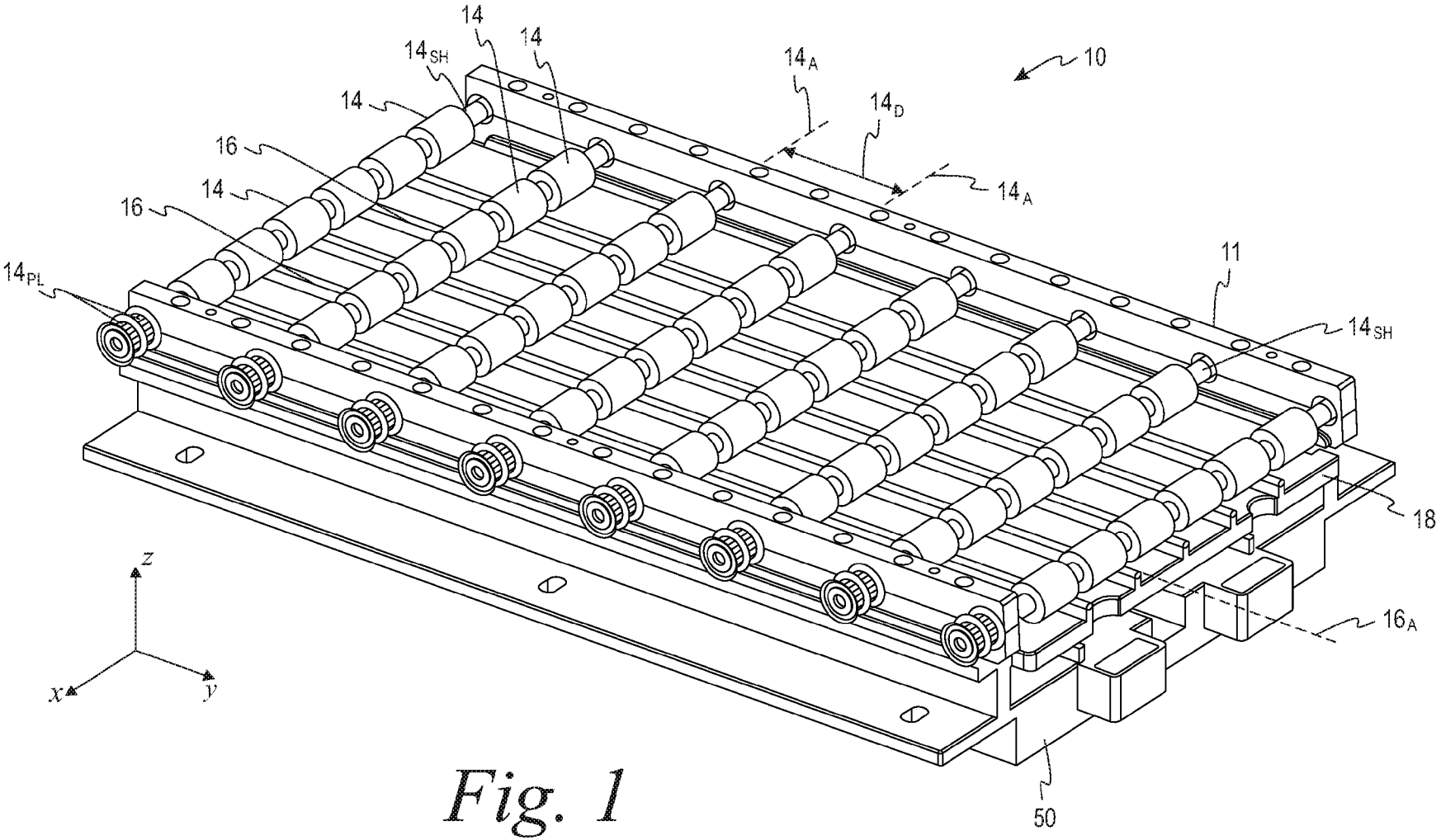
FIG. 1 is a perspective view of a banknote transport mechanism according to some embodiments of the present disclosure employing one or more rails.

The present disclosure is susceptible to various modifications and alternative forms, and some representative embodiments have been shown by way of example in the drawings and will be described in detail herein. It should be understood, however, that the inventive aspects are not limited to the particular forms illustrated in the drawings. Rather, the disclosure is to cover all modifications, equivalents, combinations, and alternatives falling within the spirit and scope of the inventions as defined by the appended claims.

DETAILED DESCRIPTION OF THE ILLUSTRATED EMBODIMENTS

Figure 2:
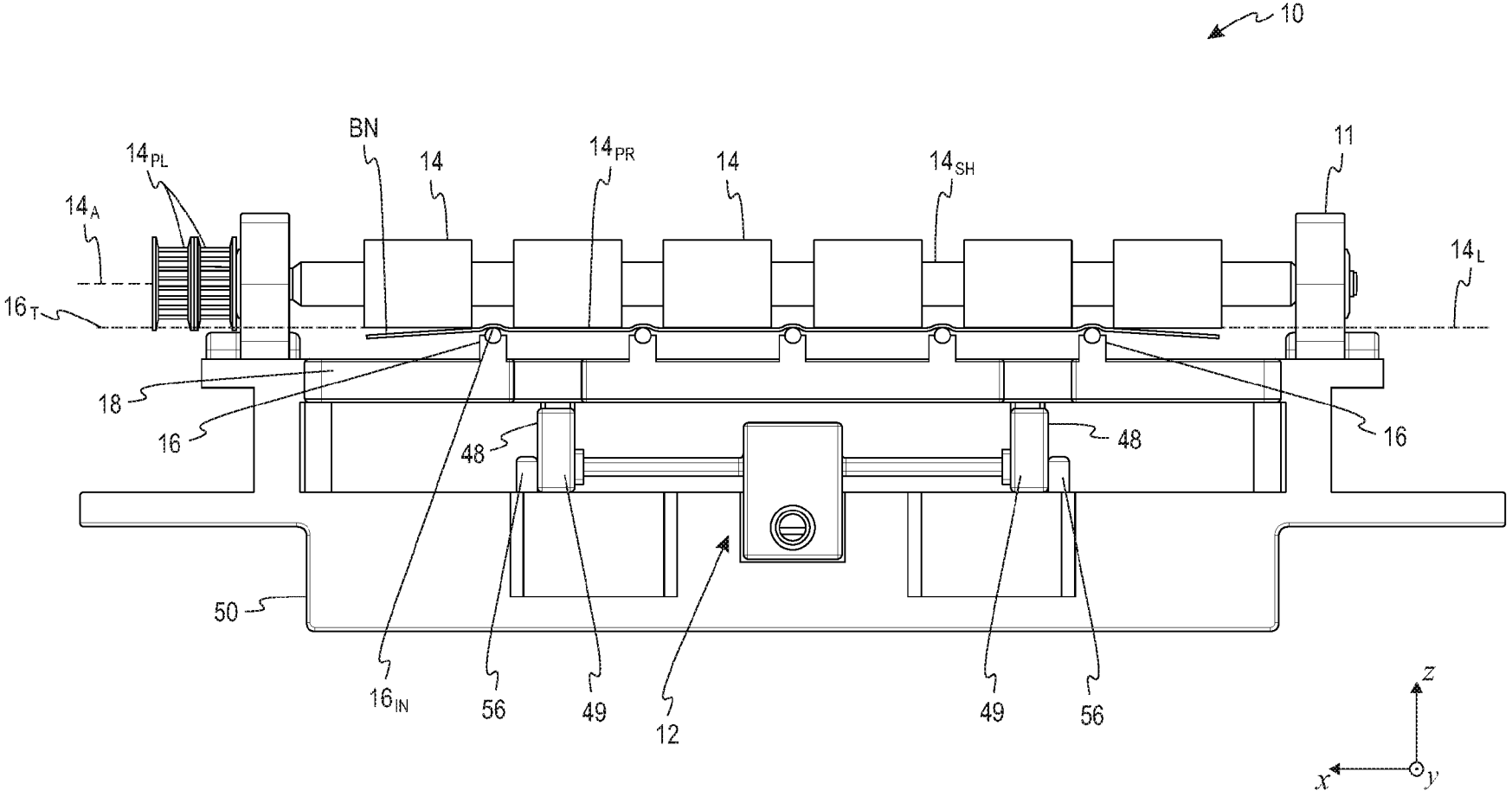
FIG. 2 is a cross-sectional view of the banknote transport mechanism of FIG. 1.

FIG. 1 is a perspective view of a banknote transport mechanism according to some embodiments of the present disclosure employing one or more rails 16 and FIG. 2 is a cross-sectional view of the banknote transport mechanism of FIG. 1.

As seen in FIGS. 1 and 2, according to some embodiments a banknote transport mechanism 10 comprises a plurality of driven rollers 14 fixedly mounted to or positioned on a plurality of driven roller shafts $\mathbf{14}_{SH}$. The driven rollers 14 and the driven roller shafts $\mathbf{14}_{SH}$ rotate about respective driven roller axes $\mathbf{14}_{A}$. The banknote transport mechanism 10 also comprises a plurality of low friction rails 16. Each low friction rail 16 has a longitudinal length and a longitudinal axis $\mathbf{16}_{A}$ generally parallel to a direction of banknote transport Y. The driven roller axes $\mathbf{14}_{A}$ are oriented generally perpendicular to the direction of banknote transport Y. As best shown in FIG. 2, the driven rollers 14 on a given driven roller shaft $\mathbf{14}_{SH}$ are offset laterally in a X-direction transverse to the direction of banknote transport Y from the lateral location of each rail 16.

The driven roller shafts $\mathbf{14}_{SH}$ and the low friction rails 16 are coupled to a transport mechanism frame 11. An outer periphery $\mathbf{14}_{PR}$ of driven rollers 14 extends into a banknote transport path and contact banknotes being transported along the transport path. Referring to the embodiment shown in FIG. 2, in which the driven rollers 14 are positioned above the transport path, the driven rollers 14 extend downward into the transport path to a path-side driven roller level $\mathbf{14}_{L}$ as determined by the outer periphery or circumference $\mathbf{14}_{PR}$ and maximum radius of each driven roller 14. In FIG. 2, the outer periphery or surface of each driven roller 14 is flat in the lateral direction and the rollers have a constant cross-sectional radius across the lateral dimension of the rollers 14. Conversely, each low friction rail 16 extends into the transport path from the opposite side of the transport path as driven rollers 14. In FIG. 2, in which the low friction rails 16 are positioned below the transport path, the upper or interior or distal ends or surfaces $\mathbf{16}_{IN}$ of the rails 16 extend upward into the transport path to a path-side rail level $\mathbf{16}_{T}$ as determined by the top or distal surface $\mathbf{16}_{IN}$ of each rail 16. The top or distal surface $\mathbf{16}_{IN}$ of each rail 16 contacts banknotes being transported along the transport path. According to some embodiments, as shown in FIG. 2, the driven rollers 14 and the low friction rails 16 are positioned relative to each other such that the periphery or circumference $\mathbf{14}_{PR}$ of the driven rollers 14 extends into the transport path at or beyond the position the interior ends $\mathbf{16}_{IN}$ of the rails 16. According to some embodiments, as the driven rollers 14 are laterally offset from the rails 16, a banknote BN being transported along the transport path becomes corrugated by the forces applied from one side of the transport path by the driven rollers 14 and the opposing forces applied by the rails 16 from the other side of the transport path.

According to some embodiments, the driven rollers 14 and/or the outer periphery $\mathbf{14}_{PR}$ of driven rollers 14 are made of high-friction material such as, for example, rubber and/or urethane and/or polyurethane.

Each driven roller shaft $\mathbf{14}_{SH}$ is rotationally driven by one or more motors controlled by one or more processors or controllers. According to some embodiments, a single motor drives one or more non-slip timing belts which operatively engage pulleys $\mathbf{14}_{PL}$ fixedly mounted to an end of each driven roller shaft $\mathbf{14}_{SH}$. According to some embodiments, rotationally speed of the outer periphery $\mathbf{14}_{PR}$ of the driven rollers 14 are speed matched to the linear banknote transport rate at which banknotes are fed into the transport mechanism 10 such as by a banknote feeder.

The banknote transport mechanism 10 functions by using a series of driven rollers 14 cooperating with the low friction rails 16 to pull and/or push banknotes BN, one along a banknote path in the direction of banknote transport Y. According to some prior banknote transport mechanisms, a banknote was sandwiched between a pair of speed matched conveyor belts which were routed to direct a banknote to another location. Alternatively, according to some prior banknote transport mechanisms, a banknote was pulled along a banknote path as the banknote passed between a pair of rollers positioned on opposite sides of banknote path, with one of the rollers in each pair being a driven roller and the other opposing roller being a passive, pressure roller that was driven by contact with the driven roller in the absence of a banknote being located therebetween. Each pressure roller was spring biased into contact with a corresponding driven roller. The spring bias allowed a pair of driven and pressure rollers to separate when a banknote entered between them. Banknotes were thus driven downstream from one pair of driven and pressure rollers to a downstream pair of driven and passive rollers with the next downstream pair of rollers gaining control of the banknote before the previous pair of rollers released the banknote.

According to some embodiments of the present disclosure, rather than using pressure rollers to provide a counter force to create adequate drive friction between a banknote BN and a driven roller 14, a series of fixed position, low friction rails 16 are employed to provide that force. As seen in FIG. 2, the location of the running or distal surface of the rails $\mathbf{16}_{IN}$ relative to an outer surface or outer periphery $\mathbf{14}_{PR}$ of the driven rollers 14 is such that a slight non-damaging corrugation is introduced and maintained into the cross section of the banknote BN as it is transported along the banknote path. According to some embodiments, the corrugation provides column strength to the banknote to allow it to be pushed as well as pulled in the transport direction along the transport path. In addition, the corrugation of the banknote causes the banknote to become elastic/resilient in a direction normal (Z-direction in the example shown in FIG. 2) to the banknote path plane thus creating friction between the banknote BN and the driven roller 14.

Figure 3:
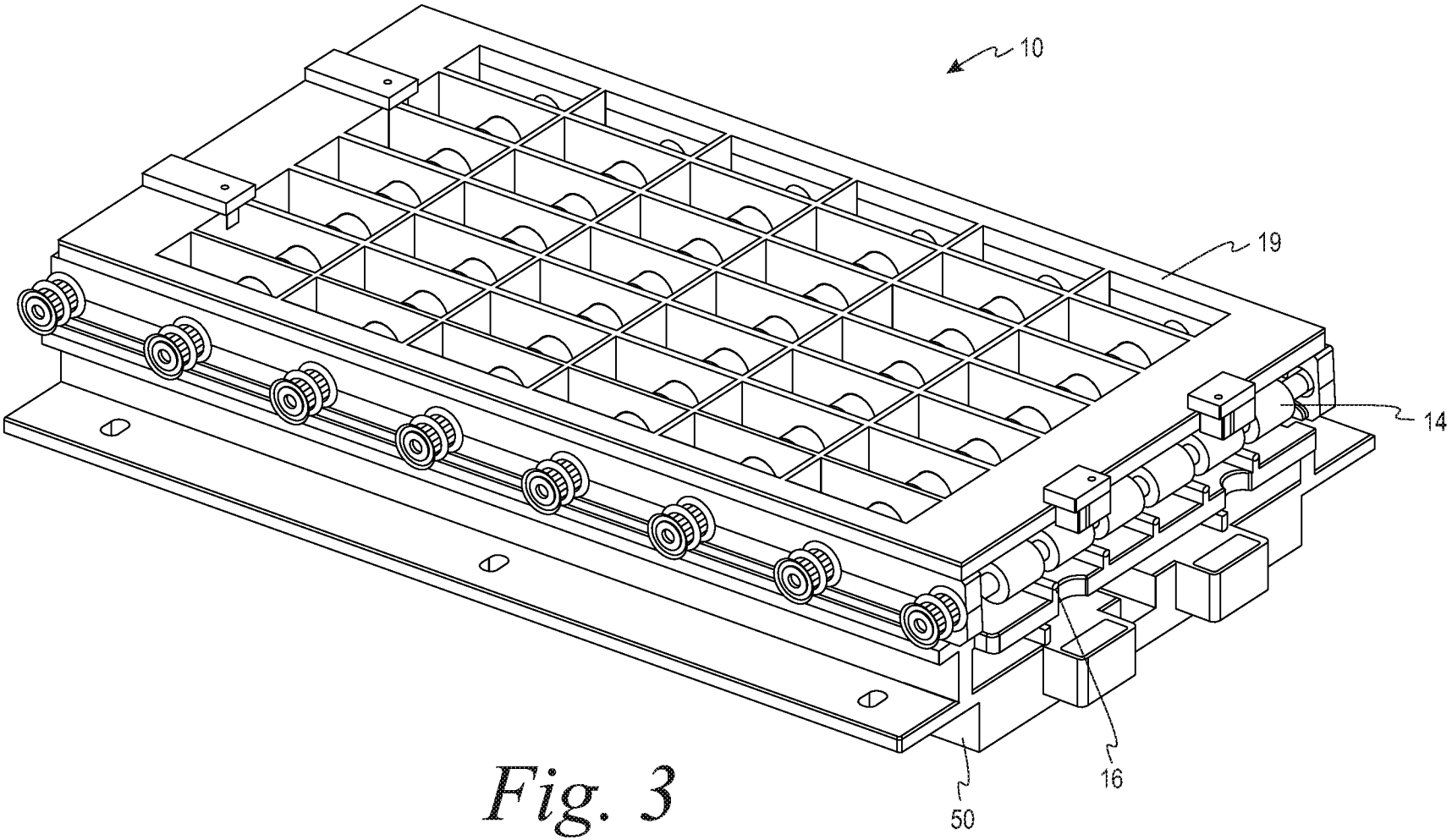
FIG. 3 is a perspective view of a banknote transport mechanism according to some alternative embodiments of the present disclosure.

Turning to FIG. 3, according to some alternative embodiments, the banknote transport mechanism 10 may comprise a hold-down rail plate 19. According to some such embodiments, the hold-down rail plate 19 provides a means to keep a banknote from lifting and/or flying out of the paper path between the driven rollers 14. However, the corrugation of transported banknotes BN may inhibit or prevent banknotes from doing so making the hold-down rail plate 19 unnecessary.

In the embodiments illustrated in FIGS. 1-3, each driven roller shaft $\mathbf{14}_{SH}$ of the transport mechanism 10 comprises six (6) high-friction driven rollers 14 and five (5) low friction rails 16 running longitudinally between the driven rollers 14. Other quantities of driven rollers 14 and rails 16 or their axial spacing and/or dimensions could be used to according to alternative embodiments, such as, for example, six rollers and seven rails, five rollers and four rails, etc.

The drive roller shafts $\mathbf{14}_{SH}$ are axially constrained in translation but are free to rotate about their axes $\mathbf{14}_{A}$. According to some embodiments, the distance $\mathbf{14}_{D}$ (shown in FIG. 1) between the axes $\mathbf{14}_{A}$ of adjacent drive roller shafts $\mathbf{14}_{SH}$ is such that a banknote is always in contact with a driven roller 14.

As illustrated in FIGS. 1-3, the surface or outer periphery $\mathbf{14}_{PR}$ of the driven rollers 14 are flat faced. However, according to some embodiments, the surface or outer periphery $\mathbf{14}_{PR}$ of the driven rollers 14 may be crowned (see, e.g., FIGS. 7A, 7B) or concave (see, e.g., FIGS. 8A, 8B, 9A, 9B) and/or may have raised surfaces at or near their lateral edges (see, e.g., FIGS. 9A, 9B). According to some embodiments, the surface or outer periphery $\mathbf{14}_{PR}$ of the driven rollers 14 are crowned or otherwise shaped to achieve maximum contact area with banknotes being transported, to achieve higher friction with the banknotes, and/or to introduce corrugation into the banknotes in the most predictable and stress-reduced geometry as possible. According to some embodiments, the surface or outer periphery $\mathbf{14}_{PR}$ of the driven rollers 14 have a high-coefficient of friction.

According to some embodiments, the low friction rails 16 may be removably coupled to the frame 11 for easy replacement. According to some embodiments, the low friction rails 16 are fabricated from a low friction / high abrasion resistance material such as, for example, metal, plastic, glass, and/or ceramic such as stainless steel, tungsten, or steel such as with any of a various types of plating such as electroless nickel or electroless nickel infused with with PTFE (teflon), low friction and/or abrasion resistant plastics such as acetal polyoxymethylene thermoplastic, Texin 255 Urethane Thermoplastic Elastomer, or Ultra-high-molecular-weight polyethylene (UHMWPE, UHMW).

According to some embodiments, a rail position adjustment mechanism 12 may be employed to adjust the spacing of the interior or distal ends $\mathbf{16}_{IN}$ of the rails 16 relative to the outer periphery or circumference $\mathbf{14}_{PR}$ of the driven rollers 14. In FIG. 2, the rails 16 are coupled to the rail position adjustment mechanism 12 which in turn is coupled to the frame 11. In some embodiments, the rail position adjustment mechanism 12 takes the form of a parallel/inclined plane located underneath a rail carrying plate 18 which carries the rails 16 and enables adjustment of the distance between the rails 16 relative to the driven rollers 14. According to such embodiments, the parallel/inclined plane mechanism adjustment mechanism ensures that the plane of the longitudinal axes $\mathbf{16}_{A}$ of the rails 16 remains parallel to the plane of the driven roller axes $\mathbf{14}_{A}$. The rail position adjustment mechanism 12 controls the degree of interference distance between the two aforementioned planes.

Figure 4A:
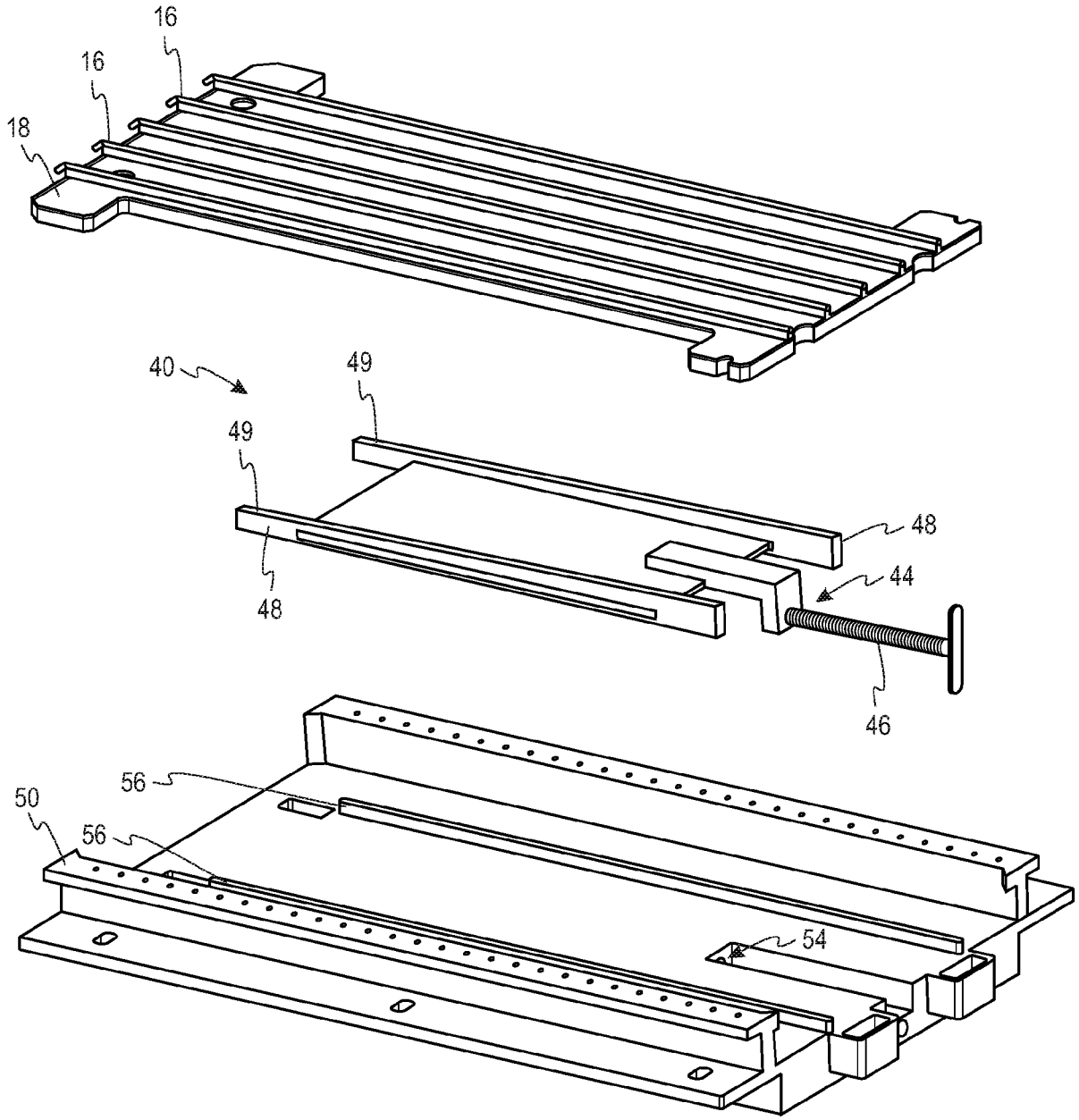
FIG. 4A is an exploded perspective view and FIG. 4B is an exploded side view of a rail carrying plate, a rail adjustment wedge, and a base plate according to some embodiments.
Figure 4B:
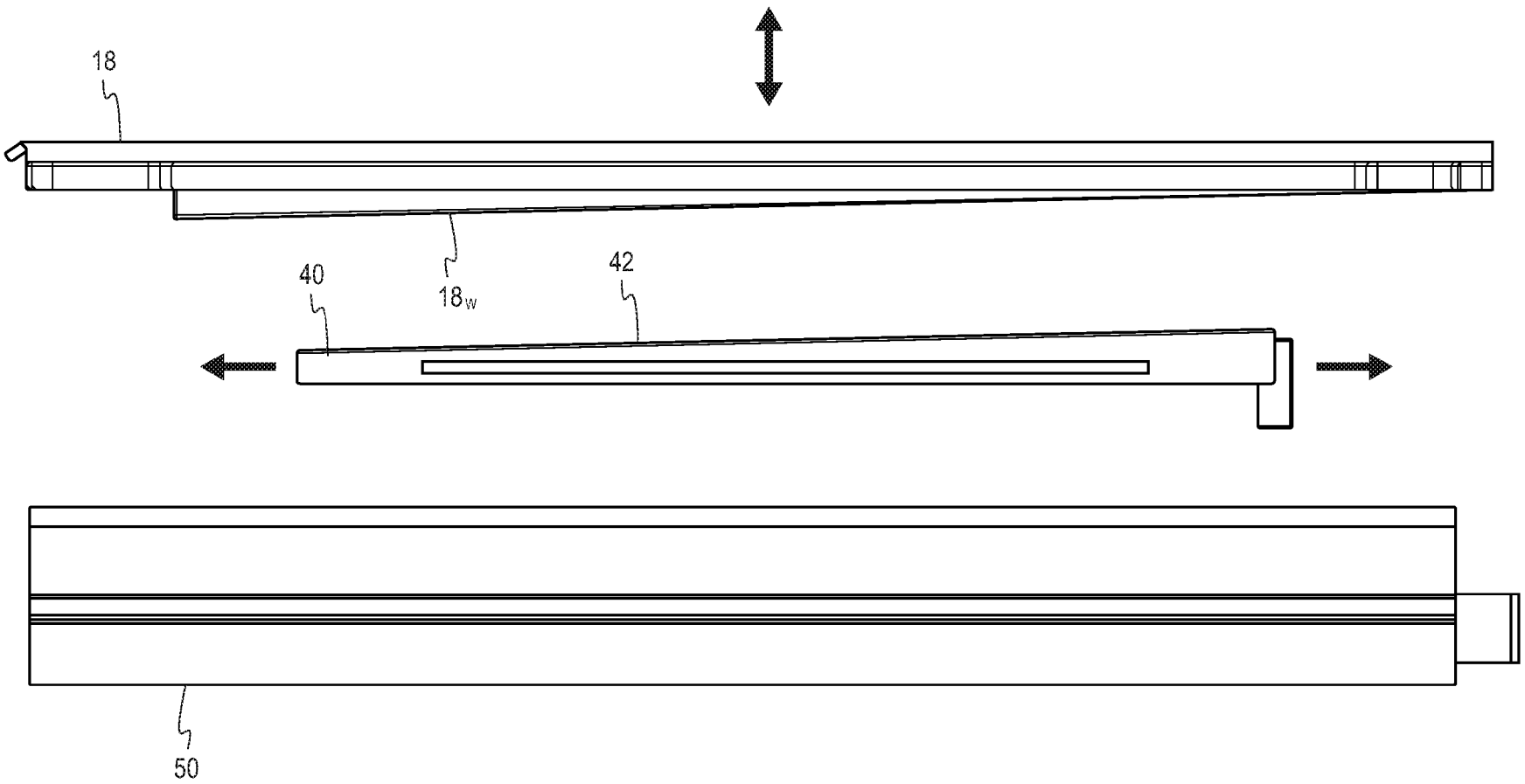
Figure 4C:
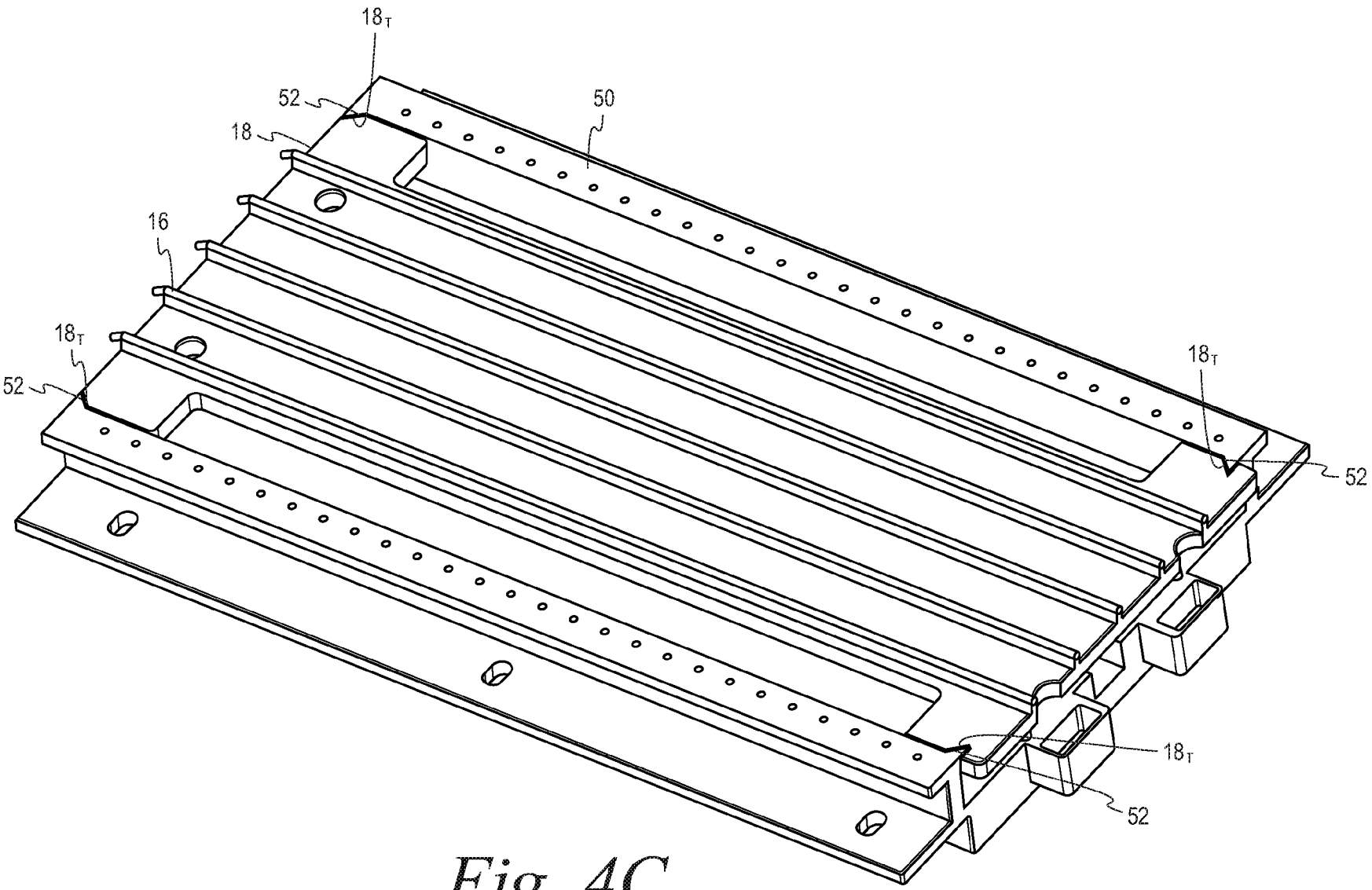
FIG. 4C is a top perspective view of a rail carrying plate within a base plate according to some embodiments.
Figure 4D:
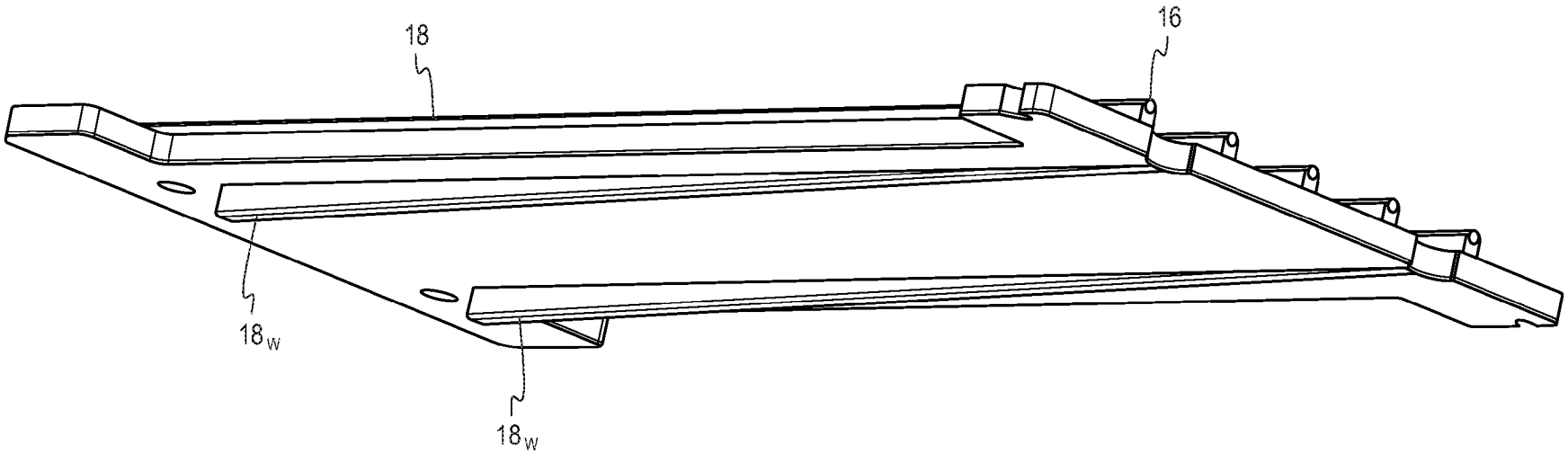
FIG. 4D is a bottom perspective view of a rail carrying plate according to some embodiments.

Referring to FIGS. 4A-4D, an example of a rail position adjustment mechanism 12 is shown. FIG. 4A is an exploded perspective view and FIG. 4B is an exploded side view of a rail carrying plate 18, a rail adjustment wedge 40, and a base plate 50 according to some embodiments. FIG. 4C is a top perspective view of the rail carrying plate 18 within the base plate 50 according to some embodiments. FIG. 4D is a bottom perspective view of the rail carrying plate 18 according to some embodiments. The rail adjustment wedge 40 has at least one angled surface 42 which in FIGS. 4A and 4B is the top surface and the rail carrying plate 18 has an angled surface $\mathbf{18}_{W}$ configured to engage the rail adjustment wedge 40. According to some embodiments, a threaded rod 46 is threaded through a threaded aperture 44 in the rail adjustment wedge 40 and threaded into a threaded aperture 54 in the base plate 50. As the threaded rod is rotated in one direction the rail adjustment wedge 40 moves to the right in FIGS. 4A-4B and moves to the left when the threaded rod is rotated in the opposite direction. The angled surfaces 42, $\mathbf{18}_{W}$ of the rail adjustment wedge 40 and the rail carrying plate 18, respectively, cooperate so as to cause the rail carrying plate 18 to be raised as the rail adjustment wedge 40 moves to the left and so as to cause the rail carrying plate 18 to be lowered as the rail adjustment wedge 40 moves to the right as illustrated in FIGS. 4A-4B. According to some embodiments, the angles of the angled surfaces 42, $\mathbf{18}_{W}$ of the rail adjustment wedge 40 and the rail carrying plate 18, respectively, are complimentary (e.g., both are angled at x degrees from horizontal but in opposite directions) so that the low friction rails 16 on the rail carrying plate 18 are maintained parallel to the driven roller axes $\mathbf{14}_{A}$ and/or the outer periphery $\mathbf{14}_{PR}$ of driven rollers 14 (e.g., such as all being parallel to a horizontal plane) as the rail adjustment wedge 40 moves to the left and/or right as illustrated in FIGS. 4A-4B. According to some embodiments, the base plate 50 has one or more tabs 52 which engage complimentary shaped edges $\mathbf{18}_{T}$ of the rail carrying plate 18 so as to constrain the movement of the rail carrying plate 18 to a vertical movement while inhibiting the movement of the rail carrying plate 18 in either a longitudinal direction (Y-direction in FIG. 1) or lateral direction (X-direction in FIG. 1) as the longitudinal position of the rail adjustment wedge 40 is changed. According to some embodiments, a pair of base plate rails 56 abut the outer surfaces 48 of longitudinal guides 49 of the rail adjustment wedge 40 and inhibit lateral movement of the rail adjustment wedge 40 constraining the motion of the rail adjustment wedge 40 to a longitudinal motion. While the orientation of the rail carrying plate 18, the rail adjustment wedge 40, and the base plate 50 are shown as substantially horizontal in FIGS. 4A-4D, the orientation can be changed without changing the operation of the rail position adjustment mechanism 12. According to some embodiments, the threaded rod 46 is configured to be manually rotated such as by having a handle at one end. According to some embodiments, a motor may be employed to rotate the threaded rod 46.

According to some embodiments, the driven rollers 14 and the low friction rails 16 are positioned relative to each other such that the periphery or circumference $\mathbf{14}_{PR}$ of the driven rollers 14 extends into the transport path beyond the position the interior or distal ends $\mathbf{16}_{IN}$ of the rails 16 by a distance of approximately 0.030″ inches (about 0.76 mm), that is, an interference distance of approximately 0.030″ inches. According to some embodiments, the interference distance can vary significantly without a detrimental effect to the proper function of the banknote transport mechanism 10. With reference to FIG. 2, a positive interference distance is the distance by which the top or distal surface $\mathbf{16}_{IN}$ of a rail 16 as indicated by height $\mathbf{16}_{T}$ is above the lower height of the outer periphery or circumference $\mathbf{14}_{PR}$ of an adjacent driven roller 14 as indicated by height $\mathbf{14}_{L}$. According to some embodiments, the driven rollers 14 and the low friction rails 16 are positioned relative to each other such that the periphery or circumference $\mathbf{14}_{PR}$ of the driven rollers 14 and the interior or distal ends $\mathbf{16}_{IN}$ of the rails 16 are separated by a negative interference distance of about the thickness of banknotes to be transported such as, for example, a negative interference distance of about 0.004 inches for U.S. banknotes. According to some embodiments, the driven rollers 14 and the low friction rails 16 are positioned relative to each other such that the periphery or circumference $\mathbf{14}_{PR}$ of the driven rollers 14 and the interior or distal ends $\mathbf{16}_{IN}$ of the rails 16 are separated by an interference distance ranging between a negative interference distance of about the thickness of banknotes to be transported and a positive interference distance of approximately 0.030″ inches. According to some embodiments, the driven rollers 14 and the low friction rails 16 are positioned relative to each other such that the distal periphery or circumference $\mathbf{14}_{PR}$ of the driven rollers 14 and the interior or distal ends or surfaces $\mathbf{16}_{IN}$ of the rails 16 are separated by an interference distance ranging between a negative interference distance of about the thickness of banknotes to be transported and a positive interference distance of approximately 0.05″ inches. According to some embodiments, the driven rollers 14 and the low friction rails 16 are positioned relative to each other such that the distal periphery or circumference $\mathbf{14}_{PR}$ of the driven rollers 14 and the interior or distal ends $\mathbf{16}_{IN}$ of the rails 16 are separated by an interference distance ranging between a negative interference distance of about the thickness of banknotes to be transported and a positive interference distance of approximately 0.04″ inches. According to some embodiments, the interference distance is set as small as necessary to achieve reliable, consistent, and accurate transport of banknotes without slippage or skewing.

According to some embodiments, the rail position adjustment mechanism 12 enables the distance between the periphery or circumference $\mathbf{14}_{PR}$ of the driven rollers 14 and the interior or distal ends $\mathbf{16}_{IN}$ of the rails 16 to be readjusted to a desired or target interference distance to compensate for abrasive wear to the periphery or circumference $\mathbf{14}_{PR}$ of the driven rollers 14 and/or the interior or distal ends $\mathbf{16}_{IN}$ of the rails 16. According to some embodiments, the adjustment mechanism 12 allows for the transport mechanism 10 to be continued to be used even as the functional surfaces such as the driven rollers 14 and rails 16 wear down due to abrasion and friction with the banknotes. According to some embodiments, readjustment of the adjustment mechanism 12 is performed manually or automatically. According to some embodiments, one or more sensors are employed to monitor the interference distance(s) between periphery or circumference $\mathbf{14}_{PR}$ of one or more driven rollers 14 and one or more of the interior or distal ends $\mathbf{16}_{IN}$ of the rails 16 and the output of the one or more sensors is coupled to a processor which controls the adjustment mechanism 12 and instructs the adjustment mechanism 12 to adjust as necessary so the interference distance(s) and/or average interference distance are/is maintained within a target range. For example, output of the one or more sensors may be coupled to a processor which controls a motor which turns the threaded rod 46 of FIG. 4A as to adjust the longitudinal position of rail adjustment wedge 40 as necessary so the interference distance(s) and/or average interference distance are/is maintained within a target range.

According to some embodiments, no rail position adjustment mechanism 12 is employed. According to some embodiments, the rail position adjustment mechanism may take other forms such as, for example, lead screws.

Figure 5A:
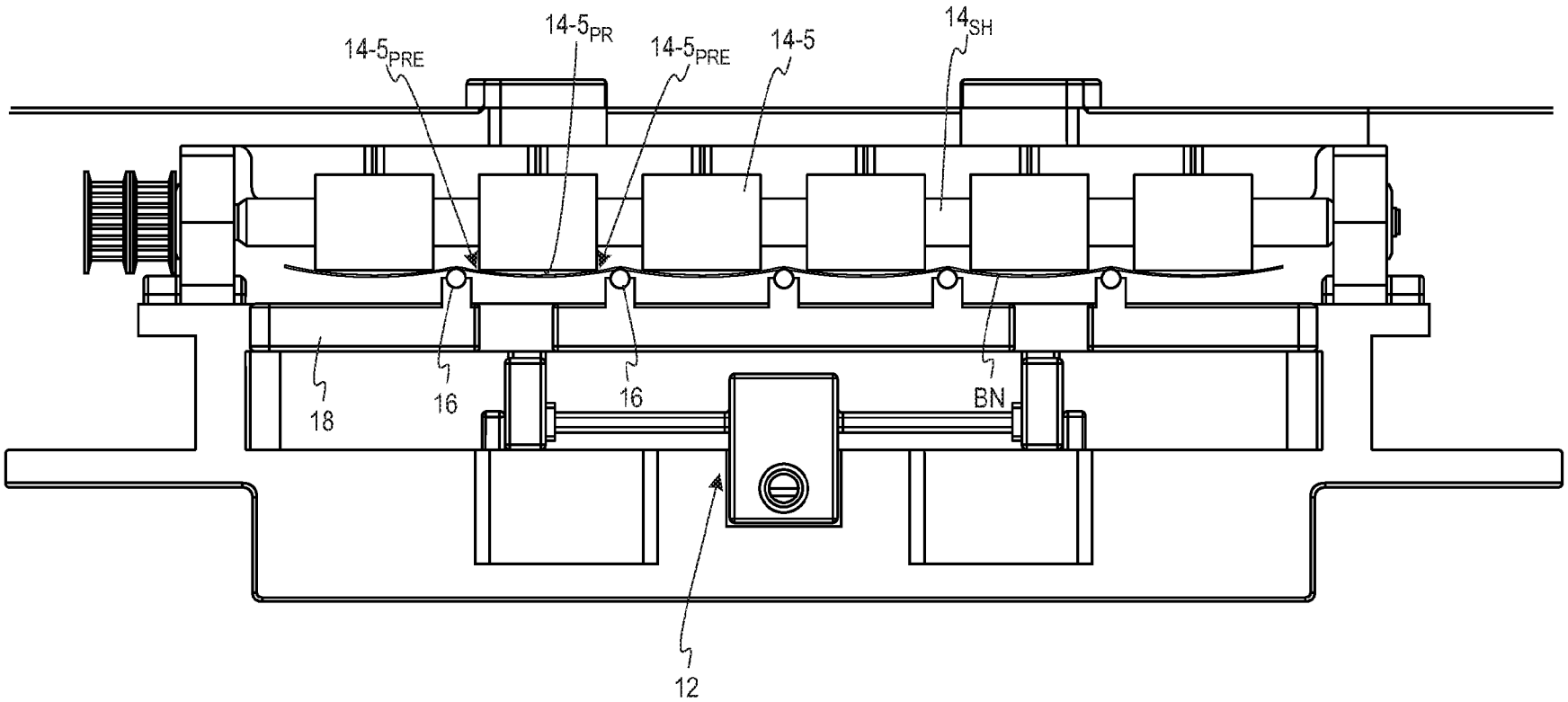
FIG. 5A is a cross-sectional view of a portion of a banknote transport mechanism similar to that shown in FIG. 2 wherein the driven rollers have a flat outer surface and sharp edges and FIG. 5B is an enlarged partial view of FIG. 5A.
Figure 5B:
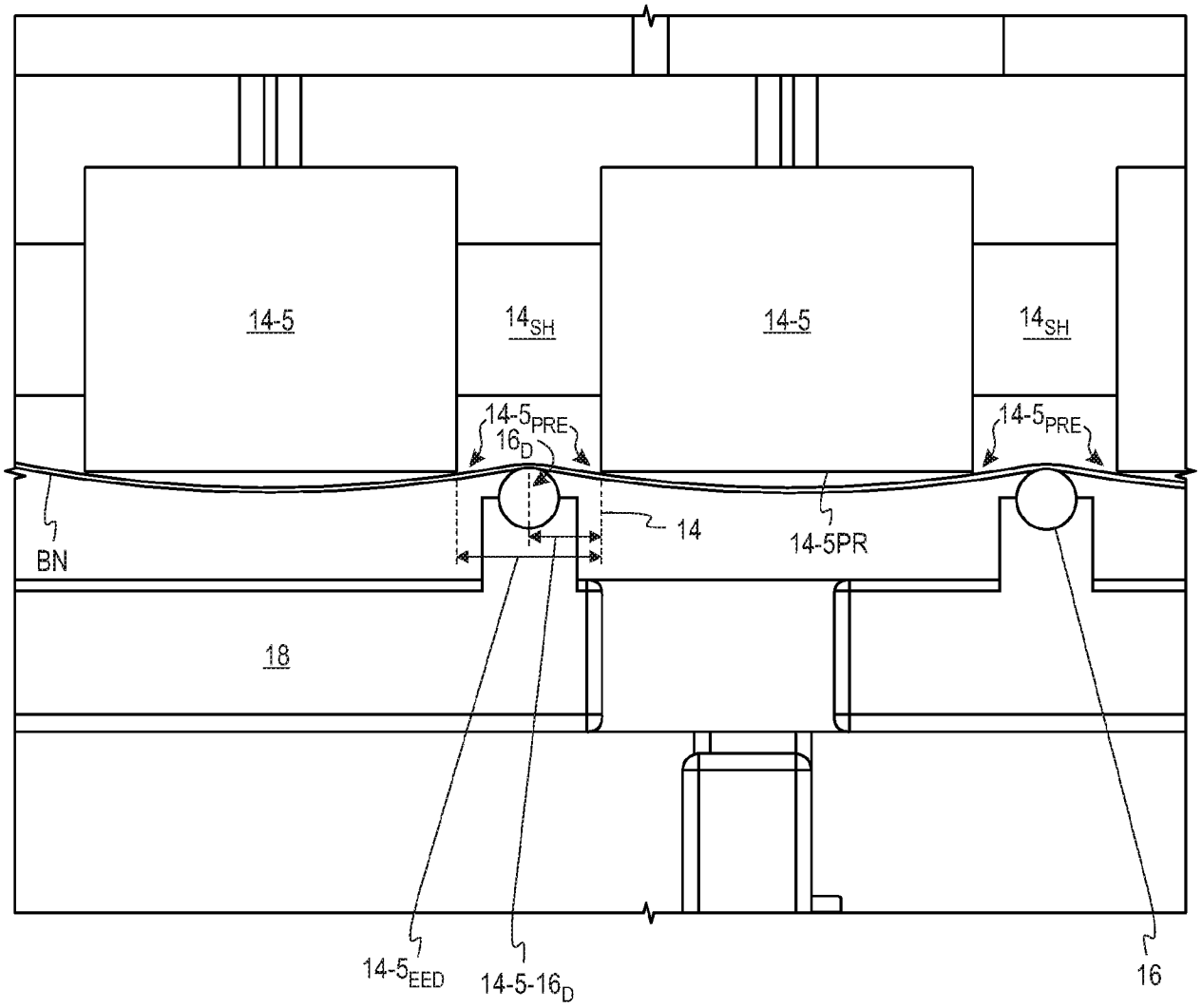

As discussed above, according to some embodiments, the surface or outer periphery $\mathbf{14}_{PR}$ of the driven rollers 14 may have varying shapes. For example, FIG. 5A is a cross-sectional view of a portion of a banknote transport mechanism similar to that shown in FIG. 2 wherein driven rollers 14-5 have a flat outer surface or periphery $\mathbf{14\text{-}5}_{PR}$ of driven rollers 14-5 and sharp lateral edges $\mathbf{14\text{-}5}_{PRE}$. FIG. 5B is an enlarged partial view of FIG. 5A. As seen in FIGS. 5A and 5B, according to some embodiments, the shape of the outer surface or periphery $\mathbf{14\text{-}5}_{PR}$ and the shape of the lateral edges $\mathbf{14\text{-}5}_{PRE}$ of the driven rollers 14-5 may cause a banknote BN being transported along a transport path to bow away from the lateral middle of the driven rollers 14-5.

In general, the shape of the outer surface or periphery $\mathbf{14}_{PR}$, $\mathbf{14\text{-}5}_{PR}$; the shape of the lateral edges $\mathbf{14}_{PRE}$, $\mathbf{14\text{-}5}_{PRE}$ of the driven rollers 14, 14-5; the shape of the distal end of the rail 16 (or pressure roller or belt as described below); the distance $\mathbf{14\text{-}5}_{EED}$ between two laterally adjacent edges $\mathbf{14\text{-}5}_{PRE}$ of driven rollers 14, 14-5; the distance $\mathbf{14\text{-}5\text{-}16}_{D}$ between an edge $\mathbf{14\text{-}5}_{PRE}$ of a driven rollers 14, 14-5 and a laterally adjacent rail 16 (or pressure roller or belt); and the interference distance may influence how a banknote BN positioned between the driven rollers 14, 14-5 and rails 16 (or pressure rollers or belts) is shaped during transport by the transport mechanism and/or how a corresponding transport mechanism transports banknotes along a corresponding transport path. The lateral center of the rail 16 is indicated as $\mathbf{16}_{D}$. Likewise, the coefficient of friction of the above components such as the outer surface or periphery $\mathbf{14}_{PR}$, $\mathbf{14\text{-}5}_{PR}$, the lateral edges $\mathbf{14}_{PRE}$, $\mathbf{14\text{-}5}_{PRE}$ of the driven rollers, and/or the distal ends of the rails 16 (or pressure rollers or belts) influence how a corresponding transport mechanism transports banknotes along a corresponding transport path.

In general, if the cross-path gap between the distal portions of the rails 16 (or pressure rollers or belts) and the driven rollers is less than the thickness of the media being transported such as a banknote, then friction is created, and the media/banknote moves forward along the transport path. According to some embodiments, friction can be increased by reducing the gap between the distal surface $\mathbf{16}_{IN}$ of the rail 16 (or pressure roller or belt) and the adjacent driven roller(s). According to some embodiments, the gap can be reduced to the point where the distal surface $16_{IN}$ of the rail 16 sits in a trough between adjacent driven rollers (that is, there is a positive interference distance). According to such embodiments, the distal surface $16_{IN}$ of the rail 16 has a negative spacing or gap (positive interference distance) in relation to the distal surface (outer surface or periphery) $14_{PR}$ of the adjacent driven roller.

In addition to the cross-path gap between the distal portions of the rails 16 and the driven rollers, other dimensions that are important according to some embodiments are the width of the gap between laterally adjacent driven rollers 14-5$_{EED}$ and the width of a corresponding rail 16 (or pressure roller or belt) laterally positioned therebetween and/or the lateral distance between the contact location(s) of a banknote with a rail (or pressure roller or belt) and a laterally adjacent driven roller. According to some embodiments, a maximum friction may be obtained if the rail (or pressure roller or belt) is 0.001″ narrower than the spacing between the adjacent driven rollers. According to some embodiments, as the cross-path gap (associated with the interference distance) between the adjacent driven rollers and the rail (or pressure roller or belt) decreases, the side or lateral clearance between the laterally adjacent driven rollers and the rail 16 also decreases, increasing the overall frictional drive force. If, however, the rail 16 (or pressure roller or belt) is significantly narrower (for example: 0.020″ narrower) than the spacing between laterally adjacent driven rollers, the friction force may not increase as dramatically as the cross-path gap between the distal portions of the rails 16 and the driven rollers is decreased (as described in the preceding paragraph). According to some embodiments, the minimum difference between the width of the rail 16 (or pressure roller or belt) and the gap between laterally adjacent driven rollers 14-5$_{EED}$ may be approximately 0.001″. According to some embodiments, the maximum difference between the width of the rail 16 (or pressure roller or belt) and the gap between laterally adjacent driven rollers 14-5$_{EED}$ may be approximately ¼″.

Figure 6A:
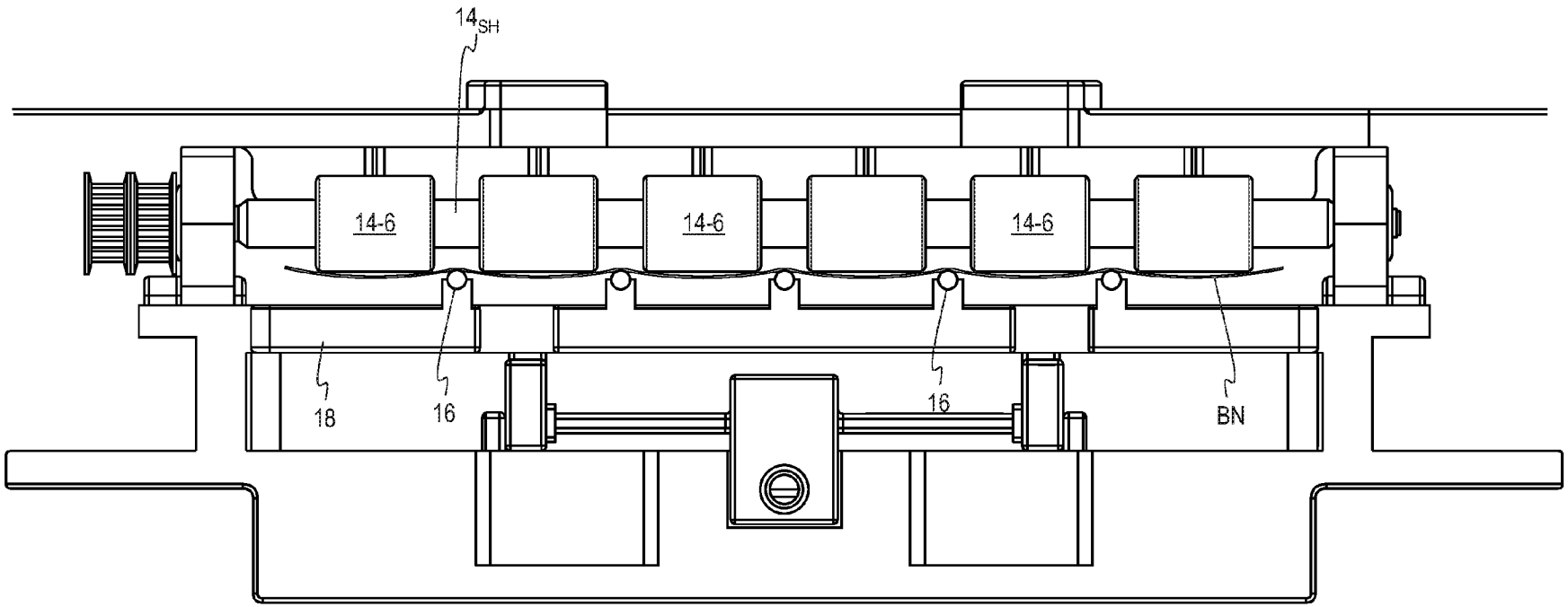
FIG. 6A is a cross-sectional view of a portion of a banknote transport mechanism similar to that shown in FIG. 2 wherein the driven rollers have a flat outer surface and radiused edges and FIG. 6B is an enlarged partial view of FIG. 6A.
Figure 6B:
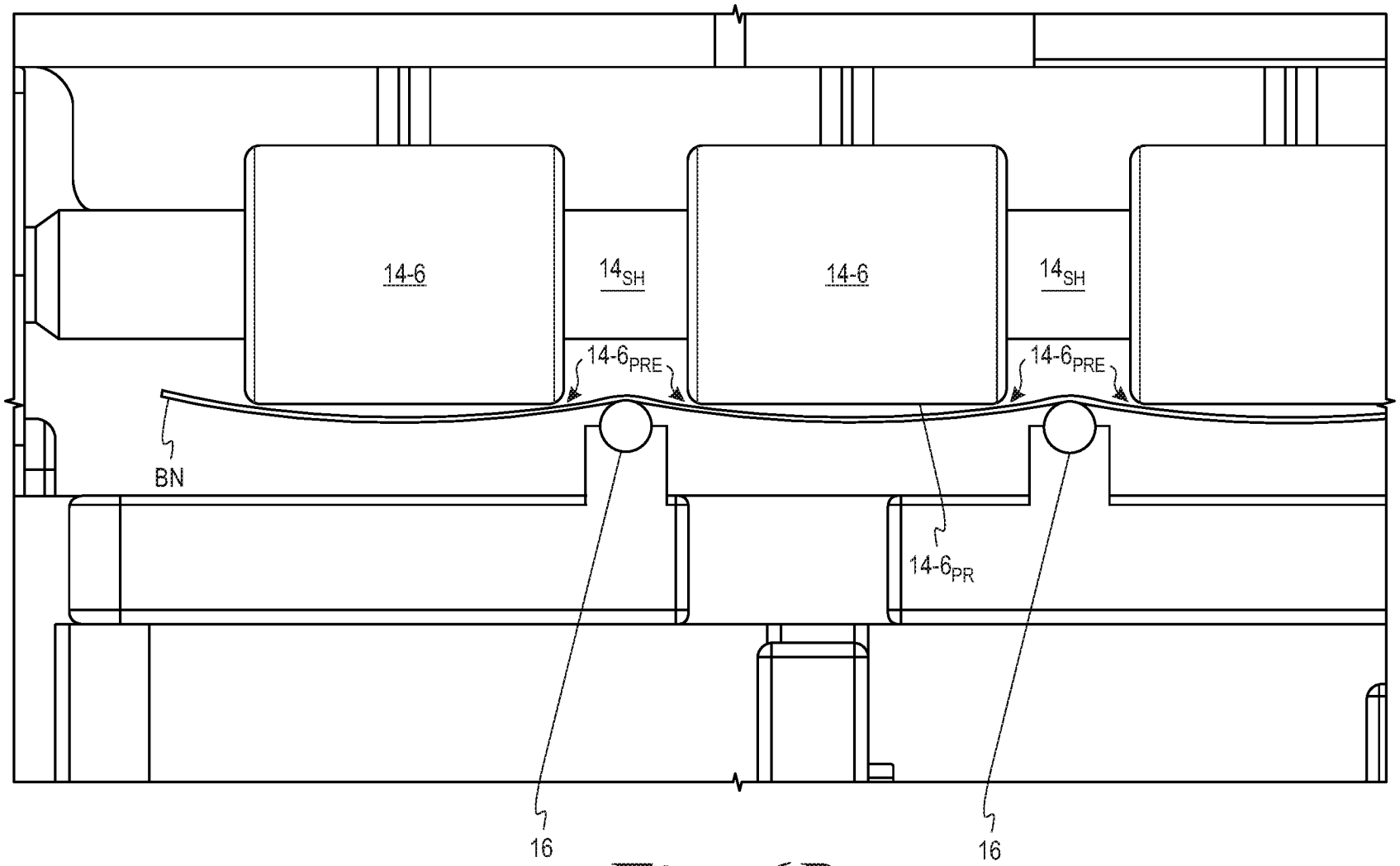

FIG. 6A is a cross-sectional view of a portion of a banknote transport mechanism similar to that shown in FIG. 2 wherein the driven rollers 14-6 have a flat outer surface 14-6$_{PR}$ and radiused or rounded lateral edges 14-6$_{PRE}$. FIG. 6B is an enlarged partial view of FIG. 6A.

Figure 7A:
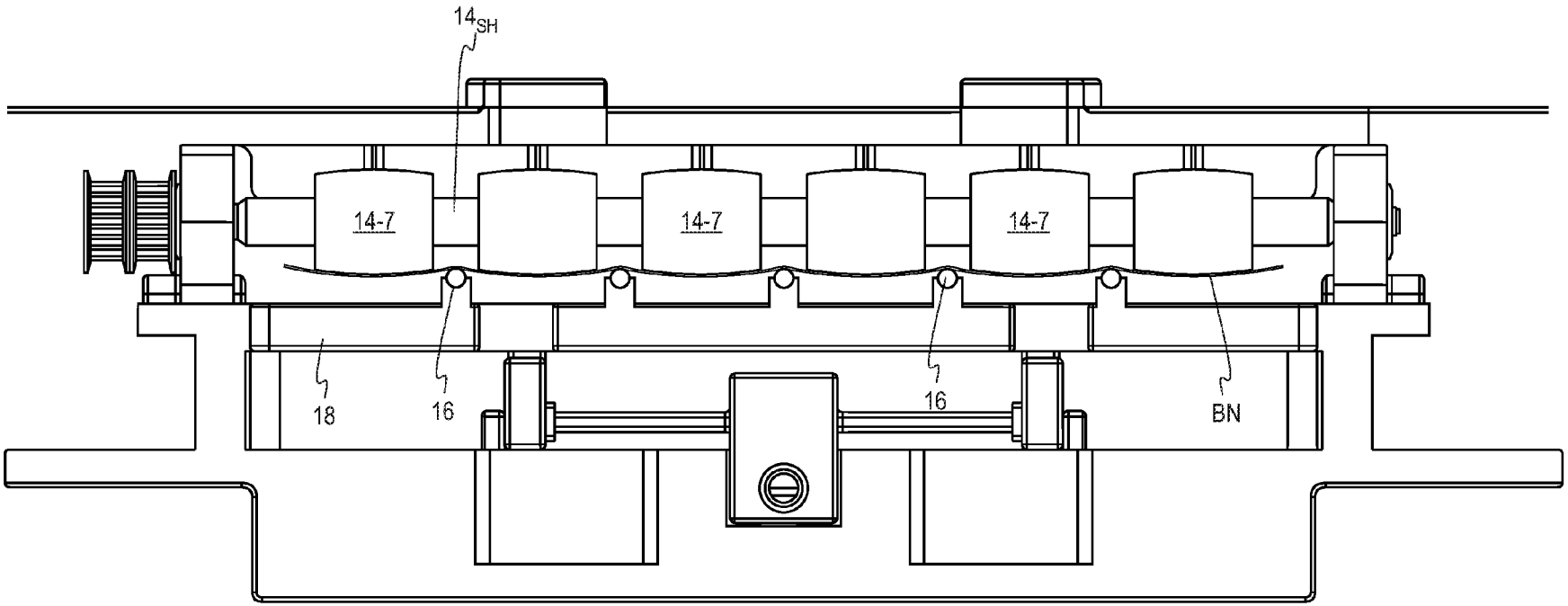
FIG. 7A is a cross-sectional view of a portion of a banknote transport mechanism similar to that shown in FIG. 2 wherein the driven rollers have a crowned outer surface and FIG. 7B is an enlarged partial view of FIG. 7A.
Figure 7B:
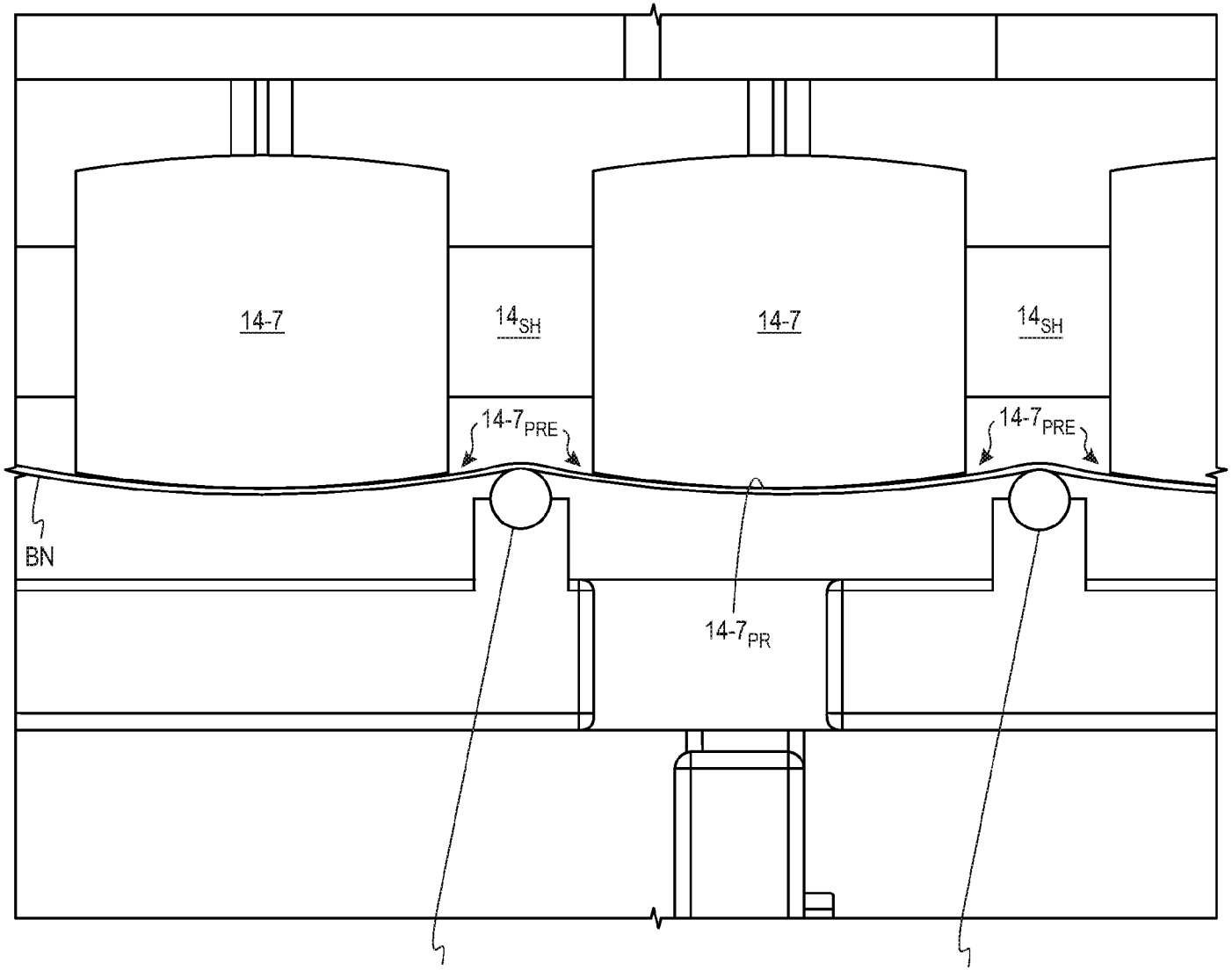

FIG. 7A is a cross-sectional view of a portion of a banknote transport mechanism similar to that shown in FIG. 2 wherein the driven rollers 14-7 have a crowned outer surface 14-7$_{PR}$. FIG. 7B is an enlarged partial view of FIG. 7A. In FIGS. 7A-7B, the outer periphery or surface of each driven roller 14-7 is crowned in the lateral direction and the rollers have a maximum cross-sectional radius near the middle of the lateral dimension of the rollers 14 and the cross-sectional radii decrease moving from the lateral middle to the lateral ends of the rollers 14-7. According to some embodiments, the crowned shape of the outer surface 14-7$_{PR}$ may contribute to a greater area of contact between the outer surface 14-7$_{PR}$ of the driven rollers 14-7 and a banknote BN being transported by the transport mechanism which in turn may lead to greater friction between the driven rollers 14-7 and the banknote BN and greater driving force imparted by the driven rollers 14-7 to the banknote BN and/or greater control over the transportation of the banknote BN, e.g., less slippage.

Figure 8A:
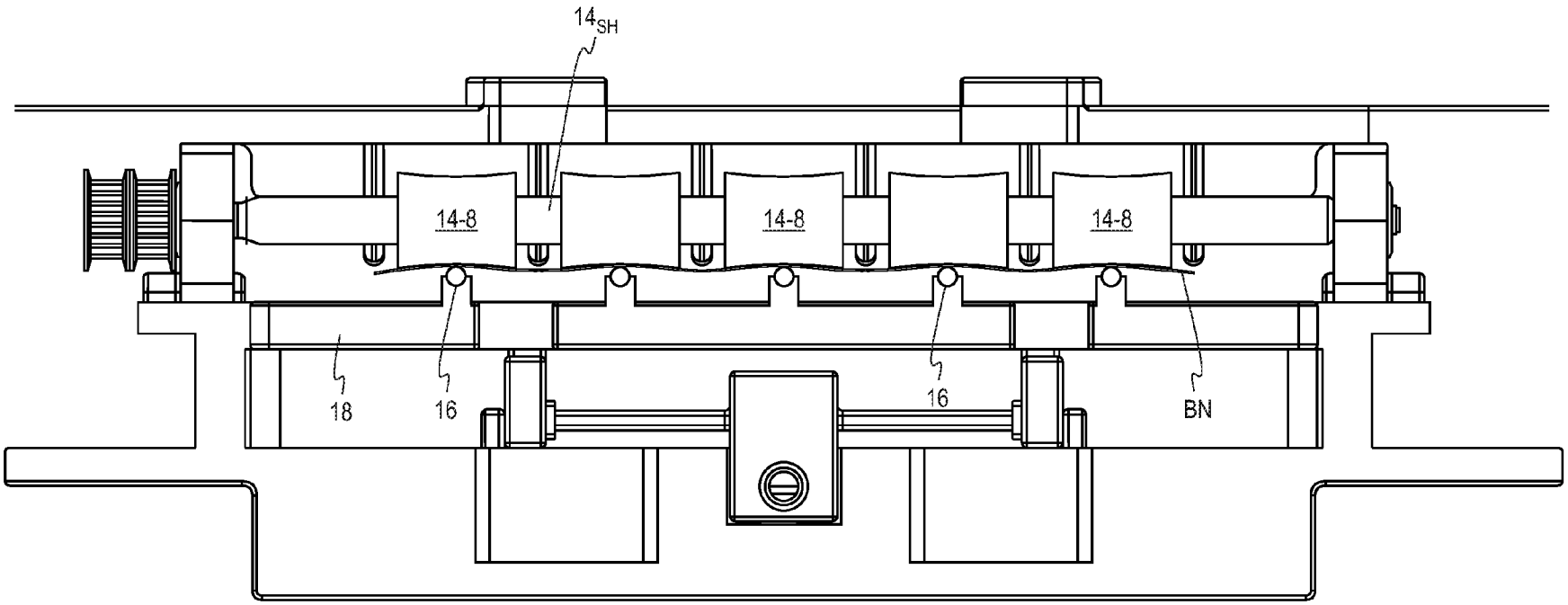
FIG. 8A is a cross-sectional view of a portion of a banknote transport mechanism similar to that shown in FIG. 2 wherein the driven rollers have a concave outer surface and wherein rails are positioned opposite the transport path from the driven rollers as opposed to in between adjacent driven rollers and FIG. 8B is an enlarged partial view of FIG. 8A.
Figure 8B:
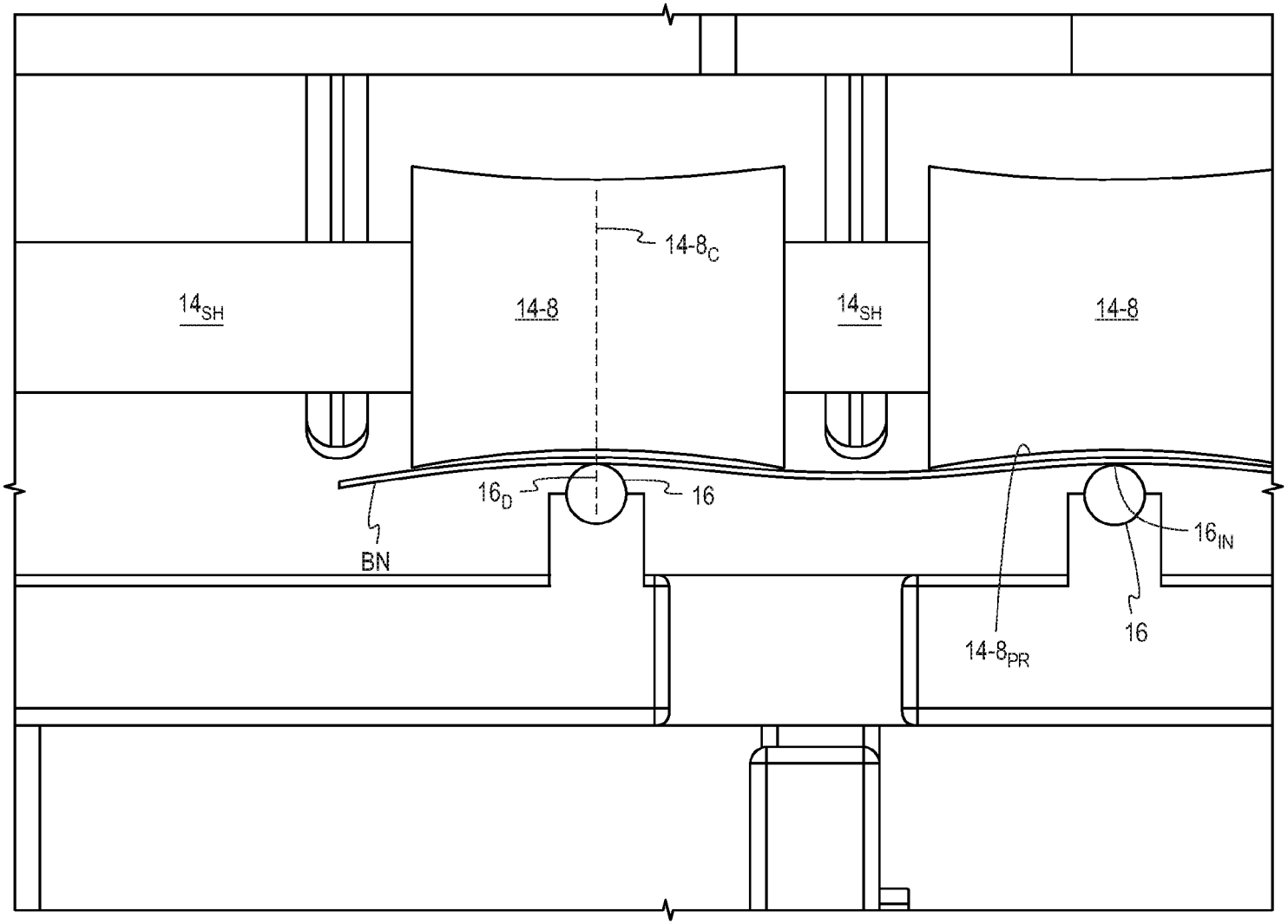

FIG. 8A is a cross-sectional view of a portion of a banknote transport mechanism similar to that shown in FIG. 2 wherein the driven rollers 14-8 have a concave outer surface 14-8$_{PR}$ and wherein rails 16 are positioned adjacent to and laterally aligned with but on the opposite side of the transport path from the driven rollers 14-8 as opposed to being positioned laterally in between adjacent driven rollers 14-8. FIG. 8B is an enlarged partial view of FIG. 8A. In FIGS. 8A-8B, the outer periphery or surface of each driven roller 14-8 is concave in the lateral direction and the rollers have a minimum cross-sectional radius near the middle of the lateral dimension of the rollers 14 and the cross-sectional radii increase moving from the lateral middle to the lateral ends of the rollers 14-8 and each roller 14-8 has a maximum radius near the laterals ends. While the banknote BN is shown to be slightly spaced from the outer surface 14-8$_{PR}$ of the driven rollers 14-8, adjustments such as reducing the distance between the distal end $16_{IN}$ of the rail 16 and the outer surface 14-8$_{PR}$ of the driven rollers 14-8 can result in the banknote BN being in contact with the outer surface 14-8$_{PR}$ of the driven rollers 14-8. As shown in FIG. 8B, according to some embodiments, the lateral center 14-8$_C$ of the driven rollers 14-8 may be positioned near the innermost, most distal portions $16_D$ of the adjacent rails 16. According to other embodiments, the lateral position of the rails 16 relative to the driven rollers 14, 14-8 may vary such as being arranged in an off-center manner.

Figure 9A:
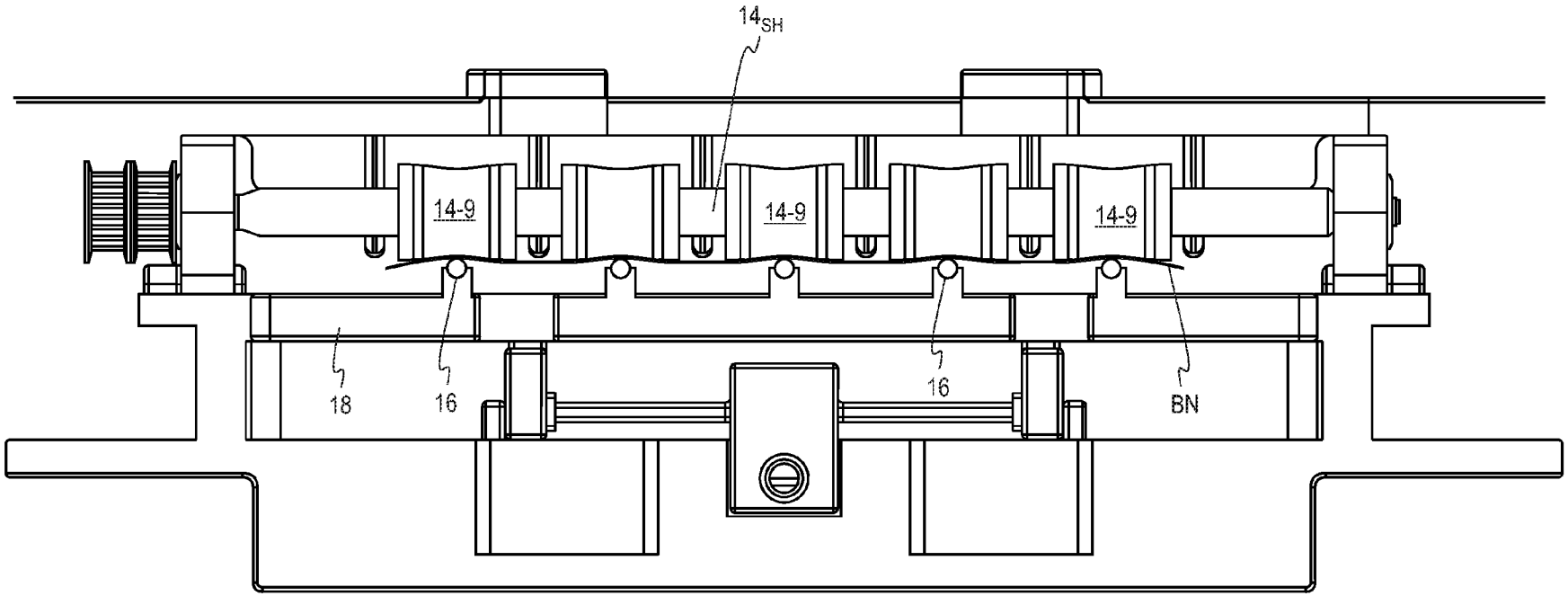
FIG. 9A is a cross-sectional view of a portion of a banknote transport mechanism similar to that shown in FIGS. 8A and 8B wherein the driven rollers have a concave, bell-shaped outer surface and wherein rails are positioned opposite the transport path from the driven rollers as opposed to in between adjacent driven rollers
Figure 9B:
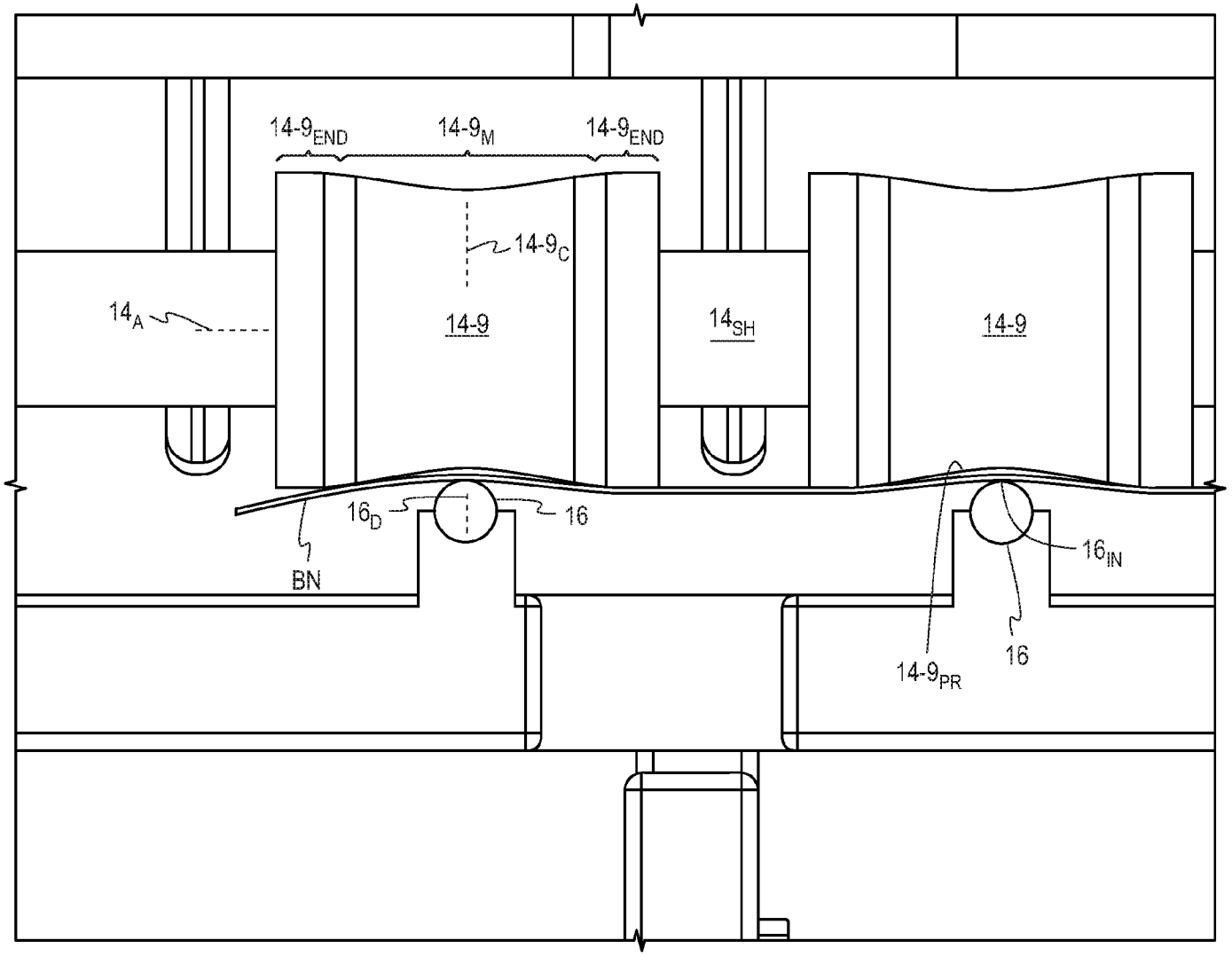
FIG. 9B is an enlarged partial view of FIG. 9A.

FIG. 9A is a cross-sectional view of a portion of a banknote transport mechanism similar to that shown in FIGS. 8A and 8B wherein the driven rollers 14-9 have a concave, bell-shaped outer surface 14-9$_{PR}$ and wherein rails 16 are positioned adjacent to and laterally aligned with but on the opposite side of the transport path from the driven rollers 14-9 as opposed to being positioned in between adjacent driven rollers 14-9. FIG. 9B is an enlarged partial view of FIG. 9A. The outer surface 14-9$_{PR}$ of the driven rollers 14-9 has a laterally middle, concave section 14-9$_M$ between two laterally outside or end sections 14-9$_{END}$. According to some embodiments, the laterally outside or end sections 14-9$_{END}$ are relatively flat, i.e., the radius of the outer surface from the center rotational axis $14_A$ of the driven rollers 14-9 in those sections is relatively constant.

While the banknote BN is shown to be slightly spaced from some parts of the outer surface 14-9$_{PR}$ of the driven rollers 14-9, adjustments such as reducing the distance between the distal end $16_{IN}$ of the rail 16 and the outer surface 14-9$_{PR}$ of the driven rollers 14-9 can result in the banknote BN being in contact with more of the outer surface 14-9$_{PR}$ of the driven rollers 14- 9. As shown in FIG. 9B, according to some embodiments, the lateral center 14-9*c* of the driven rollers 14-9 may be positioned near the innermost, most distal portions $16_D$ of the adjacent rails 16. According to other embodiments, the lateral position of the rails 16 relative to the driven rollers 14, 14-9 may vary such as being arranged in an off-center manner.

According to some embodiments, the bell-shaped of the outer surface 14-9$_{PR}$ of the driven rollers 14-9 may contribute to a greater area of contact between the outer surface 14-9$_{PR}$ of the driven rollers 14-9 (such as near the laterally outside or end sections 14-9$_{END}$) and a banknote BN being transported by the transport mechanism relative to that for the arrangement shown in FIGS. 8A and 8B which in turn may lead to greater friction between the driven rollers 14-9 and the banknote BN and greater driving force imparted by the driven rollers 14-9 to the banknote BN and/or greater control over the transportation of the banknote BN, e.g., less slippage.

According to some embodiments, the rails 16 described above in connection with FIGS. 1-9 are replaced with one or more pressure rollers such as pressure rollers 17-10, 17-11 described below. Transport mechanisms employing such pressure rollers will be referred to as roller-to-roller transport mechanisms, as opposed to the roller-to-rail transport mechanisms described above in connection with FIGS. 1-9. Such roller-to-roller transport mechanisms may have a single transport path associated with each driven transport roller as illustrated in connection with FIGS. 1-9 or may be bi-directional transport mechanisms in which each driven transport roller has two transport paths associated therewith such as those illustrated below in connection with FIGS. 10-11D. The shape of the driven rollers (and/or pressure rollers) such as in FIGS. 10-11D may take on various shapes such as described above, e.g., flat outer surface with sharp lateral edges, flat outer surface with radiused or rounded lateral edges, crowned outer surface, concave outer surface, concave, bell-shaped outer surface, see e.g., FIGS. 5A-9B.

According to some embodiments, in roller-to-roller systems, the basic concept is the same as the roller-to-rail systems, but instead of using longitudinal rails running in the transport direction (such as rails 16 mounted on a plate), there is a corresponding pressure roller shaft $\mathbf{17}_{SH}$ such as a pressure roller shaft $\mathbf{17}_{SH}$ comprising one or more low-friction material pressure rollers across the transport path from an associated driven roller shaft $\mathbf{14}_{SH}$ such as a driven roller shaft $\mathbf{14}_{SH}$ comprising one or more high-friction material driven rollers. According to some such embodiments, the pressure rollers (e.g., pressure rollers made of the low-friction material) laterally line up with the lateral gaps (e.g., gap $\mathbf{14\text{-}5}_{EED}$ shown in FIG. 5B) between laterally adjacent driven rollers (e.g., high-friction driven rollers). According to some such roller-to-rollers systems, friction may be created in the same way as the roller-to-rail systems but instead of using rails 16, one or more pressure roller shafts $\mathbf{17}_{SH}$, each having one or more pressure rollers are used to interface with the high-friction driven rollers.

According to some alternative roller-to-roller systems, one or more pressure rollers may actually be in contact with corresponding driven rollers (see, e.g., FIG. 11A described below) wherein the contact between one or more pressure rollers and one or more cross path driven rollers is used to automatically set the cross-path gap between pressure rollers and corresponding driven rollers. According to some such alternative embodiments, a series of pressure rollers (e.g., low-friction pressure rollers) are laterally aligned in the lateral gaps (e.g., gap $\mathbf{14\text{-}5}_{EED}$ shown in FIG. 5B) created by the spacing between the cross-path driven rollers (e.g., high-friction driven rollers) and two additional pressure rollers are laterally aligned with and are in contact with cross-path driven rollers. According to some such embodiments, the two additional pressure rollers in contact with cross-path driven rollers and any other laterally offset driven rollers are employed to transport documents along an associated transport path. The use of the two additional pressure rollers in contact with cross-path driven rollers can create a consistent cross-path gap for all the rollers.

According to some embodiments, a problem with any of these systems (roller-to-rail, roller-to-roller, roller-to-belt) may be accurately setting the cross-path gap between low friction devices (whether they be a rail, roller, plate, or belt), and the high friction driven rollers that would be driving the note. According to some embodiments, the use of pressure rollers in contact with cross-path driven rollers assists in overcoming or mitigating such problems. According to some embodiments employing the use of pressure rollers in contact with cross-path driven rollers, the shaft on which the two additional pressure rollers (and/or the shaft on which the driven rollers) are mounted is spring loaded so that the opposing shafts have the ability to move apart as documents pass through the contact point between the pressure roller and the driven roller (such as described below in connection with FIGS. 11A-14B).

According to some embodiments, the other designs (such as some embodiments discussed below in connection with FIG. 10 that do not employ pressure roller housings 1200) may not have any direct contact between high friction rollers and low friction rollers. According to some such embodiments, the pressure roller shafts $\mathbf{17}_{SH}$ and the drive roller shafts $\mathbf{14}_{SH}$ may be rotationally mounted at fixed locations in side plates (e.g., side plates $\mathbf{1102}_{SD}$, $\mathbf{1104}_{SD}$) of the transport mechanism with the cross-path gap being set to the thickness of the banknotes (such as the thickness of U.S. banknotes) to be transported along the transport path. Such embodiments, may be advantageous in avoiding or reducing the added cost of making the pressure roller shafts spring loaded and moveable. Additionally, according to some embodiments, when spring biased shafts are employed such as spring biased pressure roller shafts, additional mechanisms may be needed to hold mechanisms on opposing sides of the transport path (such as a pressure roller shaft and a corresponding drive roller shaft) at the proper location relative to each other such as a clamping mechanism.

According to some embodiments, the rails 16 described above in connection with FIGS. 1-9 are replaced with one or more pressure belts such as pressure belts 1602 described below in connection with FIGS. 15A-15C. Transport mechanisms employing such pressure belts will be referred to as roller-to-belt transport mechanisms, as opposed to the roller-to-rail transport mechanisms described above in connection with FIGS. 1-9. Such roller-to-belt transport mechanisms may have a single transport path associated with each driven transport roller as illustrated in connection with FIGS. 1-9 or may be bi-directional transport mechanisms in which each driven transport roller has two transport paths associated therewith such as those illustrated below in connection with FIGS. 10-11D. The shape of the driven rollers (and/or pressure belts) may take on various shapes such as described above, e.g., flat outer surface with sharp lateral edges, flat outer surface with radiused or rounded lateral edges, crowned outer surface, concave outer surface, concave, bell-shaped outer surface, see e.g., FIGS. 5A-9B.

Figure 15A:
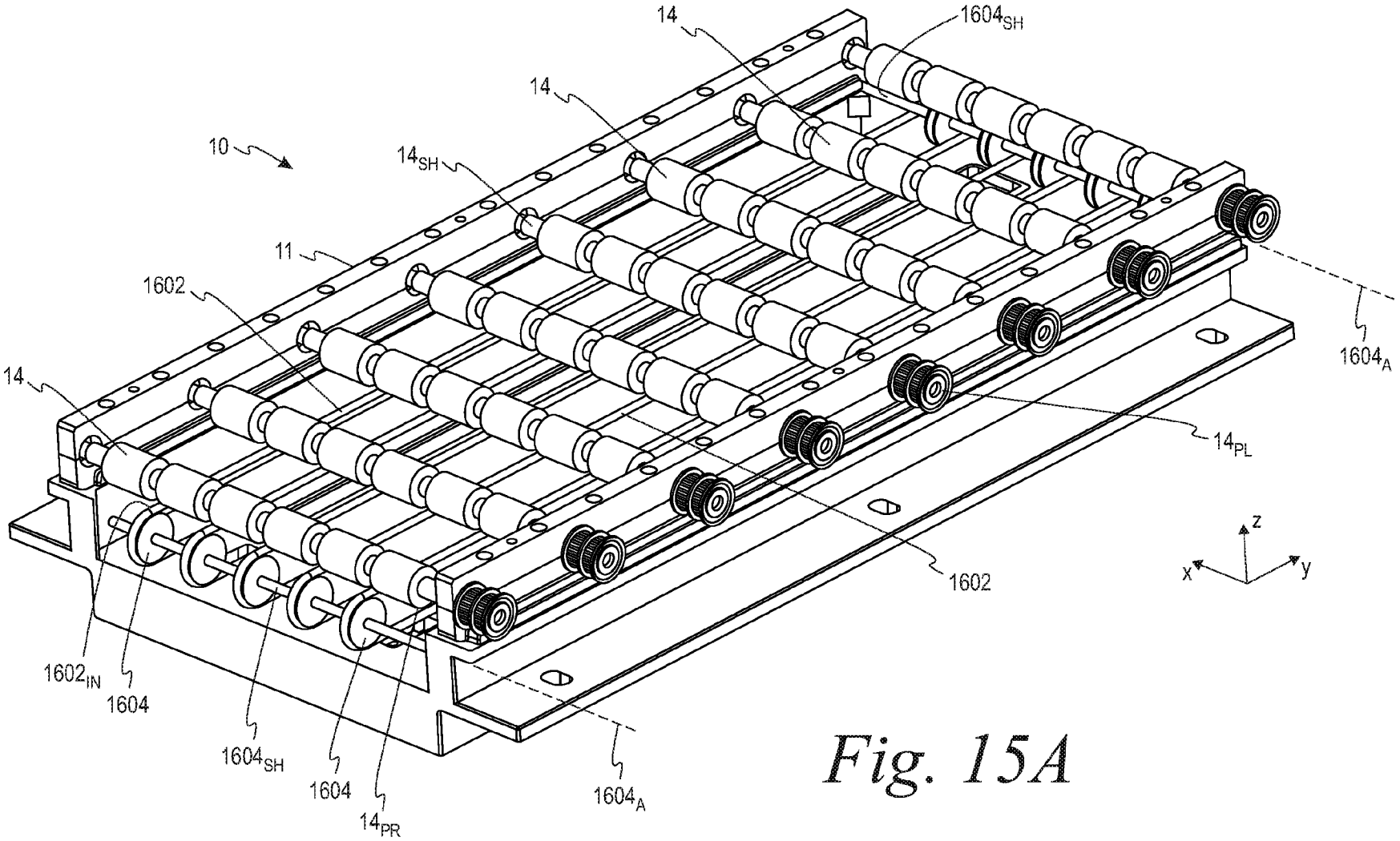
FIG. 15A is a perspective view of a banknote transport mechanism according to some embodiments of the present disclosure employing one or more belts.

FIG. 15A is a perspective view of a banknote transport mechanism according to some embodiments of the present disclosure employing one or more belts 1602. The belts 1602 are mounted about laterally spaced pulleys 1604 mounted to a pair of belt shafts $\mathbf{1604}_{SH}$ spaced apart from each other in a transport direction. As with the transport mechanism described above in connection with FIGS. 1-2, the transport mechanism comprises a plurality of drive shafts $\mathbf{14}_{SH}$ spaced in the transport direction with each drive shaft $\mathbf{14}_{SH}$ comprising one or more driven rollers 14. As illustrated, the driven rollers 14 on each drive shaft $\mathbf{14}_{SH}$ are spaced laterally from each other and the belts 1602 are laterally aligned between adjacent driven rollers 14. As described above in connection with rails 16 and pressure rollers, according to some embodiments, outer or distal sides $\mathbf{1602}_{IN}$ of the belts 1602 may be positioned in a direction across the transport path (parallel to the z-axis in FIG. 15A) so that there is a positive, neutral, or negative interference distance or cross-path gap relative to the peripheries $\mathbf{14}_{PR}$ of the driven rollers 14.

As described above and/or below in connection with rails 16 and pressure rollers, according to some embodiments, one or more or all of the belts may be laterally aligned with corresponding driven rollers 14 (see, e.g., pressure rollers $\mathbf{14\text{-}11}_{CON}$ in FIG. 11A). According to some roller-to-belt systems, the belts are moveable, e.g., the transport path side of the belts contacting the documents residing on the transport path move in the transport direction along with the documents being driven along the transport path by the driven rollers such as by movement of the belts 1602 resulting in the belt pulleys 1604 and the belt shafts $\mathbf{1604}_{SH}$ rotating about the axes $\mathbf{1604}_{A}$ of the belt shafts $\mathbf{1604}_{SH}$. According to some roller-to-belt systems, one or more O-rings are used as belts 1602. According to some such embodiments, the O-ring(s) would be laterally narrower than the lateral spacing between cross-path adjacent driven rollers (see, e.g., gap $\mathbf{14\text{-}5}_{EED}$ shown in FIG. 5B) and may travel the entire length of a portion of a transport path, very similar to the rail system shown in FIG. 1. According to some embodiments, such a roller-to-belt system may be subject to less wear than a corresponding roller-to-rail system in that the belt is moving and may not be as subject to wear as a stationary rail. As with the roller-to-roller systems, in some roller-to-belt systems the belts may be configured and laterally positioned to all fit between the lateral gaps between laterally adjacent driven rollers (see, e.g., gap $\mathbf{14\text{-}5}_{EED}$ shown in FIG. 5B) and/or the belts may be laterally positioned between the lateral gaps between laterally adjacent driven rollers and one, two, or more rollers on the belt shaft(s) contact cross-path driven rollers to provide a controlled, self-setting cross-path gap.

Figure 15B:
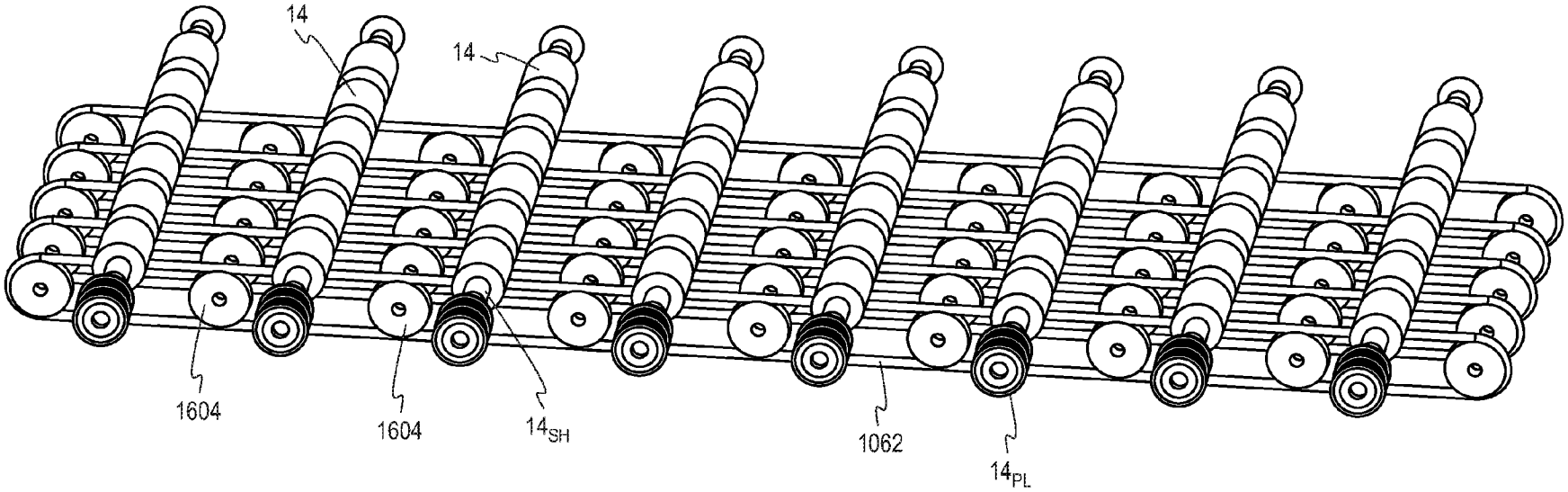
FIG. 15B is a perspective view of a banknote transport mechanism according to some embodiments of the present disclosure employing one or more belts.
Figure 15C:
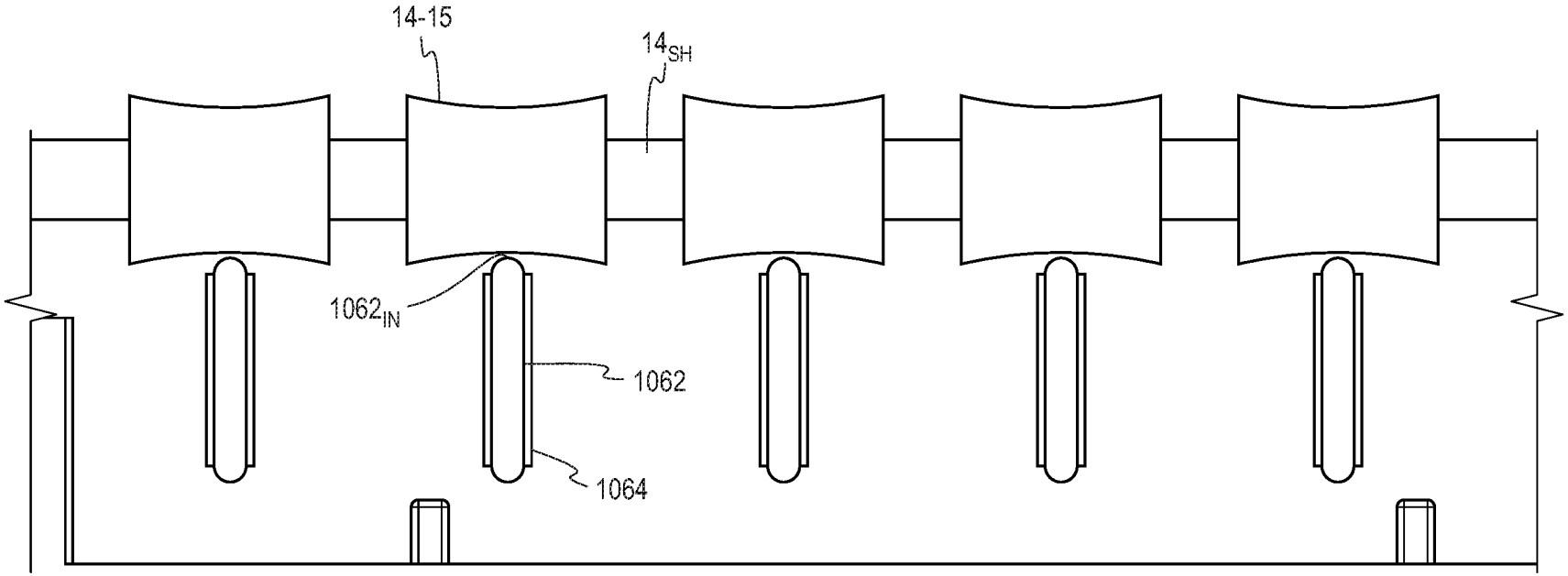
FIG. 15C is an end view of a banknote transport mechanism according to some embodiments of the present disclosure employing one or more belts.

According to some embodiments, the belts in roller-to-belt systems such as belts 1602 in FIGS. 15A-15C may have a round cross-section. According to alternative embodiments, the belts in roller-to-belt systems such as belts 1602 in FIGS. 15A-15C have a square or rectangular cross-section and/or have a flat, crowned, concave, or other-shaped distal $\mathbf{1602}_{IN}$ surface such as described above in connection with driven rollers in connection with FIGS. 5A-9B. Likewise, the peripheries of the driven rollers 14 in roller-to-belt systems such as in FIGS. 15A-15C may be flat, crowned, concave, or other-shaped distal $\mathbf{14}_{PR}$ surface such as described above in connection with driven rollers in connection with FIGS. 5A-9B.

Figure 11A:
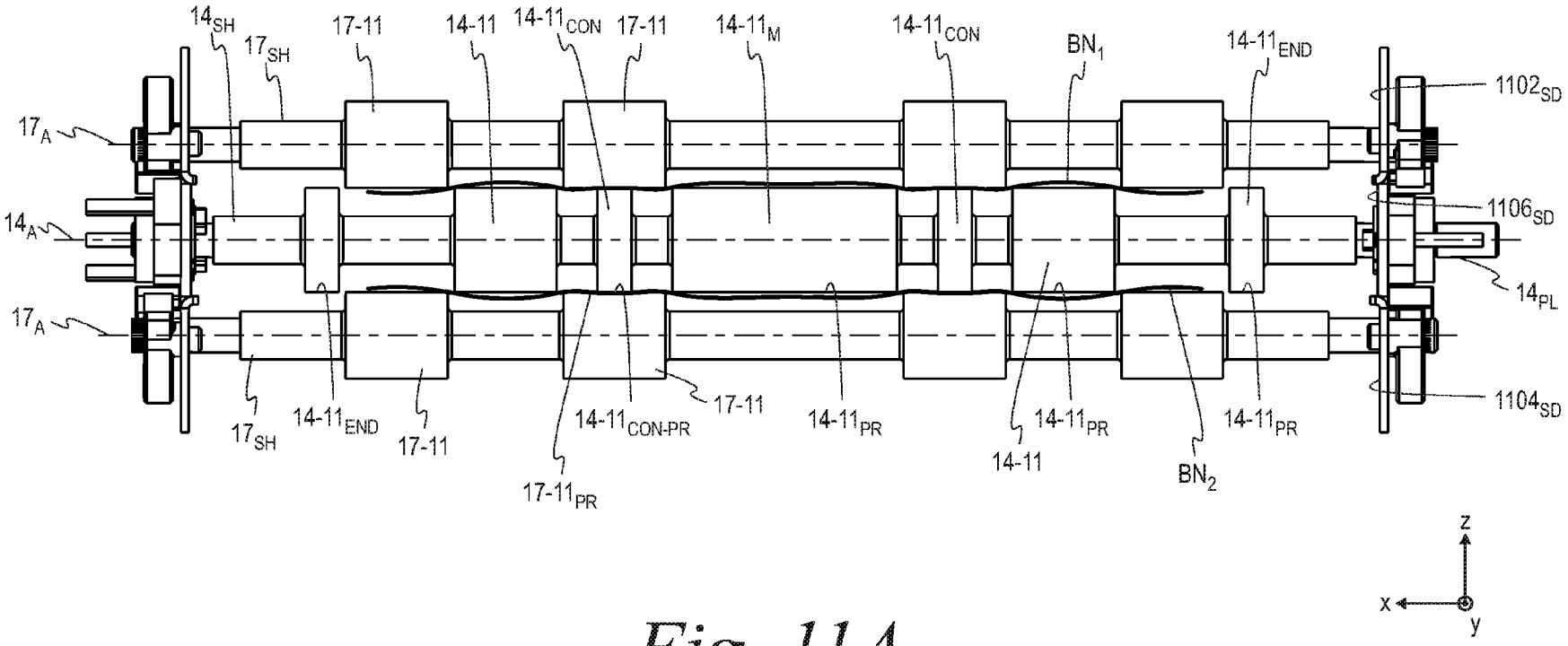
FIG. 11A is a cross-sectional view of a bi-directional banknote transport mechanism having central driven rollers and transport paths on opposite sides of the driven rollers.

According to some embodiments, one or more or all of the belts 1602 may be laterally aligned with corresponding driven rollers 14 (see, e.g., pressure rollers $\mathbf{14\text{-}11}_{CON}$ in FIG. 11A) and the laterally aligned corresponding driven rollers 14 have a flat, crowned, or concave outer surface or periphery $\mathbf{14}_{PR}$.

While in FIG. 15A five (5) belts 1602 and six (6) driven rollers 14 per driven roller shaft $\mathbf{14}_{SH}$ are shown, according to some embodiments, fewer or more belts 1602 and/or driven rollers 14 may be employed according to various embodiments.

According to some embodiments, the belts 1602 are passively driven in the transport direction by frictional contact with banknotes BN being driven along the transport path by driven rollers 14. According to some embodiments, the belts 1602 may be actively moved such as by one or more motors driving one or more of the belt shafts $\mathbf{1604}_{SH}$ such as being driven at a complimentary speed to which the driven rollers 14 are rotated by one or more motors.

As illustrated in FIG. 15A, the belts 1602 are unsupported between pulleys 1604 positioned at opposite ends of a portion of a transport path. According to some embodiments, the belts 1602 may be supported between the pulleys 1604 positioned at opposite ends of a portion of a transport path such as via additional pulleys 1604 mounted on one or more additional belt shafts $\mathbf{1604}_{SH}$ positioned therebetween in the transport direction such as, for example, by having a belt shafts $\mathbf{1604}_{SH}$ with pulleys 1604 thereon positioned across the transport path opposite each driven roller shaft $\mathbf{14}_{SH}$.

FIG. 15B is a perspective view of a banknote transport mechanism according to some embodiments of the present disclosure employing one or more belts 1062 and one or more additional belt shafts $\mathbf{1604}_{SH}$ having one or more grooved pulleys 1604 mounted thereon. The additional belt shafts $\mathbf{1604}_{SH}$ are positioned in the transport direction between two transport path end belt shafts $\mathbf{1604}_{SH}$ and facilitate the maintenance of the belts 1602 in closed proximity to the driven rollers 14 between the two end shafts $\mathbf{1604}_{SH}$. As illustrated, the additional belt shafts $\mathbf{1604}_{SH}$ are positioned in the transport direction between adjacent driven roller shafts $\mathbf{14}_{SH}$. According to some embodiments, the additional belt shafts $\mathbf{1604}_{SH}$ may alternatively or additionally be positioned opposite the transport path of driven roller shafts $\mathbf{14}_{SH}$ as are the belt shafts $\mathbf{1604}_{SH}$ in FIG. 15A.

According to some embodiments, one or more low-friction bars having a longitudinal axis generally parallel to a direction of banknote transport (similar to rails 16 in FIG. 1) or transport plates (similar to transport plates 1102, 1104 in FIG. 11B) may be used to maintain the cross-path spacing between the middle portions of the belts 1062 and driven rollers 14 mounted on driven roller shafts $\mathbf{14}_{SH}$ positioned in the transport direction between two transport path end belt shafts $\mathbf{1604}_{SH}$. According to some embodiments, such low-friction bars or transport plates may have grooves therein to maintain the lateral positions of the belts 1062 and/or may be made of plastic.

FIG. 15C is an end view of a banknote transport mechanism according to some embodiments of the present disclosure employing one or more belts 1062 positioned laterally aligned with driven rollers 14-15. As illustrated in FIG. 15C, the driven rollers 14-15 have a concave outer surface.

Figure 10:
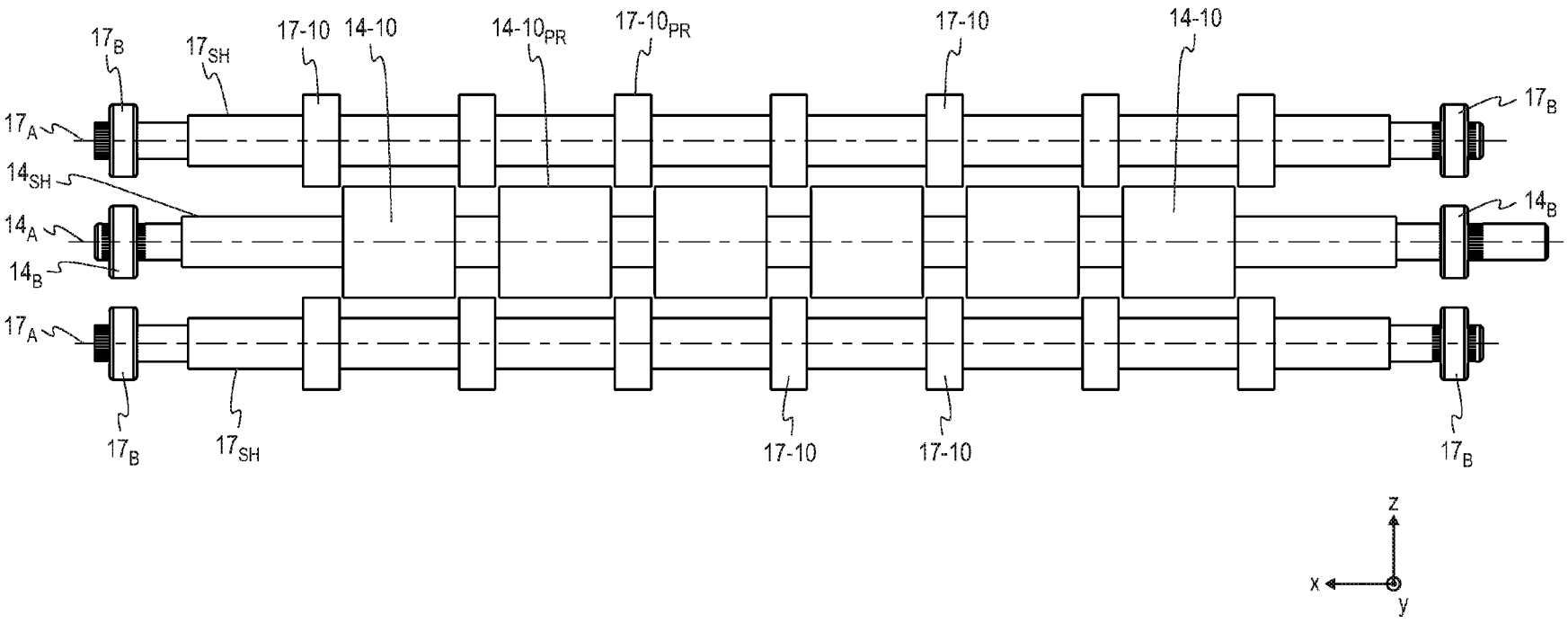
FIG. 10 is a cross-sectional view of a bi-directional banknote transport mechanism having central driven rollers and transport paths on opposite sides of the driven rollers.

FIG. 10 is a cross-sectional view of a bi-directional banknote transport mechanism having central driven rollers 14-10 and transport paths on opposite sides of the driven rollers 14-10. A drive shaft $\mathbf{14}_{SH}$ is positioned between two pressure roller drive shafts $\mathbf{17}_{SH}$. One or more driven rollers 14-10 are non-rotationally mounted to or positioned on the drive shaft $\mathbf{14}_{SH}$ and the drive shaft $\mathbf{14}_{SH}$ (and the driven rollers 14-10 mounted thereon) rotate about a longitudinal axis $\mathbf{14}_{A}$. Likewise, one or more pressure rollers 17-10 are non-rotationally mounted to or positioned on each pressure roller shaft $\mathbf{17}_{SH}$ and each pressure roller shaft $\mathbf{17}_{SH}$ (and the pressure rollers 17-10 mounted thereon) rotate about respective longitudinal axes $\mathbf{17}_{A}$. A pair of drive shaft bearings $\mathbf{14}_{B}$ are mounted on opposite ends of the drive shaft $\mathbf{14}_{SH}$. Likewise, pair of pressure roller shaft bearings $\mathbf{17}_{B}$ are mounted on opposite ends of each pressure roller shaft $\mathbf{17}_{SH}$. According to some embodiments, the bearings $\mathbf{14}_{B}$ and the bearings $\mathbf{17}_{B}$ are press fit onto the ends of the respective drive or pressure roller shafts. According to some embodiments, the pressure rollers 17-10 and the pressure roller shafts $\mathbf{17}_{SH}$ are free-wheeling.

A first transport path is defined between the driven rollers 14-10 and the pressure rollers 17-10 on a first side of the drive shaft $\mathbf{14}_{SH}$ and a second transport path is defined between the driven rollers 14-10 and the pressure rollers 17-10 on a second side of the drive shaft $\mathbf{14}_{SH}$. Banknotes are driven along the first transport path by the driven rollers 14-10 in a first direction, such as into the page in FIG. 10 and banknotes are driven along the second transport path by the driven rollers 14-10 in a second, opposite direction, such as out of the page in FIG. 10.

According to some embodiments, the drive shaft $\mathbf{14}_{SH}$ and the pressure roller shafts $\mathbf{17}_{SH}$ are arranged in a generally horizontal manner, with a first one of the pressure roller shafts $\mathbf{17}_{SH}$ being positioned adjacent to and above the drive shaft $14_{SH}$ and a second one of the pressure roller shafts $17_{SH}$ being positioned adjacent to and below the drive shaft $14_{SH}$.

The transport mechanism illustrated in FIG. 10 may be similar to that shown in FIGS. 1 and 2 wherein the rails 16 of FIG. 2 are replaced by pressure rollers 17-10 (and a second transport path is provided above the driven rollers 14 shown in FIGS. 1 and 2). According to some embodiments, a plurality of drive shafts $14_{SH}$ are provided in the transport mechanism of FIG. 10 in a similar manner as shown and described above in connection with FIGS. 1 and 2. Likewise, corresponding pressure roller shafts $17_{SH}$ may be positioned adjacent to each drive shaft $14_{SH}$ on one or both sides of each drive shaft $14_{SH}$ depending on whether a single transport path is desired or two, bi-directional transport paths are desired.

Likewise, the transport mechanism illustrated in FIG. 10 may be similar to that shown in FIGS. 11A-11D described below but having a differing arrangement of driven and/or pressure rollers.

As discussed above, other embodiments may have the drive shafts $14_{SH}$ and the pressure roller shafts $17_{SH}$ having other orientations such as to define vertical transport paths and/or transport paths that transition between horizontal and vertical orientations and/or transport paths that are at other angles from being horizontal.

Figure 11B:
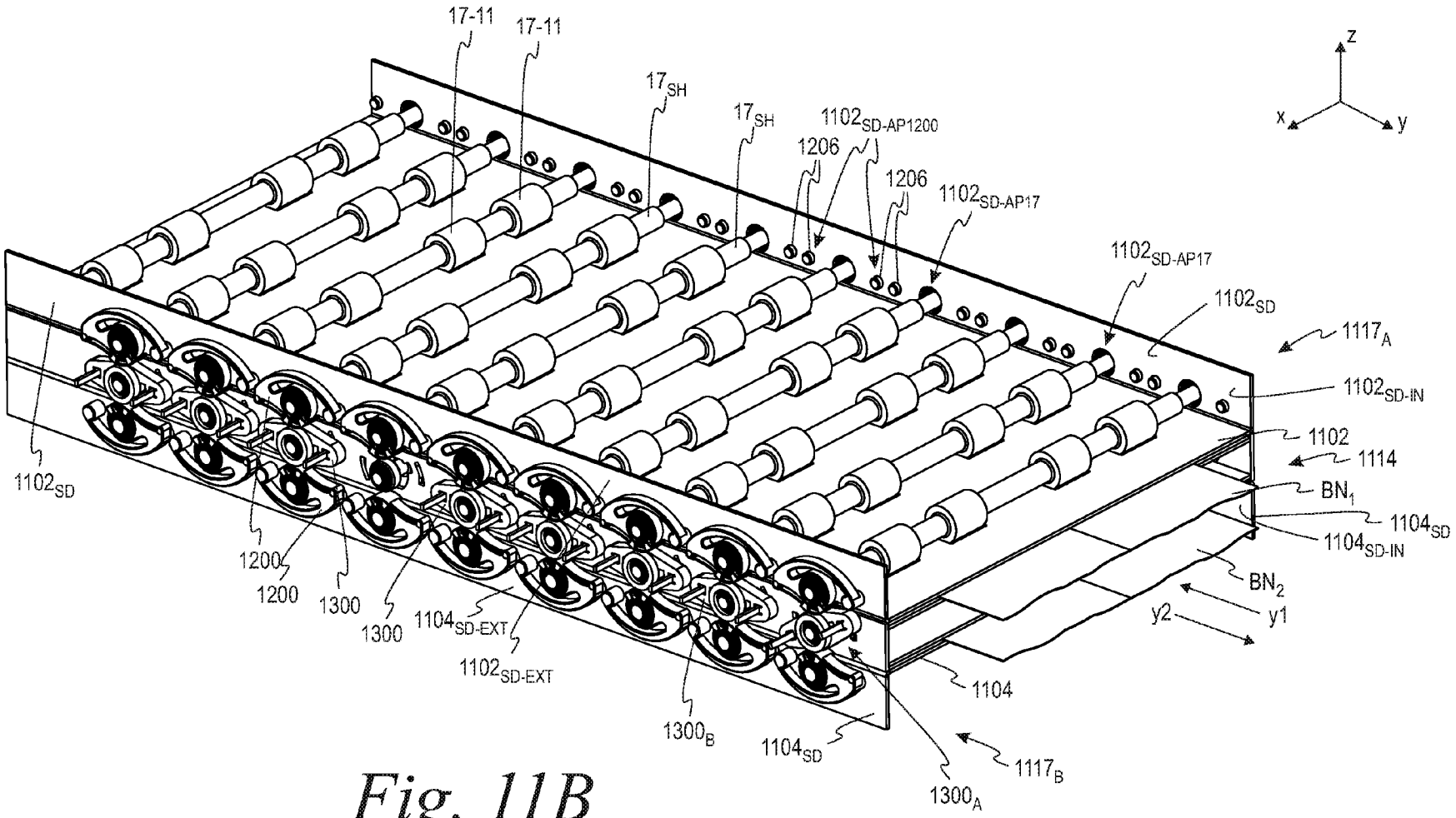
FIG. 11B is a perspective view of the bi-directional banknote transport mechanism of FIG. 11A shown in a closed, operational state.
Figure 11C:
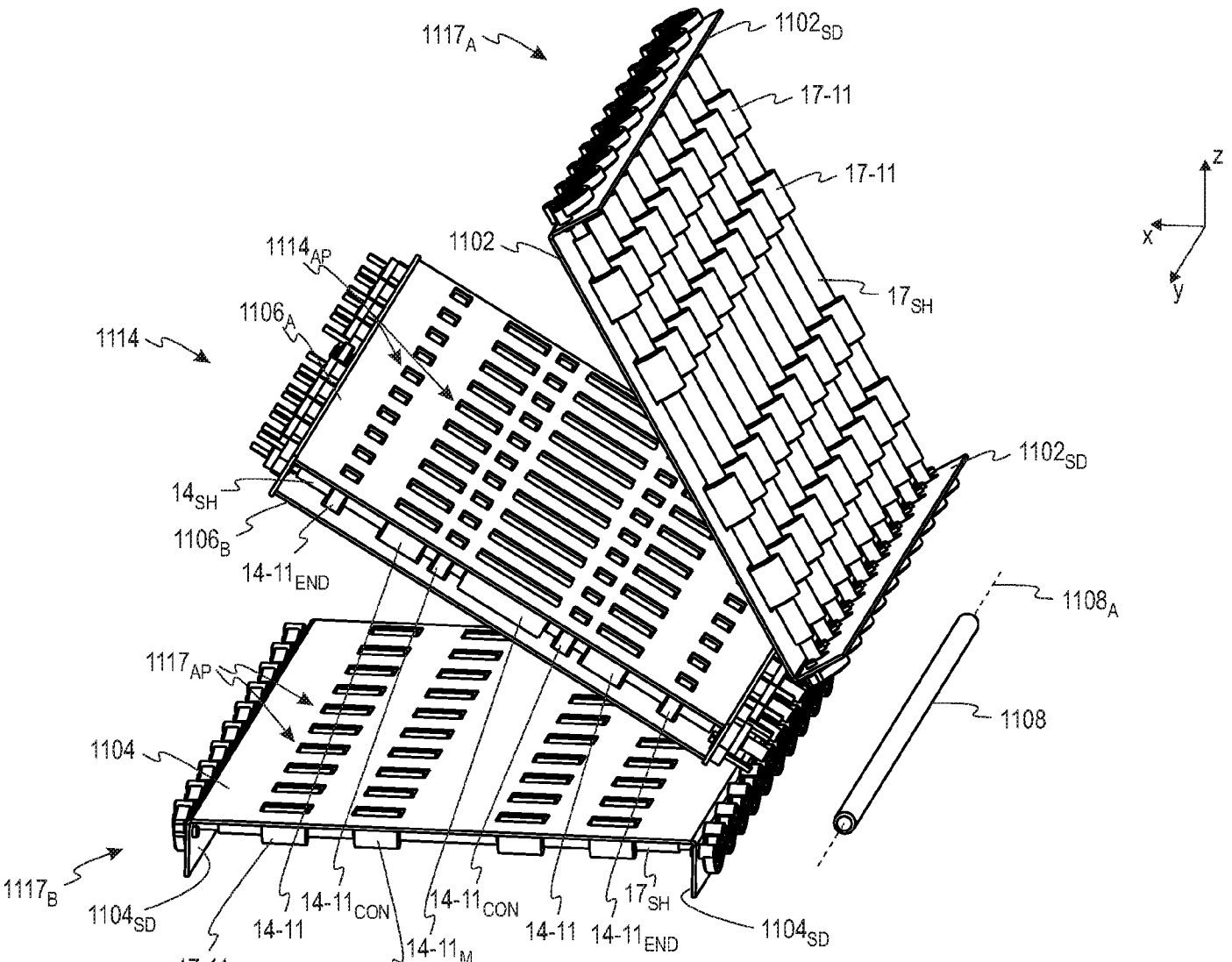
FIG. 11C is a perspective view of the bi-directional banknote transport mechanism of FIG. 11A shown in an open, non-operational state.
Figure 11D:
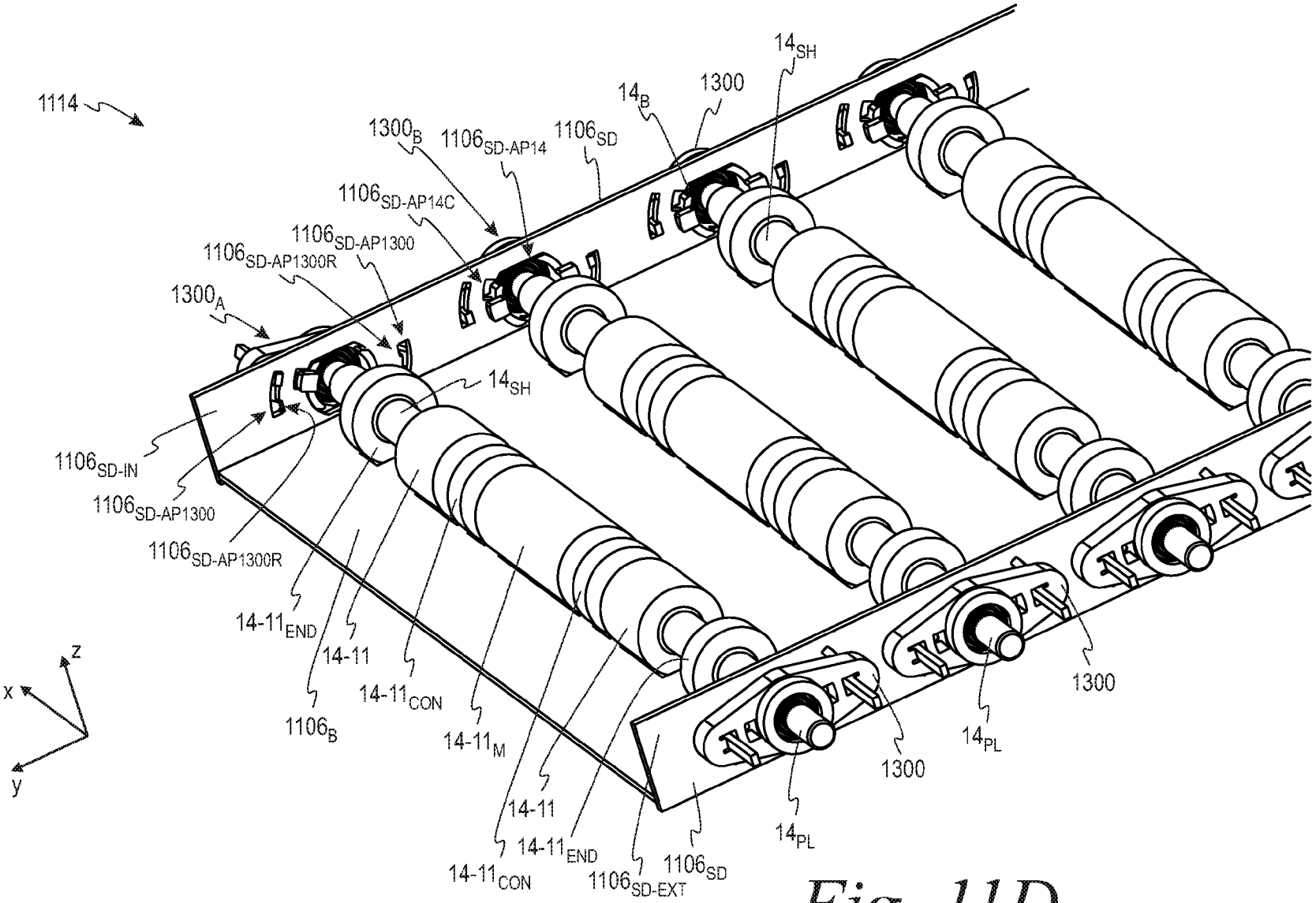
FIG. 11D is a perspective view of driven transport rollers of the bi-directional banknote transport mechanism of FIG. 11A.

FIG. 11A is a cross-sectional view of a bi-directional banknote transport mechanism having central driven rollers 14-11, 14-11$_M$, 14-11$_{CON}$, 14-11$_{END}$ and transport paths on opposite sides of the driven rollers. FIG. 11B is a perspective view of the bi-directional banknote transport mechanism of FIG. 11A shown in a closed, operational state. FIG. 11C is a perspective view of the bi-directional banknote transport mechanism of FIG. 11A shown in an open, non-operational state. FIG. 11D is a perspective view of driven transport rollers 14-11, 14-11$_M$, 14-11$_{CON}$, 14-11$_{END}$ of the bi-directional banknote transport mechanism of FIG. 11A. With reference to FIGS. 11A-11D, a lateral direction is parallel the indicated x-axis and a transport direction is parallel to the indicated y-axis.

In FIG. 11A, transport plates 1102, 1104, 1106$_A$, 1106$_B$ shown in FIGS. 11B-11D to be described below have been omitted for clarity. According to some embodiments, transport plates 1102, 1104, 1106$_A$, 1106$_B$ are not included in the transport mechanism.

The driven rollers 14-11, 14-11$_M$, 14-11$_{CON}$, 14-11$_{END}$ illustrated in FIGS. 11A-11D have varying lateral dimensions with driven roller 14-11$_M$ being the widest and driven rollers 14-11$_{CON}$, 14-11$_{END}$ being the narrowest. The driven rollers 14-11, 14-11$_M$, 14-11$_{END}$ are laterally offset from adjacent pressure rollers 17-11. However, contacting driven rollers 14-11$_{CON}$ laterally overlap the lateral positions of some of the pressure rollers 17-11. In the absence of a banknote $BN_1$, $BN_2$, the radial periphery 14-11$_{CON\text{-}PR}$ of the contacting driven rollers 14-11$_{CON}$ contact the radial periphery 17-11$_{PR}$ of adjacent pressure rollers 17-11 positioned on the opposite side of a transport path lying therebetween and rotationally drive the pressure rollers 17-11 about their corresponding rotational axes $17_A$. According to some embodiments, the engagement between the contacting driven rollers 14-11$_{CON}$ and the adjacent pressure rollers 17-11 facilitates the interference distance between the laterally offset pressure rollers 17-11 and the other driven rollers 14-11, 14-11$_M$, 14-11$_{END}$ in being self-setting. For example, the radial dimensions of the contacting driven rollers 14-11$_{CON}$ and the adjacent pressure rollers 17-11 can be used to set the interference distance between the laterally offset pressure rollers 17-11 and the other driven rollers 14-11, 14-11$_M$, 14-11$_{END}$. According to some embodiments, the self-setting interference distance can reduce manufacturing and/or service costs and may automatically compensate for wear such as roller wear.

According to some embodiments, a pair of contacting driven rollers 14-11$_{CON}$ (and corresponding pressure rollers 17-11) may be positioned laterally near the ends of the drive shafts $14_{SH}$ (and pressure roller shafts $17_{SH}$) laterally outside the transport path along which banknotes are transported. According to such embodiments, contacting driven rollers 14-11$_{CON}$ may be employed without interfering with the transport path.

According to some embodiments, the drive shafts $14_{SH}$ are rotationally driven about drive shaft axes $14_A$ via a belt engaging pulleys $14_{PL}$ positioned at an end of the drive shafts $14_{SH}$. According to some embodiments, the pressure rollers 17-11 and the pressure roller shafts $17_{SH}$ are free-wheeling.

According to some embodiments, the transport mechanism may comprise one or more transport plates 1102, 1104, 1106$_A$, and 1106$_B$. A first transport path is defined between transport plates 1102 and 1106$_A$ and a second transport path is defined between transport plates 1104 and 1106$_B$. According to some embodiments, the driven rollers drive banknotes along the first and second transport paths in opposite directions such as in the direction of arrow y1 (see, e.g., banknote $BN_1$) shown in FIG. 11B along the first transport path and in the direction of arrow y2 along the second transport path (see, e.g., banknote $BN_2$). With reference to FIG. 11A, banknote $BN_1$ would be driven into the page (negative y-direction) along the first transport path while banknote $BN_2$ is driven in a direction out of the page (y-direction) along the second transport path. According to some such embodiments, driven rollers on a single drive shaft $14_{SH}$ may be employed to drive banknotes in opposite directions, and in some embodiments, may simultaneously drive two different banknotes $BN_1$, $BN_2$ in opposite directions.

As best seen in FIG. 11C, according to some embodiments, the transport plates 1102, 1104, 1106$_A$, and 1106$_B$ have apertures 1114$_{AP}$, 1117$_{AP}$ herein to permit corresponding drive and pressure rollers to extend into the transport paths therebetween and contact banknotes being transported along the transport paths.

According to some embodiments, the transport mechanism comprises a first pressure roller assembly 1117$_A$ positioned adjacent to and on a first side of a driven roller assembly 1114, and optionally, a second pressure roller assembly 1117$_B$ positioned adjacent to and on a second, opposite side of the driven roller assembly 1114. According to some embodiments, the first pressure roller assembly 1117$_A$ and the driven roller assembly 1114 may be pivoted about a pivot axis 1108$_A$ shown in FIG. 11C which is generally parallel to a transport direction (e.g., the ± y-direction). According to some such embodiments, the first pressure roller assembly 1117$_A$ and the driven roller assembly 1114 are coupled to a hinge bar or pin 1108. When positioned in the non-operational positions shown in FIG. 11C, a person such as an operator or service personnel can access the transport paths between transports plates 1102 and 1106$_A$ and/or between 1106$_B$ and 1104, any banknotes therebetween, the various driven 14 and pressure 17 rollers, and/or any sensors such as for cleaning and/or maintenance.

According to some embodiments, the first and second pressure roller assemblies 1117$_A$, 1117$_B$ each comprise a transport plate 1102, 1104 and side plates 1102$_{SD}$, 1104$_{SD}$ which are positioned near lateral ends of the transport plates 1102, 1104 and may be oriented generally orthogonal thereto. According to some embodiments, the side plates $1102_{SD}$, $1104_{SD}$ extend generally parallel to the associated transport direction(s). According to some embodiments, the transport plate 1102 and the corresponding side plates $1102_{SD}$ may be formed from a unitary piece of metal or molded plastic bent or formed in a generally U-shaped manner. According to some embodiments, the transport plate 1104 and the corresponding side plates $1104_{SD}$ may be formed from a unitary piece of metal or molded plastic bent or formed in a generally U-shaped manner. The first and second pressure roller assemblies $1117_A$, $1117_B$ each further comprise a plurality of pressure roller shafts $17_{SH}$ with each shaft having one or more pressure rollers 17-11 thereon. According to some embodiments, the transport plates 1102, 1104 have a plurality of apertures $1117_{AP}$ therein to permit the peripheries $17\text{-}11_{PR}$ of the pressure rollers 17-11 to contact banknotes BN being transported along an associated transport path and/or driven rollers laterally aligned with the pressure rollers 17-11 on the opposite side of an associated transport path. According to some embodiments, the side plates $1102_{SD}$, $1104_{SD}$ have a plurality of pressure roller shaft apertures $1102_{SD\text{-}AP17}$ (see FIG. 11B), $1104_{SD\text{-}AP17}$ (not shown) therein to accommodate ends of pressure roller shafts $17_{SH}$ to be positioned herein. According to some embodiments, the side plates $1102_{SD}$, $1104_{SD}$ have one or more pressure roller housing locating apertures $1102_{SD\text{-}AP1200}$ (see FIG. 11B), $1104_{SD\text{-}AP1200}$ (not shown) therein associated with each pressure roller shaft aperture $1102_{SD\text{-}AP17}$, $1104_{SD\text{-}AP17}$ to accommodate one or more locking tabs or locating lugs 1206 (see, e.g., FIG. 12B) of an associated pressure roller housing 1200 to be positioned herein. According to some embodiments, each pressure roller shaft aperture $1102_{SD\text{-}AP17}$, $1104_{SD\text{-}AP17}$ has two pressure roller housing locating apertures $1102_{SD\text{-}AP1200}$ (see FIG. 11B), $1104_{SD\text{-}AP1200}$ (not shown) associated therewith with one aperture $1102_{SD\text{-}AP1200}$, $1104_{SD\text{-}AP1200}$ positioned upstream of the associated pressure roller shaft aperture $1102_{SD\text{-}AP17}$, $1104_{SD\text{-}AP17}$ and one aperture $1102_{SD\text{-}AP1200}$, $1104_{SD\text{-}AP1200}$ positioned downstream of the associated pressure roller shaft aperture $1102_{SD\text{-}AP17}$, $1104_{SD\text{-}AP17}$.

According to some embodiments, the driven roller assembly 1114 comprises a first transport plate $1106_A$ and optionally a second transport plate $1106_B$. The first and second transport plates $1106_A$, $1106_B$ may have side plates $1106_{SD}$ which are positioned near lateral ends of the transport plates $1106_A$, $1106_B$ and may be oriented generally orthogonal thereto. According to some embodiments, the side plates $1106_{SD}$ extend generally parallel to the associated transport direction(s). According to some embodiments, the transport plate $1106_A$ or the transport plate $1106_B$ and the corresponding side plates $1106_{SD}$ may be formed from a unitary piece of metal or molded plastic bent or formed in a generally U-shaped manner. According to some embodiments, the transport plates $1106_A$, $1106_B$ and the corresponding side plates $1104_{SD}$ may be formed from a unitary piece of metal or molded plastic bent or formed in a generally rectangular shaped manner. The driven roller assembly 1114 further comprises a plurality of driven roller or drive shafts $14_{SH}$ with each drive shaft having one or more driven rollers 14, 14-11, $14\text{-}11_M$, $14\text{-}11_{CON}$, $14\text{-}11_{END}$ thereon. According to some embodiments, the transport plates $1106_A$, $1106_B$ have a plurality of apertures $1114_{AP}$ therein to permit the peripheries $14\text{-}11_{PR}$, $14\text{-}11_{CON\text{-}PR}$ of the driven rollers 14-11, $14\text{-}11_M$, $14\text{-}11_{CON}$, $14\text{-}11_{END}$ to contact banknotes BN being transported along an associated transport path and/or pressure rollers laterally aligned with the driven rollers $14\text{-}11_{CON}$ on the opposite side of an associated transport path. According to some embodiments, the side plates $1106_{SD}$ have a plurality of drive shaft apertures $1106_{SD\text{-}AP14}$ (see FIG. 11D), therein to accommodate ends of drive shafts $14_{SH}$ to be positioned herein. According to some embodiments, the side plates $1106_{SD}$ have one or more driven roller housing apertures $1106_{SD\text{-}AP1300}$ (see FIG. 11D) therein associated with each drive shaft aperture $1106_{SD\text{-}AP14}$ to accommodate one or more locking tabs 1310 (see, e.g., FIG. 13) of an associated driven roller housing 1300 to be positioned herein. According to some embodiments, each associated drive shaft aperture $1106_{SD\text{-}AP14}$ has two driven roller housing apertures $1106_{SD\text{-}AP1300}$ (see FIG. 11D) associated therewith with one aperture $1106_{SD\text{-}AP1300}$ positioned upstream of the associated drive shaft aperture $1106_{SD\text{-}AP14}$ and one apertures $1106_{SD\text{-}AP1300}$ positioned downstream of the associated drive shaft aperture $1106_{SD\text{-}AP14}$.

Figure 12B:
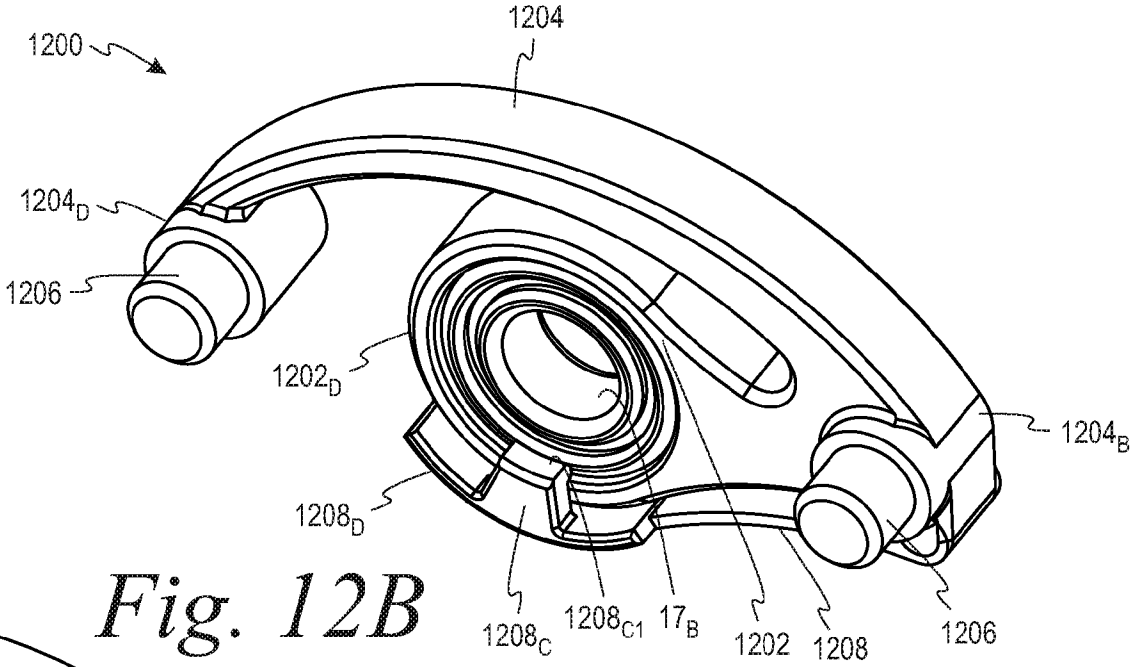
FIG. 12B is a perspective second side view of a pressure roller housing in a closed, operational state.
Figure 12A:
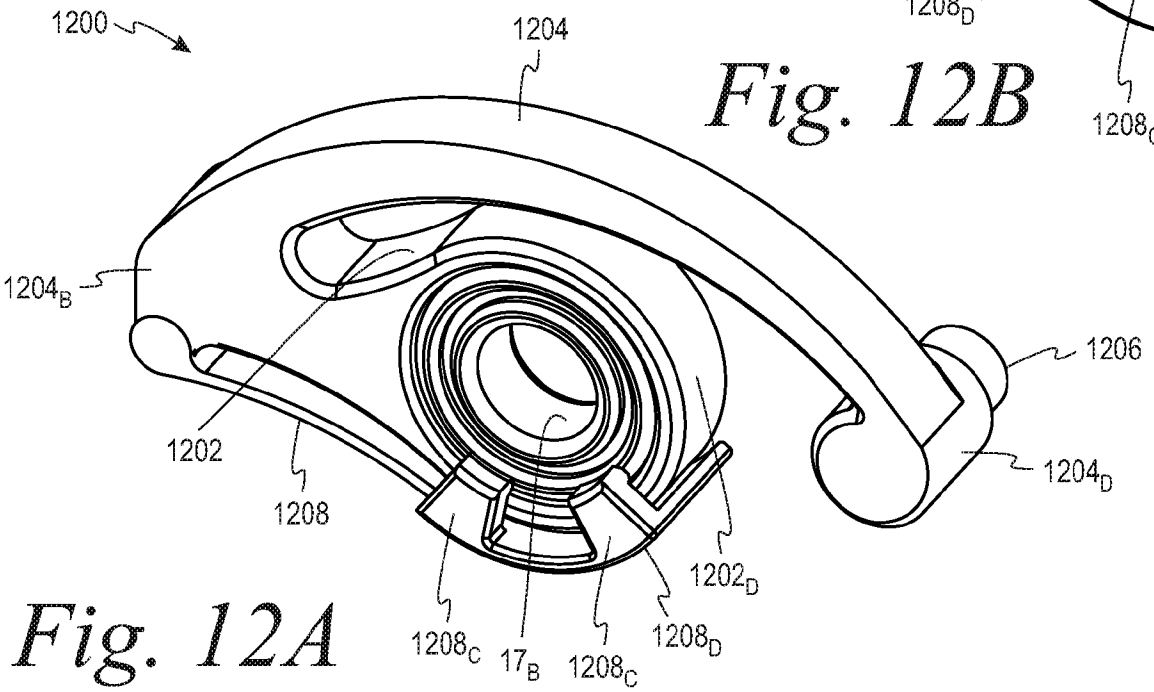
FIG. 12A is a perspective first side view of a pressure roller housing in a closed, operational state.
Figure 12C:
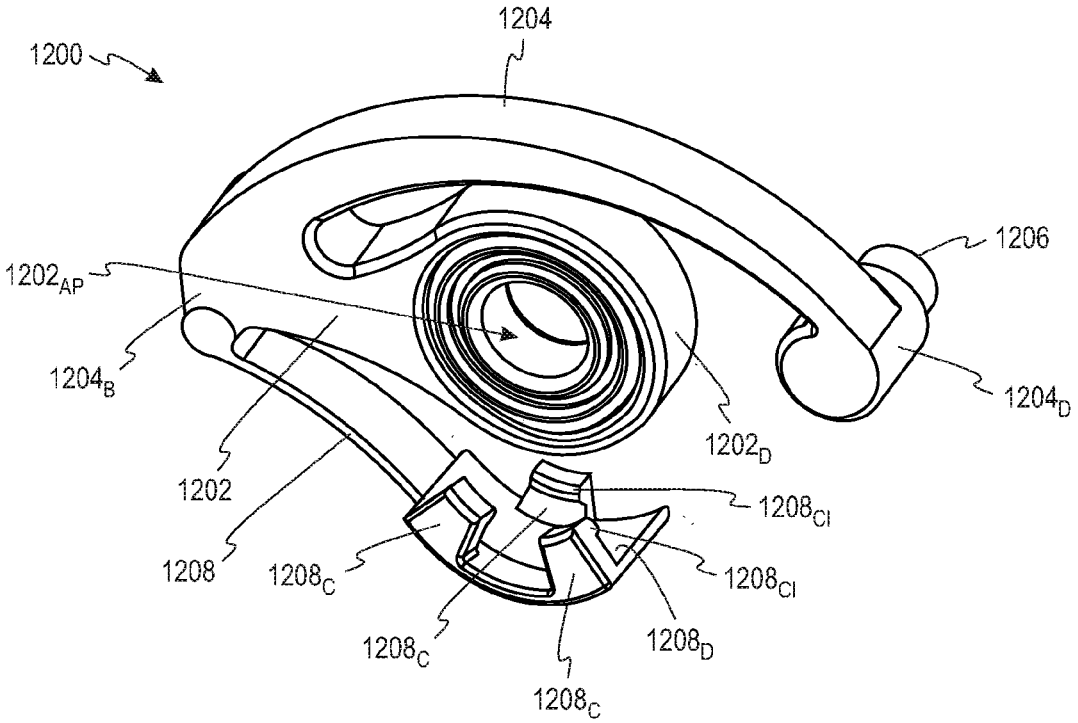
FIG. 12C is a perspective view of the pressure roller housing of FIG. 12A in an open, non-operational state.

FIG. 12A is a perspective first side view of a pressure roller housing 1200 in a closed, operational state and FIG. 12B is a perspective second side view of the 1200 pressure roller housing in a closed, operational state. FIG. 12C is a perspective view of the pressure roller housing 1200 of FIG. 12A in an open, non-operational state. According to some embodiments, the pressure roller housing 1200 comprises a base $1204_B$ from which a bearing housing 1202 extends, the bearing housing 1202 having a distal end $1202_D$. According to some embodiments, the pressure roller housing 1200 further comprises a spring arm 1204 extending from the base $1204_B$, the spring arm 1204 having a distal end $1204_D$. According to some embodiments, the pressure roller housing 1200 further comprises a bearing clip arm 1208 extending from the base $1204_B$, the bearing clip arm 1208 having a distal end $1208_D$ and one or more bearing retaining clips or flanges $1208_C$ positioned near the distal end $1208_D$ and extending toward the bearing housing 1202 when the bearing clip arm 1208 is positioned in the open, non-operational state such as shown in FIG. 12C. According to some embodiments, the pressure roller housing 1200 comprises one or more locating lugs 1206. According to some embodiments, the pressure roller housing 1200 comprises two locating lugs 1206 with a first locating lug 1206 located near the base 1204 and a second locating lug located near the distal end $1204_D$ of the spring arm 1204. According to some embodiments, the locating lugs extend from a second side of the pressure roller housing 1200. The bearing housing 1202 has an opening or aperture $1202_{AP}$ therein configured to accommodate a bearing $17_B$. As shown in FIGS. 12A, 12B, when the bearing clip arm 1208 is positioned in a closed operational state, the one or more bearing retaining clips or flanges $1208_C$ retain the bearing $17_B$ within the bearing housing 1202. According to some embodiments, the bearing retaining clips or flanges $1208_C$ comprise a bearing flange $1208_{C1}$ on a distal portion of each flanges $1208_C$ wherein the bearing flanges $1208_{C1}$ are configured to engage sides of the bearing $17_B$ and assist with retaining the bearing clip arm 1208 in the closed operational state and/or with retaining the bearing $17_B$ within the bearing housing 1202.

Figure 13:
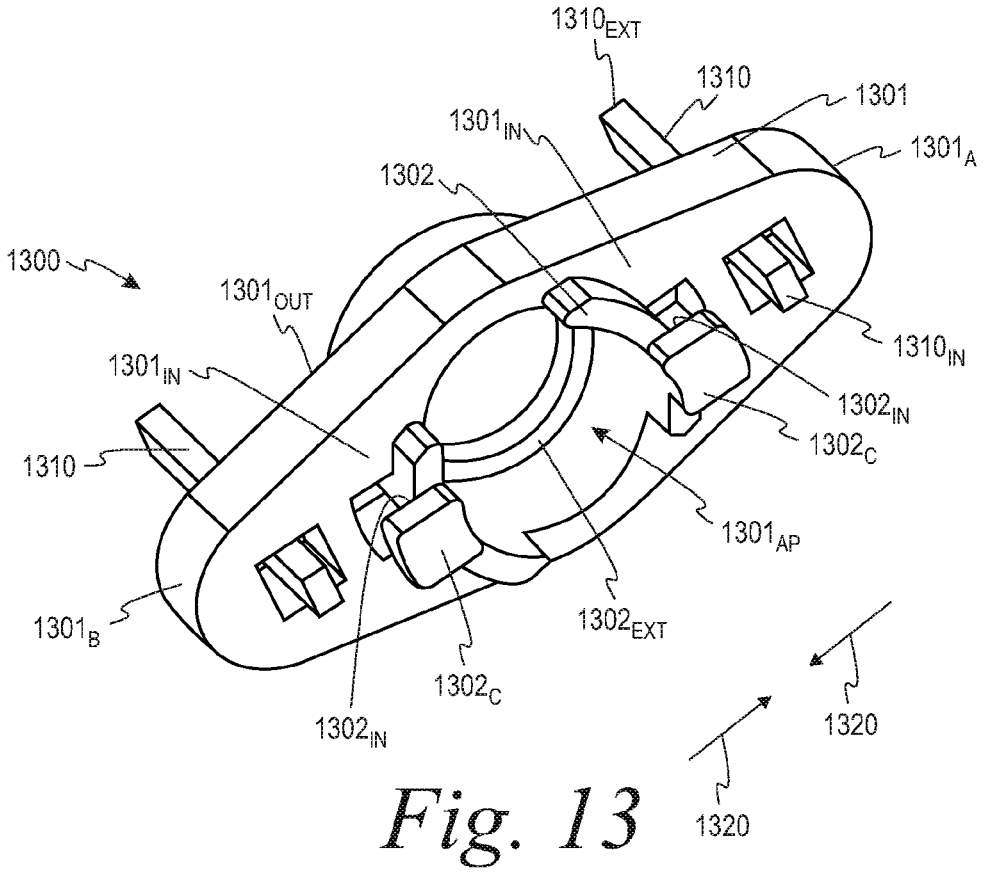
FIG. 13 is a perspective view of a driven roller housing.

FIG. 13 is a perspective view of a driven roller housing 1300. The driven roller housing 1300 comprises a body 1301 having an opening or aperture $1301_{AP}$ therein configured to accommodate a bearing $14_B$. According to some embodiments, the body 1301 has an elongated shape having a first end $1301_A$ and a second end $1301_B$. The body 1301 has an inner surface $1301_{IN}$ and an outer surface $1301_{OUT}$. According to some embodiments, the driven roller housing 1300 comprises one or more locking tabs 1310 coupled to the body 1301 and having an interior end $\mathbf{1310}_{IN}$ extending past the inner surface $\mathbf{1301}_{IN}$ of the body 1301 and an exterior end $\mathbf{1310}_{EXT}$ extending past the outer surface $\mathbf{1301}_{OUT}$ of the body 1301. According to some embodiments, the interior end(s) $\mathbf{1310}_{IN}$ are biased toward the aperture $\mathbf{1301}_{AP}$. As shown in FIG. 13, the driven roller housing 1300 comprises two locking tabs 1310 and the interior ends $\mathbf{1310}_{IN}$ of the locking tabs 1310 are biased toward each other in the direction 1320. The locking tabs 1310 are pivotally mounted to the body 1301 such that when the exterior ends $\mathbf{1310}_{OUT}$ of the locking tabs 1310 are moved toward each other (e.g., in the direction 1320) such as when squeezed between a thumb and index finger of a person, the interior ends $\mathbf{1310}_{IN}$ of the locking tabs 1310 move away from each other (in a direction opposite of direction 1320).

According to some embodiments, the driven roller housing 1300 further comprises one or more side plate flanges 1302 extending beyond the inner surface $\mathbf{1301}_{IN}$ of the body 1301 with each side plate flange 1302 having an interior side flange $\mathbf{1302}_{C}$ extending from near a distal end of the side plate flange 1302 such as in a direction away from the aperture $\mathbf{1301}_{AP}$. The interior side flanges $\mathbf{1302}_{C}$ have an inner surface $\mathbf{1302}_{IN}$.

Figure 14A:
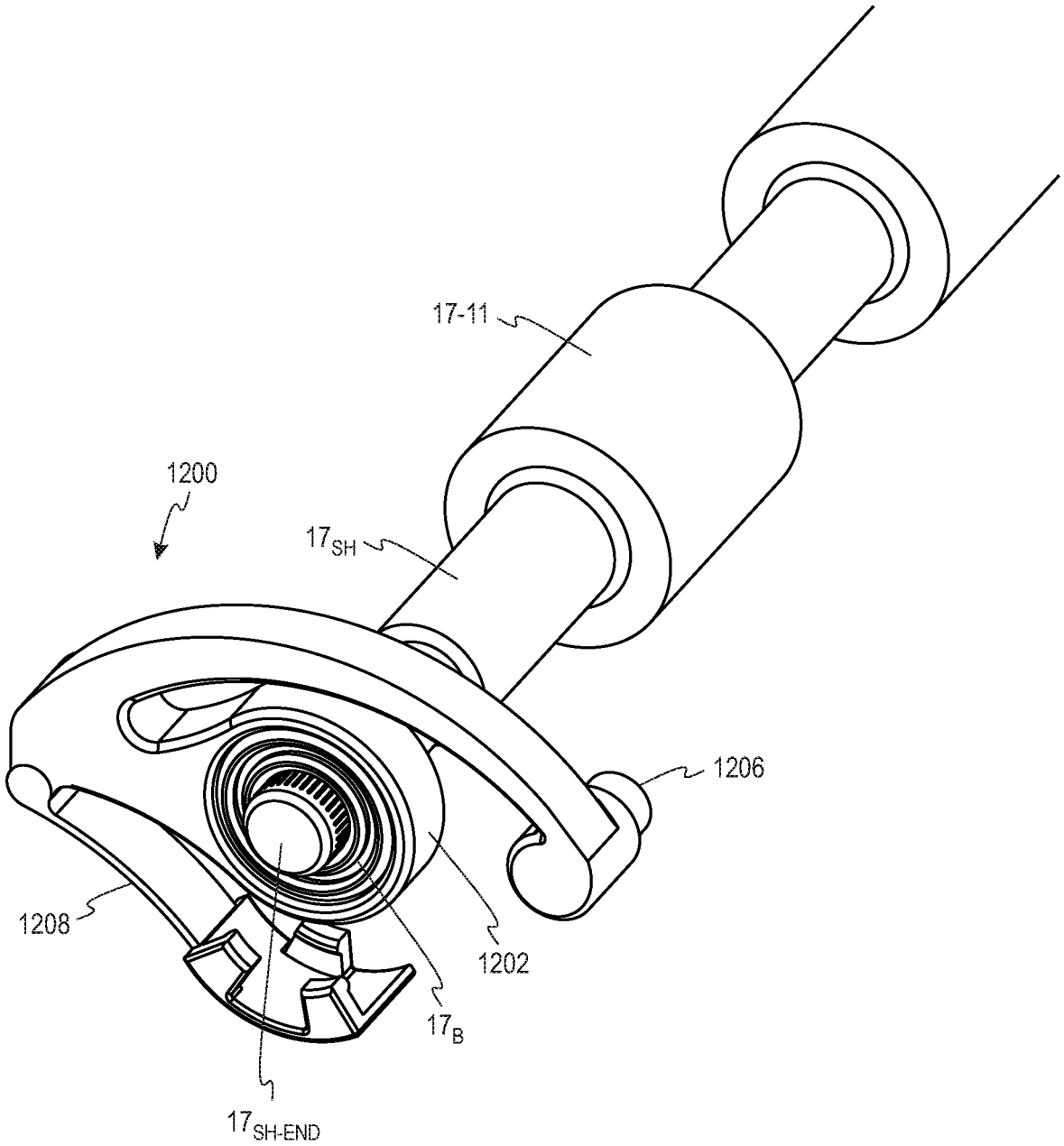
FIG. 14A is a perspective view of a pressure roller shaft having a pressure roller bearing positioned within a pressure roller housing with the pressure roller housing being in an open, non-operational state.
Figure 14B:
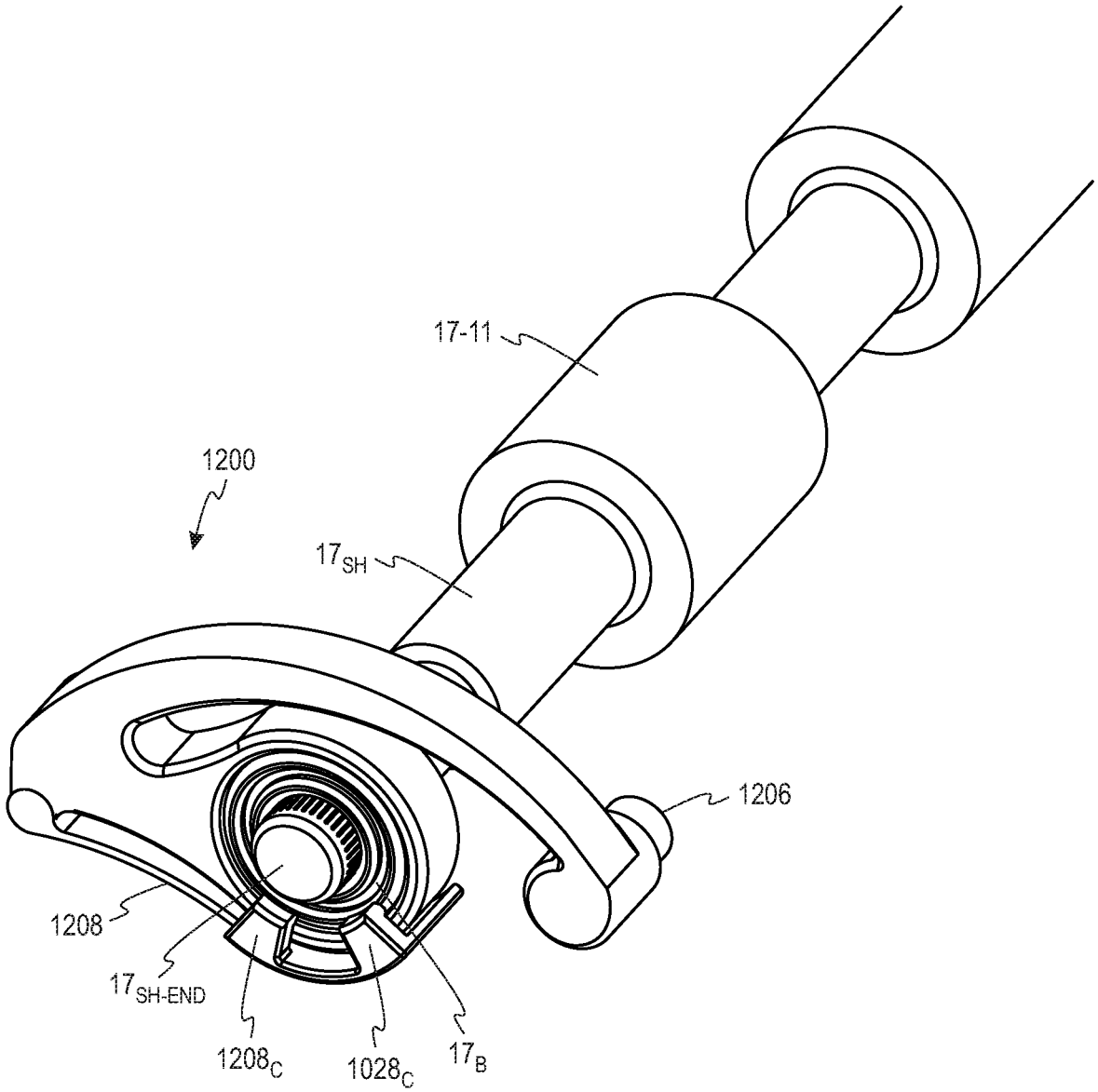
FIG. 14B is a perspective view of a pressure roller shaft having a pressure roller bearing positioned within the pressure roller housing with the pressure roller housing being in a closed, operational state.

FIG. 14A is a perspective view of a pressure roller shaft $\mathbf{17}_{SH}$ having a pressure roller bearing $\mathbf{17}_{B}$ positioned within a pressure roller housing 1200 with the pressure roller housing 1200 being in an open, non-operational state. FIG. 14B is a perspective view of a pressure roller shaft $\mathbf{17}_{SH}$ having a pressure roller bearing $\mathbf{17}_{B}$ positioned within the pressure roller housing 1200 with the pressure roller housing 1200 being in a closed, operational state.

Installation/Removal of Pressure Roller Shafts

According to some embodiments, pressure roller shafts $\mathbf{17}_{SH}$ may be easily installed and/or removed from the transport mechanisms described herein such as during initial assembly and/or during service of the transport mechanisms. According to some such embodiments, the transport mechanism utilizes pressure roller housings 1200. With reference to FIGS. 14A and 11B, during initial assembly, a pressure roller shaft $\mathbf{17}_{SH}$ having one or more pressure rollers 17-11 thereon and having a bearing $\mathbf{17}_{B}$ mounted to and near each of the ends of the pressure roller shaft $\mathbf{17}_{SH}$ is positioned within a pressure roller assembly $\mathbf{1117}_{A}$, $\mathbf{1117}_{B}$ by first positioning a first end of the pressure roller shaft $\mathbf{17}_{SH}$ between the two corresponding side plates $\mathbf{1102}_{SD}$, $\mathbf{1104}_{SD}$ of the pressure roller assembly $\mathbf{1117}_{A}$, $\mathbf{1117}_{B}$. Then the bearing $\mathbf{17}_{B}$ located at a first end of the pressure roller shaft $\mathbf{17}_{SH}$ is fed through a first pressure roller shaft aperture $\mathbf{1102}_{SD\text{-}AP17}$ (see FIG. 11B) in a first one of the side plates $\mathbf{1102}_{SD}$, $\mathbf{1104}_{SD}$. The pressure roller shaft $\mathbf{17}_{SH}$ may be continued to be fed through a first pressure roller shaft aperture $\mathbf{1102}_{SD\text{-}AP17}$ located in a first one of the side plates until the second end of the pressure roller shaft $\mathbf{17}_{SH}$ clears the second side plate at which point the second end of the pressure roller shaft $\mathbf{17}_{SH}$ may be positioned parallel to an associated transport plate 1102, 1104. Then the bearing $\mathbf{17}_{B}$ located at the second end of the pressure roller shaft $\mathbf{17}_{SH}$ is fed through a second pressure roller shaft aperture $\mathbf{1102}_{SD\text{-}AP17}$ in the second one of the side plates $\mathbf{1102}_{SD}$, $\mathbf{1104}_{SD}$. Then pressure roller shaft $\mathbf{17}_{SH}$ is positioned between the first and second side plates, e.g., side plates $\mathbf{1102}_{SD}$ so that the bearings $\mathbf{17}_{B}$ on opposite ends of the pressure roller shaft $\mathbf{17}_{SH}$ extend past exterior sides $\mathbf{1102}_{SD\text{-}EXT}$, $\mathbf{1104}_{SD\text{-}EXT}$ of the side plates $\mathbf{1102}_{SD}$, $\mathbf{1104}_{SD}$. A pressure roller housing 1200 is then positioned about the bearings $\mathbf{17}_{B}$ with each bearing $\mathbf{17}_{B}$ being positioned within a respective opening or aperture $\mathbf{1202}_{AP}$ of a respective bearing housing 1202 as shown in FIG. 14A and the one or more locating lugs 1206 of the pressure roller housing 1200 are positioned within corresponding apertures $\mathbf{1102}_{SD\text{-}AP1200}$, $\mathbf{1104}_{SD\text{-}AP1200}$ in the corresponding side plates $\mathbf{1102}_{SD}$, $\mathbf{1104}_{SD}$ (see, e.g., FIG. 11B). Then, the bearing clip arm 1208 and the associated one or more bearing retaining clips or flanges 1208*c* of each pressure roller housing 1200 is moved to its closed, operational state as shown in FIGS. 14B and 11B.

According to some embodiments, the bearings $\mathbf{17}_{B}$ are a press-fit on the pressure roller shafts $\mathbf{17}_{SH}$ and are mounted to the pressure roller shaft $\mathbf{17}_{SH}$ prior to the ends of the pressure roller shaft $\mathbf{17}_{SH}$ being fed through the apertures $\mathbf{1102}_{SD\text{-}AP17}$, $\mathbf{1104}_{SD\text{-}AP17}$ of the side plates $\mathbf{1102}_{SD}$, $\mathbf{1104}_{SD}$. According to some such embodiments, two pre-assembled press-fit bearings $\mathbf{17}_{B}$ are installed near the ends of each pressure roller shaft $\mathbf{17}_{SH}$ at appropriate spacing from each other and the pressure rollers 17-10, 17-11 on the pressure roller shaft $\mathbf{17}_{SH}$. According to some embodiments, the pressure roller shaft $\mathbf{17}_{SH}$ is an overmolded pressure roller shaft $\mathbf{17}_{SH}$ having the pressure rollers 17-10, 17-11 formed therewith such as being cast or injection molded as a unitary part. According to some embodiments, the pressure rollers 17-10, 17-11 and the pressure roller shaft $\mathbf{17}_{SH}$ are separate parts and the pressure rollers 17-10, 17-11 are mounted on and fixed to the pressure roller shaft $\mathbf{17}_{SH}$.

While the bearings $\mathbf{17}_{B}$ are described as having already been mounted to the pressure roller shaft $\mathbf{17}_{SH}$ prior to feeding the ends of the pressure roller shaft $\mathbf{17}_{SH}$ through the apertures $\mathbf{1102}_{SD\text{-}AP17}$, $\mathbf{1104}_{SD\text{-}AP17}$ of the side plates $\mathbf{1102}_{SD}$, $\mathbf{1104}_{SD}$, according to some alternative embodiments, the bearings $\mathbf{17}_{B}$ may be mounted to the pressure roller shaft $\mathbf{17}_{SH}$ after feeding the ends of the pressure roller shaft $\mathbf{17}_{SH}$ through the apertures $\mathbf{1102}_{SD\text{-}AP17}$, $\mathbf{1104}_{SD\text{-}AP17}$ of the side plates $\mathbf{1102}_{SD}$. According to some such alternative embodiments wherein the bearings $\mathbf{17}_{B}$ are to be mounted to a pressure roller shaft $\mathbf{17}_{SH}$ after the pressure roller shaft $\mathbf{17}_{SH}$ has been fed through the side plates, a means is employed to maintain each bearing $\mathbf{17}_{B}$ in a fixed location on the shaft $\mathbf{17}_{SH}$ (such as the use of a shoulder positioned near each end on the pressure roller shaft $\mathbf{17}_{SH}$ or a groove and an e-ring at each end of the pressure roller shaft $\mathbf{17}_{SH}$). According to some embodiments, the bearings $\mathbf{17}_{B}$ are mounted to the shaft $\mathbf{17}_{SH}$ in a manner that they cannot move towards each other from their designed locations.

According to some embodiments, when the bearing clip arms 1208 and the associated one or more bearing retaining clips or flanges 1208*c* of each pair of pressure roller housings 1200 are moved to their closed, operational state as shown in FIGS. 14B and 11B, the clips or flanges $\mathbf{1208}_{C}$ positioned about the bearings $\mathbf{17}_{B}$ and the preset spacing between the bearings $\mathbf{17}_{B}$ properly position the pressure roller shaft $\mathbf{17}_{SH}$ laterally between the side plates $\mathbf{1102}_{SD}$, $\mathbf{1104}_{SD}$ and laterally relative to the corresponding driven rollers. Likewise, the locating lugs 1206 and the corresponding apertures $\mathbf{1102}_{SD\text{-}AP1200}$, $\mathbf{1104}_{SD\text{-}AP1200}$ in the corresponding side plates $\mathbf{1102}_{SD}$, $\mathbf{1104}_{SD}$ may precisely position the pressure roller shaft $\mathbf{17}_{SH}$ in the cross-gap direction (parallel to the Z-axis in FIG. 11B) and in the feed direction (parallel to the y-axis in FIG. 11B).

According to some embodiments, the pressure roller housings 1200 perform as injection-molded springs to allow notes to pass between driven rollers on a fixed, position drive shaft $\mathbf{14}_{SH}$ and pressure rollers on a pressure roller shaft $\mathbf{17}_{SH}$ being held at its ends by pressure roller housings 1200. According to some embodiments, only holes $\mathbf{1102}_{SD\text{-}}$ $_{AP1200}$, 1104$_{SD\text{-}AP1200}$ in the side plates 1102$_{SD}$, 1104$_{SD}$ (which may be made from, for example, sheet metal) are required to locate the pressure roller housings 1200 and the associated spring arms 1204. According to some embodiments, the roller shaft bearings 17$_B$ may be pressed onto the ends of the pressure roller shafts 17$_{SH}$. According to some embodiments, the bearing clip arms 1208 in their closed, operational state about roller shaft bearings 17$_B$ mounted on a pressure roller shaft 17$_{SH}$ and the locating lugs 1206 positioned within holes 1102$_{SD\text{-}AP1200}$, 1104$_{SD\text{-}AP1200}$ in the side plates 1102$_{SD}$, 1104$_{SD}$ retain the pressure roller housings 1200 in their operational position and locate the pressure roller shaft 17$_{SH}$ axially.

To remove a pressure roller shaft 17$_{SH}$ from a pressure roller assembly 1117$_A$, 1117$_B$, first the bearing clip arms 1208 and the associated one or more bearing retaining clips or flanges 1208$_C$ of each pressure roller housing 1200 coupled to the ends of the pressure roller shaft 17$_{SH}$ are moved to their open, non-operational state as shown in FIG. 14A and the pressure roller housings 1200 are decoupled from the ends of the pressure roller shaft 17$_{SH}$. Then the pressure roller shaft 17$_{SH}$ is moved laterally until one end, e.g., the second end, of the pressure roller shaft 17$_{SH}$ clears a side plate, e.g., the second side plate, at which point the second end of the pressure roller shaft 17$_{SH}$ may be angled away from an associated transport plate 1102, 1104. Then the pressure roller shaft 17$_{SH}$ may be moved so that the bearing 17$_B$ located at the first end of the pressure roller shaft 17$_{SH}$ is fed through the first pressure roller shaft apertures 1102$_{SD\text{-}AP17}$ (see FIG. 11B) in the first one of the side plates 1102$_{SD}$, 1104$_{SD}$ such that the bearing 17$_B$ located at the first end of the pressure roller shaft 17$_{SH}$ is positioned between the two side plates, e.g., 1102$_{SD}$. The pressure roller shaft 17$_{SH}$ may then be removed from the corresponding pressure roller assembly 1117$_A$, 1117$_B$.

To reinstall the removed pressure roller shaft 17$_{SH}$ or install a new pressure roller shaft 17$_{SH}$ in place thereof, the procedure to install a pressure roller shaft 17$_{SH}$ during initial assembly may then be followed.

Installation/Removal of Drive Shafts

According to some embodiments, drive shafts 14$_{SH}$ may be easily installed and/or removed from the transport mechanisms described herein such as during initial assembly and/or during service of the transport mechanisms. According to some such embodiments, the transport mechanism utilizes driven roller housings 1300. With reference to FIGS. 11D and 13, during initial assembly, a drive shaft 14$_{SH}$ having one or more driven rollers (e.g., driven rollers 14, 14-11, 14-11$_M$, 14-11$_{CON}$, and/or 14-11$_{END}$) thereon and having a bearing 14$_B$ mounted to and near each of the ends of the drive shafts 14$_{SH}$ is positioned within a driven roller assembly 1114 by first positioning a first end of the drive shaft 14$_{SH}$ between the two corresponding side plates 1106$_{SD}$ of the driven roller assembly 1114. Then the bearing 14$_B$ located at a first end of the drive shafts 14$_{SH}$ is fed through a first driven roller shaft aperture 1106$_{SD\text{-}AP14}$ in a first one of the side plates 1106$_{SD}$. The drive shaft 14$_{SH}$ may be continued to be fed through a first driven roller shaft aperture 1106$_{SD\text{-}AP14}$ located in a first one of the side plates until the second end of the drive shaft 14$_{SH}$ clears the second side plate at which point the second end of the drive shaft 14$_{SH}$ may be positioned parallel to an associated transport plate 1106$_A$, 1106$_B$. Then the bearing 14$_B$ located at the second end of the drive shaft 14$_{SH}$ is fed through a second driven roller shaft aperture 1106$_{SD\text{-}AP14}$ in the second one of the side plates 1106$_{SD}$. Then drive shaft 14$_{SH}$ is positioned between the first and second side plates, e.g., side plates 1106$_{SD}$ so that the bearings 14$_B$ on opposite ends of the drive shaft 14$_{SH}$ extend past exterior sides 1106$_{SD\text{-}EXT}$ of the side plates 1106$_{SD}$.

A driven roller housing 1300 is then positioned about the bearings 14$_B$ with each bearing 14$_B$ being positioned within a respective opening or aperture 1301$_{AP}$ of a respective bearing housing 1300 and the interior ends 1310$_{IN}$ of one or more locking tabs 1310 of the driven roller housing 1300 are positioned within corresponding apertures 1106$_{SD\text{-}AP1300}$ in the corresponding side plates 1106$_{SD}$ (see, e.g., FIG. 11B). According to some embodiments, a driven roller housing 1300 is positioned about the bearings 14$_B$ and the interior ends 1310$_{IN}$ of one or more locking tabs 1310 of the driven roller housing 1300 are positioned within corresponding apertures 1106$_{SD\text{-}AP1300}$ in the corresponding side plates 1106$_{SD}$ with the ends 1301$_A$, 1301$_B$ of the body 1301 of the driven roller housing 1300 rotated at an angle with respect to the plane of an associated transport plate, e.g., transport plate 1106$_B$ (see driven roller housing 1300$_A$ in FIGS. 11B and 11D shown in an insertion/removal position). Likewise, according to some embodiments, during this step, the exterior ends 1310$_{OUT}$ of the locking tabs 1310 are moved toward each other (e.g., in the direction 1320) by an external bias such as by an installer or service personnel squeezing the locking tabs toward each other between a thumb and index finger of the person so that the interior ends 1310$_{IN}$ of the locking tabs 1310 move away from each other (in a direction opposite of direction 1320) whereby the interior ends 1310$_{IN}$ of the locking tabs 1310 fit more easily into the corresponding apertures 1106$_{SD\text{-}AP1300}$. The external bias is removed and the interior ends 1310$_{IN}$ of locking tabs 1310 move toward each other.

According to some embodiments, the apertures an enlarged portion or cutout 1106$_{SD\text{-}AP1300R}$ near one end of each. Likewise, according to some embodiments, the driven roller shaft aperture 1106$_{SD\text{-}AP14}$ have enlarged portions or cutouts 1106$_{SD\text{-}AP14C}$ sized to permit the interior side flanges 1302$_C$ of the driven roller housing 1300 to fit therethrough. According to some embodiments, the enlarged portions or cutouts 1106$_{SD\text{-}AP14C}$ are positioned on opposite sides of the driven roller shaft aperture 1106$_{SD\text{-}AP14}$ and are offset from a plane parallel to an associated transport plate, e.g., transport plate 1106$_B$.

During installation of a driven roller housing 1300 about a bearings 14$_B$, the interior side flanges 1302*c* are aligned with the enlarged portions or cutouts 1106$_{SD\text{-}AP14C}$ of the driven roller shaft aperture 1106$_{SD\text{-}AP14}$ and the interior side flanges 1302*c* are inserted through the enlarged portions or cutouts 1106$_{SD\text{-}AP14C}$ in a laterally inward direction (e.g., in the negative x-direction in FIG. 11D for housing 1300$_A$) until the interior side flanges 1302*c* clear the interior side 1106$_{SD\text{-}IN}$ of the side plate 1106$_{SD}$. At this point, the inner side 1301$_{IN}$ of the body 1301 of the driven roller housing 1300 is adjacent to and may be abutting the exterior side 1106$_{SD\text{-}EXT}$ of the side plate 1106$_{SD}$. Then the body 1301 of the driven roller housing 1300$_A$ is rotated (clockwise in FIG. 11B). As the body 1301 is rotated, the interior side flanges 1302$_C$ become no longer aligned with the enlarged portions or cutouts 1106$_{SD\text{-}AP14C}$ and the inner side 1302$_{IN}$ of the interior side flanges 1302$_C$ move to be adjacent to and perhaps abutting the interior side 1106$_{SD\text{-}IN}$ of the side plate 1106$_{SD}$, thereby preventing the driven roller housing 1300 from moving laterally outward (e.g., in the x-direction in FIG. 11D). As the body 1301 is continued to be rotated, the interior ends 1310$_{IN}$ of locking tabs 1310 become aligned with the enlarged portion or cutout $1106_{SD\text{-}AP1300R}$ of the apertures $1106_{SD\text{-}AP1300}$ at which point the interior ends $1310_{IN}$ of locking tabs 1310 move toward each other and rest in the enlarged portion or cutout $1106_{SD\text{-}AP1300R}$ (see, e.g., driven roller housing $1300_B$ shown in a locked position next to the driven roller housing $1300_A$ in FIGS. 11B, 11D). Inadvertent rotation of the body 1301 in the opposite direction (counter-clockwise in FIG. 11B) is prevented by the inward bias of the interior ends $1310_{IN}$ of locking tabs 1310 into the enlarged portion or cutout $1106_{SD\text{-}AP1300R}$ and the contact of the interior ends $1310_{IN}$ of locking tabs 1310 with the edge of the side plate $1106_{SD}$ adjacent to the enlarged portion or cutout $1106_{SD\text{-}AP1300R}$. In like manner, a second driven roller housing 1300 is installed on the bearing $14_B$ on the other end of the drive shaft $14_A$.

According to some embodiments, the bearings $14_B$ are a press-fit on the drive shaft $14_{SH}$ and are mounted to the drive shaft $14_{SH}$ prior to the ends of the drive shaft $14_{SH}$ being fed through the apertures $1106_{SD\text{-}AP14}$ of the side plates $1106_{SD}$. According to some such embodiments, two pre-assembled press-fit bearings $14_B$ are installed near the ends of each drive shaft $14_{SH}$ at appropriate spacing from each other and the rollers 14 on the drive shaft $14_{SH}$. According to some embodiments, the drive shaft $14_{SH}$ is an overmolded drive shaft $14_{SH}$ having the driven rollers 14 formed therewith such as being cast or injection molded as a unitary part. According to some embodiments, the driven rollers 14 and the drive shaft $14_{SH}$ are separate parts and the driven rollers 14 are mounted on and fixed to the drive shaft $14_{SH}$.

While the bearings $14_B$ are described as having already been mounted to the drive shaft $14_{SH}$ prior to feeding the ends of the drive shaft $14_{SH}$ through the apertures $1106_{SD\text{-}AP14}$ of the side plates $1106_{SD}$, according to some alternative embodiments, the bearings $14_B$ may be mounted to the drive shaft $14_{SH}$ after feeding the ends of the drive shaft $14_{SH}$ through the apertures $1106_{SD\text{-}AP14}$ of the side plates $1106_{SD}$. According to some such alternative embodiments wherein the bearings $14_B$ are to be mounted to the shaft $14_{SH}$ after the drive shaft $14_{SH}$ has been fed through the side plates, a means is employed to maintain each bearing $14_B$ in a fixed location on the shaft $14_{SH}$ (such as the use of a shoulder positioned near each end on the drive shaft $14_{SH}$ or a groove and an e-ring at each end of the drive shaft $14_{SH}$). According to some embodiments, the bearings $14_B$ are mounted to the shaft $14_{SH}$ in a manner that they cannot move towards each other from their designed locations.

According to some embodiments, a drive roller housing 1300 is inserted into slots $1106_{SD\text{-}AP14}$, $1106_{SD\text{-}AP1300}$ in the side plates and rotated as described above. The interior side flanges 1302*c* act as clips to hold the drive roller housing 1300 (and drive roller shaft $14_{SH}$) axially, while the locking tabs $1310_{IN}$ prevents inadvertent rotation.

According to some embodiments, when the drive roller housings 1300 are moved to their locked positions, the drive roller housings 1300 positioned about the bearings $14_B$ and the preset spacing between the bearings $14_B$ properly position the drive shaft $14_{SH}$ laterally between the side plates $1106_{SD}$ and laterally relative to the corresponding pressure rollers on the corresponding pressure roller shaft $17_{SH}$ (or rails 16 when drive roller housings 1300 are employed in connection with roller-to-rail systems such as with the drive shafts $14_{SH}$ of FIGS. 1-2 or belts 1602 drive roller housings 1300 are employed in connection with roller-to-belts systems such as with drive shafts $14_{SH}$ of FIGS. 15A-15C). Likewise, the dimensions of the side plate flanges 1302 and the corresponding driven roller shaft aperture $1106_{SD\text{-}AP14}$ in the corresponding side plates $1106_{SD}$ may precisely position the drive roller shaft $14_{SH}$ in the cross gap direction (parallel to the Z-axis in FIG. 11D) and in the feed direction (parallel to the y-axis in FIG. 11D).

To remove a drive shaft $14_{SH}$ from a driven roller assembly 1114, the exterior ends $1310_{OUT}$ of the locking tabs 1310 are moved toward each other (e.g., in the direction 1320) by an external bias such as by an installer or service personnel squeezing the locking tabs toward each other between a thumb and index finger of the person so that the interior ends $1310_{IN}$ of the locking tabs 1310 move away from each other (in a direction opposite of direction 1320) whereby the interior ends $1310_{IN}$ of the locking tabs 1310 exit the enlarged portion or cutout $1106_{SD\text{-}AP1300R}$ of the apertures $1106_{SD\text{-}AP1300}$ and the body 1301 is rotated (counter-clockwise in FIG. 11B) so that the interior ends $1310_{IN}$ of the locking tabs 1310 are no longer aligned with the enlarged portion or cutout $1106_{SD\text{-}AP1300R}$. The body 1301 of the driven roller housing continued to be rotated (counter-clockwise in FIG. 11B) until the interior side flanges 1302*c* become aligned with the enlarged portions or cutouts $1106_{SD\text{-}AP14C}$ of the driven roller shaft aperture $1106_{SD\text{-}AP14}$. The driven roller housing 1300 is then moved in a laterally outward direction (e.g., in the x-direction in FIG. 11D) as the interior side flanges 1302*c* pass through the enlarged portions or cutouts $1106_{SD\text{-}AP14C}$ until the interior side flanges $1302_C$ clear the exterior side $1106_{SD\text{-}EXT}$ of the side plate $1106_{SD}$. In like manner, a second driven roller housing 1300 is removed from the bearing $14_B$ on the other end of the drive shaft $14_A$.

Then the drive shaft $14_{SH}$ is then moved laterally so that the bearing $14_B$ located at one end, e.g., the second end, of the drive shaft $14_{SH}$ is fed through the second driven roller shaft apertures $1106_{SD}$ and the second end, of the drive shaft $14_{SH}$ clears an inner side $1106_{SD\text{-}IN}$ of a side plate, e.g., the second side plate, at which point the second end of the drive shaft $14_{SH}$ may be angled away from an associated transport plate, e.g., transport plate $1106_B$. Then the drive shaft $14_{SH}$ may be moved so that the bearing $14_B$ located at the first end of the drive shaft $14_{SH}$ is fed through the first driven roller shaft apertures $1106_{SD\text{-}AP14}$ (see FIG. 11D) in the first one of the side plates $1106_B$ such that the bearing $14_B$ located at the first end of the drive shaft $14_{SH}$ is positioned between the two side plates, e.g., $1106_B$. The drive shaft $14_{SH}$ may then be removed from the corresponding driven roller assembly 1114.

To reinstall the removed drive shaft $14_{SH}$ or install a new drive shaft $14_{SH}$ in place thereof, the procedure to install a drive shaft $14_{SH}$ during initial assembly may then be followed.

According to some embodiments employing a bi-directional driven transport assembly such as driven roller assembly 1114 shown in FIGS. 11B-11D, one of the transport plates 1106A, 1106B is removed (or not yet installed) prior to inserting or removing a drive shaft $14_{SH}$ from the driven roller assembly 1114.

According to some embodiments, housings 1200 and 1300 may employed in connection with roller-to-belts systems such as with drive shafts $14_{SH}$ and belt shafts $1604_{SH}$ of FIGS. 15A-15C to precisely positioned the belts (e.g., belts) 1602 and the driven rollers laterally relative to each other. Likewise, according to some embodiments, housings 1200 and/or 1300 may employed in connection with roller-to-rail systems such as with drive shafts $14_{SH}$ of FIGS. 1-3 to precisely positioned the driven rollers laterally relative to rails such as rails 16.

While the transport path is illustrated in FIGS. 1-3 as being generally horizontal, it may be inclined from horizontal and/or vertical and/or transition from horizontal to inclined and/or vertical or vice versa. Likewise, the transport paths for the other transport mechanisms described herein (such as those illustrated and/or described in connection with FIGS. 5A-15C) may have portions which are horizontal, vertical, and/or inclined.

According to some embodiments, the transport paths described above are generally planar apart from the corrugation inducing structures. For example, the driven roller axes $\mathbf{14}_A$ may lie in a first plane (such as a horizontal plane parallel to the XY plane) and the upper or interior or distal ends or surfaces $\mathbf{16}_{IN}$ of the rails 16 may lie in a second plane parallel to the first plane. Likewise, the driven rollers 14 may have the same dimensions or same radius so that outer periphery $\mathbf{14}_{PR}$ of driven rollers 14 positioned on a plurality of driven roller shafts $\mathbf{14}_{SH}$ define a third plane at level $\mathbf{14}_L$ parallel to the second plane defined by the upper or interior or distal ends or surfaces $\mathbf{16}_{IN}$ of the rails 16. According to such embodiments, banknotes that travel along the section of the transport path shown in FIGS. 1-2 are corrugated only in two dimensions, e.g., XZ while for a given lateral position the banknotes are generally flat in the direction of motion of the banknote, e.g., in the Y direction in FIGS. 1-2.

According to some embodiments, banknotes to be transported by the transport mechanisms described herein are generally rectangularly shaped having two generally parallel wide or long edges and two generally orthogonal narrow or short edges and two banknote surfaces or faces. According to some embodiments, the banknote transport mechanisms described herein are employed to transport banknotes in a wide-edge leading manner. According to some embodiments, the banknote transport mechanisms described herein are employed to transport U.S. banknotes.

According to some embodiments, the banknote transport mechanisms described herein are employed in a banknote processing device such as a Cummins-Allison JetScan® banknote processing device such as, for example, a JetScan® MPS and/or iFX® banknote processing device. Examples of banknote processing devices in which the banknote transport mechanisms described herein may be employed include, for example, those described in U.S. Pat. Nos. 6,398,000; 7,686,151; 7,726,457; 8,544,656; 9,141,876 and U.S. Pat. App. Serial No. 16/119,768 filed Aug. 31, 2018, each of which is incorporated herein by reference in its entirety.

For example, in some embodiments, a stack of currency bills or banknotes is stacked in a hopper and then fed, one after the other in a one at a time, seriatim manner, into a path leading to one or more transport paths leading to one or more banknote designations such as externally accessible open output receptacles and/or internal storage bins or cassettes. The banknote transport mechanisms described herein may be employed along one or more of such transport paths.

According to some embodiments, the transport mechanisms described herein are operated at high speeds and can transport banknotes at a rate of at least 5000 inches per minute and/or transport banknotes at a rate of at least 1000 banknotes per minute along the transport path such as, for example, at a rate of at least 1000 U.S. banknotes per minute in a wide-edge leading manner. According to some embodiments, U.S. banknotes at transported along the transport path a rate of at least 1000 banknotes per minute with minimal introduced skewing, such as, for example, less than 1°.

According to some embodiments, the transport mechanisms described herein transport banknotes at a rate of at least 600 banknotes per minute along the transport path such as, for example, at a rate of at least 600 U.S. banknotes per minute in a wide-edge leading manner.

According to some embodiments, the transport mechanisms described herein transport banknotes at a rate of at least 800 banknotes per minute along the transport path such as, for example, at a rate of at least 800 U.S. banknotes per minute in a wide-edge leading manner.

According to some embodiments, the transport mechanisms described herein transport banknotes at a rate of at least 1200 banknotes per minute along the transport path such as, for example, at a rate of at least 1200 U.S. banknotes per minute in a wide-edge leading manner.

According to some embodiments, the transport mechanisms described herein transport banknotes at a rate of at least 1400 banknotes per minute along the transport path such as, for example, at a rate of at least 1400 U.S. banknotes per minute in a wide-edge leading manner.

According to some embodiments, the banknote transport mechanisms described herein transport banknotes such that the leading edge of each banknote is generally flat (except for any induced corrugation) especially near the lateral ends of the leading edge (e.g., near the leading corners of the banknotes) and the driven rollers and opposing structures such as rails, pressure rollers, or belts are laterally arranged with respect to each other to facilitate the same.

According to some embodiments, the banknote transport mechanisms described herein are advantageously employed without or with the reduced use of leaf springs and/or other springs to bias structures opposing driven rollers such as pressure rollers or rails. According to some such embodiments, the springy nature of a bent or corrugated banknote may be employed to bias banknotes into frictional engagement with driven rollers without or with the reduced use of leaf springs and/or other springs to bias structures opposing driven rollers to in turn bias banknotes into engagement with driven rollers. For example, according to some embodiments, the transport mechanism illustrated in FIG. 10 is employed without using leaf springs to bias the position of the pressure rollers 17-10 and/or pressure roller shafts $\mathbf{17}_{SH}$ and/or without the use of the pressure roller housings 1200. The avoidance of the use of leaf springs and/or other types of springs can reduce manufacturing costs such as by reducing the number and costs of the parts of the transport mechanism.

According to some embodiments, the driven rollers and the pressure rollers described herein (e.g. in connection with FIGS. 1-15C) each have a circular cross-section and have a maximum radius. According to some embodiments, the driven rollers described herein and positioned on a single driven roller shaft all have approximately the same maximum radius. According to some embodiments, the driven rollers described herein and positioned on a plurality driven roller shafts all have approximately the same maximum radius. According to some embodiments, the pressure rollers described herein and positioned on a single pressure roller shaft all approximately have the same maximum radius. According to some embodiments, the pressure rollers described herein and positioned on a plurality pressure roller shafts all have approximately the same maximum radius.

According to some embodiments, the transport mechanisms described herein (e.g. in connection with FIGS. 1-15C) comprise a plurality of driven roller shafts, each driven roller shaft having a plurality driven rollers positioned thereon and each driven roller having approximately the same maximum radius. According to some embodiments, the transport mechanisms described herein comprise a plurality of pressure roller shafts, each pressure roller shaft having a plurality pressure rollers positioned thereon and each pressure roller having approximately the same maximum radius. According to some embodiments, the transport mechanisms described herein comprise a plurality of driven roller shafts and a plurality of pressure roller shafts, each driven roller shaft having a plurality driven rollers positioned thereon and each driven roller having approximately the same first maximum radius and each pressure roller shaft having a plurality pressure rollers positioned thereon and each pressure roller having the approximately same second maximum radius. According to some embodiments of the transport mechanisms described herein, the driven roller shafts lie generally in a first plane and each driven roller positioned on the driven roller shafts has approximately the same first maximum radius such that the outer peripheries $\mathbf{14}_{PR}$ of the driven rollers lie generally in a second plane generally parallel to the first plane. According to some embodiments of the transport mechanisms described herein, the pressure roller shafts associated with a given transport path lie generally in a third plane and each pressure roller positioned on the driven roller shafts has approximately the same second maximum radius such that the outer peripheries $\mathbf{17}_{PR}$ of the pressure rollers lie generally in a fourth plane generally parallel to the third plane. According to some embodiments, the distance between the second and fourth planes defines the interference distance or cross-path gap described herein.

According to some embodiments of the transport mechanisms described herein, the driven rollers 14 extend into the transport path to a path-side driven roller level $\mathbf{14}_L$ as determined by the outer periphery or circumference $\mathbf{14}_{PR}$ and maximum radius of each driven roller 14. Likewise, according to some embodiments of the transport mechanisms described herein, the pressure rollers 17 extend into the transport path to a path-side pressure roller level akin to level $\mathbf{16}_T$ as determined by the outer periphery or circumference $\mathbf{17}_{PR}$ and maximum radius of each pressure roller 17 (e.g., pressure rollers 17-10, 17-11). According to some embodiments, the distance between the path-side driven roller level $\mathbf{14}_L$ and the path-side pressure roller level defines the interference distance or cross-path gap described herein.

According to some embodiments, the transport mechanisms described herein (e.g. in connection with FIGS. 15A-15C) comprise a plurality of belt shafts $\mathbf{1604}_{SH}$, each belt shaft having a plurality of pulleys 1604 positioned thereon and a belt 1602 positioned about each pulley, each pulley having approximately the same maximum radius and each belt having approximately the same thickness. According to some embodiments of the transport mechanisms described herein, the belts 1602 extend into the transport path to a path-side belt level akin to level $\mathbf{16}_T$ as determined by the thickness of the belts 1602 and maximum radius of each pulley 1604. According to some embodiments, the distance between the path-side driven roller level $\mathbf{14}_L$ and the path-side belt level defines the interference distance or cross-path gap described herein.

Further Embodiments

Embodiment 1. A banknote transport mechanism comprising a plurality of driven rollers positioned on a driven roller shaft wherein the driven roller shaft rotates about driven roller axis and a plurality of low friction rails, each low friction rail having a longitudinal axis generally parallel to a direction of banknote transport; wherein the driven roller axis is oriented generally perpendicular to the direction of banknote transport along a transport path; wherein the driven rollers are offset laterally in a direction transverse to the direction of banknote transport from the lateral location of each rail; wherein the driven rollers cooperate with the rails to transport a banknote in the direction of banknote transport with the banknote being corrugated in a direction generally transverse to the direction of banknote transport.

Embodiment 2. A banknote transport mechanism comprising a plurality of driven roller shafts spaced apart in a direction of banknote transport along a transport path, wherein a plurality of driven rollers are positioned on each driven roller shaft, wherein each driven roller shaft rotates about a respective driven roller axis; and a plurality of low friction rails, each low friction rail having and upper surface and a longitudinal axis generally parallel to a direction of banknote transport; wherein the plurality of driven roller axes are oriented generally perpendicular to the direction of banknote transport along the transport path; wherein the plurality of driven roller axes generally lie in a first plane and the upper surfaces of the low friction rails generally lie in a second plane parallel to the first plane; wherein the driven rollers of each driven roller shaft are offset laterally in a direction transverse to the direction of banknote transport from the lateral location of each rail; wherein the driven rollers cooperate with the rails to transport a banknote in the direction of banknote transport with the banknote being corrugated in a direction generally transverse to the direction of banknote transport.

Embodiment 3. The banknote transport mechanism of embodiment 1 or embodiment 2 wherein each driven roller has an outer surface which contact banknotes being transported along the transport path; wherein the low friction rails have interior or distal ends or surfaces which contact banknotes being transported along the transport path; and wherein the outer surface of the driven rollers and the interior or distal ends or surfaces of the rails are spaced relative to each other so as to define a positive interference distance such that the outer surfaces of the driven rollers extend beyond the interior or distal ends or surfaces of the rails.

Embodiment 4. The banknote transport mechanism of embodiment 3 wherein the interference distance is approximately 0.03 inches.

Embodiment 5. The banknote transport mechanism according to any of embodiments 1-4 wherein the driven rollers are rotated at a speed to transport banknotes along the transport path at a rate of at least 600 banknotes per minutes.

Embodiment 6. The banknote transport mechanism according to any of embodiments 1-4 wherein the driven rollers are rotated at a speed to transport banknotes along the transport path at a rate of at least 800 banknotes per minutes.

Embodiment 7. The banknote transport mechanism according to any of embodiments 1-4 wherein the driven rollers are rotated at a speed to transport banknotes along the transport path at a rate of at least 1000 banknotes per minutes.

Embodiment 8. The banknote transport mechanism according to any of embodiments 1-4 wherein the driven rollers are rotated at a speed to transport banknotes along the transport path at a rate of at least 1200 banknotes per minutes.

Embodiment 9. The banknote transport mechanism according to any of embodiments 1-4 wherein the driven rollers are rotated at a speed to transport banknotes along the transport path at a rate of at least 1400 banknotes per minutes.

Embodiment 10. The banknote transport mechanism according to any of embodiments 1-9 wherein the banknote transport mechanism transports U.S. banknotes.

Embodiment 11. A method of transporting banknotes along a transport path using a banknote transport mechanism comprising transporting a banknote in a direction of banknote transport along the transport path with the banknote being corrugated in a lateral direction generally transverse to the direction of banknote transport while the banknote is generally flat in the direction of banknote transport at a plurality of lateral locations.

Embodiment 12. The method of embodiment 11 wherein the banknote transport mechanism comprises: a plurality of driven rollers positioned on a driven roller shaft wherein the driven roller shaft rotates about driven roller axis; and a plurality of low friction rails, each low friction rail having a longitudinal axis generally parallel to a direction of banknote transport; wherein the driven roller axis is oriented generally perpendicular to the direction of banknote transport along a transport path; wherein the driven rollers are offset laterally in a direction transverse to the direction of banknote transport from the lateral location of each rail.

Embodiment 13. The method of according to embodiment 12 wherein each driven roller has an outer surface which contact banknotes being transported along the transport path; wherein the low friction rails have interior or distal ends or surfaces which contact banknotes being transported along the transport path; wherein the outer surface of the driven rollers and the interior or distal ends or surfaces of the rails are spaced relative to each other so as to define a positive interference distance such that the outer surfaces of the driven rollers extend beyond the interior or distal ends or surfaces of the rails.

Embodiment 14. The method of embodiment 13 wherein the interference distance is approximately 0.03 inches.

Embodiment 15. The method according to any of embodiments 11-14 wherein the act of transporting is performed at a rate of at least 600 banknotes per minutes.

Embodiment 16. The method according to any of embodiments 11-14 wherein the act of transporting is performed at a rate of at least 800 banknotes per minutes.

Embodiment 17. The method according to any of embodiments 11-14 wherein the act of transporting is performed at a rate of at least 1000 banknotes per minutes.

Embodiment 18. The method according to any of embodiments 11-14 wherein the act of transporting is performed at a rate of at least 1200 banknotes per minutes.

Embodiment 19. The method according to any of embodiments 11-14 wherein the act of transporting is performed at a rate of at least 1400 banknotes per minutes.

Embodiment 20. The method according to any of embodiments 11-19 wherein the act of transporting comprises transporting U.S. banknotes.

Embodiment 21. A banknote transport mechanism comprising: a plurality of driven roller shafts spaced apart in a direction of banknote transport along a transport path, wherein a plurality of laterally offset driven rollers are positioned on each driven roller shaft such that a lateral gap exists between adjacent driven rollers, wherein each driven roller shaft rotates about a respective driven roller axis; a plurality of pressure roller shafts spaced apart in the direction of banknote transport along the transport path, wherein a plurality of laterally offset pressure rollers are positioned on a pressure roller shaft such that a lateral gap exists between adjacent pressure rollers, wherein each pressure roller shaft rotates about a respective pressure roller axis; wherein the pressure rollers and the driven rollers are positioned on opposite sides of a transport path; wherein the driven roller and pressure roller axes are oriented generally perpendicular to the direction of banknote transport along the transport path; wherein one or more of the pressure rollers are laterally positioned in a direction transverse to the direction of banknote transport aligned with the lateral gap between adjacent driven rollers; and wherein the driven rollers cooperate with the pressure rollers to transport a banknote in the direction of banknote transport with the banknote being corrugated in a direction generally transverse to the direction of banknote transport.

Embodiment 22. A banknote transport mechanism comprising: a plurality of driven roller shafts spaced apart in a direction of banknote transport along a transport path, wherein a plurality of laterally offset driven rollers are positioned on each driven roller shaft such that a lateral gap exists between adjacent driven rollers, wherein each driven roller shaft rotates about a respective driven roller axis; a plurality of pressure roller shafts spaced apart in the direction of banknote transport along the transport path, wherein a plurality of laterally offset pressure rollers are positioned on a pressure roller shaft such that a lateral gap exists between adjacent pressure rollers, wherein each pressure roller shaft rotates about a respective pressure roller axis; wherein the pressure rollers and the driven rollers are positioned on opposite sides of a transport path; wherein the driven roller and pressure roller axes are oriented generally perpendicular to the direction of banknote transport along the transport path; wherein one or more of the pressure rollers are laterally positioned in a direction transverse to the direction of banknote transport aligned with the lateral gap between adjacent driven rollers.

Embodiment 23. A banknote transport mechanism comprising: a plurality of driven roller shafts spaced apart in a direction of banknote transport along a transport path, wherein a plurality of laterally offset driven rollers are positioned on each driven roller shaft such that a lateral gap exists between adjacent driven rollers, wherein each driven roller shaft rotates about a respective driven roller axis; a plurality of pressure roller shafts spaced apart in the direction of banknote transport along the transport path, wherein a plurality of laterally offset pressure rollers are positioned on a pressure roller shaft such that a lateral gap exists between adjacent pressure rollers, wherein each pressure roller shaft rotates about a respective pressure roller axis; wherein the pressure rollers and the driven rollers are positioned on opposite sides of a transport path; wherein the driven roller and pressure roller axes are oriented generally perpendicular to the direction of banknote transport along the transport path; wherein one or more of the pressure rollers on each pressure shaft are laterally positioned in a direction transverse to the direction of banknote transport aligned with the lateral gap between adjacent driven rollers; and wherein the driven rollers cooperate with the pressure rollers to transport a banknote in the direction of banknote transport with the banknote being corrugated in a direction generally transverse to the direction of banknote transport.

Embodiment 24. A banknote transport mechanism comprising: a plurality of driven roller shafts spaced apart in a direction of banknote transport along a transport path, wherein a plurality of laterally offset driven rollers are positioned on each driven roller shaft such that a lateral gap exists between adjacent driven rollers, wherein each driven roller shaft rotates about a respective driven roller axis; a plurality of pressure roller shafts spaced apart in the direction of banknote transport along the transport path, wherein a plurality of laterally offset pressure rollers are positioned on a pressure roller shaft such that a lateral gap exists between adjacent pressure rollers, wherein each pressure roller shaft rotates about a respective pressure roller axis; wherein the pressure rollers and the driven rollers are positioned on opposite sides of a transport path; wherein the driven roller and pressure roller axes are oriented generally perpendicular to the direction of banknote transport along the transport path; wherein one or more of the pressure rollers on each pressure shaft are laterally positioned in a direction transverse to the direction of banknote transport aligned with the lateral gap between adjacent driven rollers.

Embodiment 25. The banknote transport mechanism according to any of embodiments 21-24 wherein the plurality of driven rollers have approximately the same path-side driven roller level generally lying in a first plane and wherein the plurality of pressure rollers have approximately the same path-side pressure roller level generally lying in a second plane; wherein the first and second planes are at least approximately parallel.

Embodiment 26. The banknote transport mechanism of embodiment 25 wherein the first and second planes are spaced apart such that a positive interference distance exists.

Embodiment 27. The banknote transport mechanism of embodiment 26 wherein the positive interference distance is approximately 0.03 inches.

Embodiment 28. The banknote transport mechanism of embodiment 25 wherein the first and second planes are the same.

Embodiment 29. The banknote transport mechanism of embodiment 25 wherein the first and second planes are spaced apart such that a negative interference distance exists.

Embodiment 30. The banknote transport mechanism of embodiment 29 wherein the negative interference distance is approximately the same as the thickness of the banknotes to be transported by the banknote transport mechanism.

Embodiment 31. The banknote transport mechanism of embodiment 29 wherein the negative interference distance is approximately 0.004 inches.

Embodiment 32. The banknote transport mechanism according to any of embodiments 21-31 wherein the driven rollers are rotated at a speed to transport banknotes along the transport path at a rate of at least 600 banknotes per minutes.

Embodiment 33. The banknote transport mechanism according to any of embodiments 21-31 wherein the driven rollers are rotated at a speed to transport banknotes along the transport path at a rate of at least 800 banknotes per minutes.

Embodiment 34. The banknote transport mechanism according to any of embodiments 21-31 wherein the driven rollers are rotated at a speed to transport banknotes along the transport path at a rate of at least 1000 banknotes per minutes.

Embodiment 35. The banknote transport mechanism according to any of embodiments 21-31 wherein the driven rollers are rotated at a speed to transport banknotes along the transport path at a rate of at least 1200 banknotes per minutes.

Embodiment 36. The banknote transport mechanism according to any of embodiments 21-31 wherein the driven rollers are rotated at a speed to transport banknotes along the transport path at a rate of at least 1400 banknotes per minutes.

Embodiment 37. The banknote transport mechanism according to any of embodiments 21-36 wherein the banknote transport mechanism transports U.S. banknotes.

Embodiment 38. The banknote transport mechanism according to any of embodiments 21-37 wherein at least two of the pressure roller shafts comprise one or more pressure rollers positioned laterally aligned with and contacting corresponding ones of the driven rollers.

Embodiment 39. The banknote transport mechanism according to any of embodiments 21-37 wherein none of pressure rollers are positioned in lateral alignment with and contacting any of the driven rollers.

Embodiment 40. The banknote transport mechanism according to any of embodiments 21-39 wherein the driven rollers are high-friction rollers and wherein the pressure rollers are low-friction rollers.

Embodiment 41. A method of transporting banknotes along a transport path using a banknote transport mechanism comprising transporting a banknote in a direction of banknote transport along the transport path with the banknote being corrugated in a lateral direction generally transverse to the direction of banknote transport while the banknote is generally flat in the direction of banknote transport at a plurality of lateral locations; wherein the banknote transport mechanism comprises: a plurality of driven rollers positioned on a driven roller shaft wherein the driven roller shaft rotates about a driven roller axis, wherein the plurality of driven rollers are positioned laterally offset on the driven roller shaft such that a lateral gap exists between adjacent driven rollers; a plurality of laterally offset pressure rollers positioned on a pressure roller shaft such that a lateral gap exists between adjacent pressure rollers, wherein the pressure roller shaft rotates about a pressure roller axis; wherein the pressure rollers and the driven rollers are positioned on opposite sides of a transport path; wherein the driven roller and pressure roller axes are oriented generally perpendicular to the direction of banknote transport along the transport path; wherein one or more of the pressure rollers are laterally positioned in a direction transverse to the direction of banknote transport aligned with the lateral gap between adjacent driven rollers; and wherein the driven rollers cooperate with the pressure rollers to transport a banknote in the direction of banknote transport with the banknote being corrugated in a direction generally transverse to the direction of banknote transport.

Embodiment 42. The method of according to embodiment 41 wherein each driven roller has an outer surface which contact banknotes being transported along the transport path; wherein each pressure roller has an outer surface which contact banknotes being transported along the transport path; wherein the outer surfaces of the driven rollers and the pressure rollers are spaced relative to each other so as to define a positive interference distance such that the outer surfaces of the driven rollers extend beyond the outer surfaces of the pressure rollers.

Embodiment 43. The method of embodiment 42 wherein the interference distance is approximately 0.03 inches.

Embodiment 44. The method according to any of embodiments 41-43 wherein the act of transporting is performed at a rate of at least 600 banknotes per minutes.

Embodiment 45. The method according to any of embodiments 41-43 wherein the act of transporting is performed at a rate of at least 800 banknotes per minutes.

Embodiment 46. The method according to any of embodiments 41-43 wherein the act of transporting is performed at a rate of at least 1000 banknotes per minutes.

Embodiment 47. The method according to any of embodiments 41-43 wherein the act of transporting is performed at a rate of at least 1200 banknotes per minutes.

Embodiment 48. The method according to any of embodiments 41-43 wherein the act of transporting is performed at a rate of at least 1400 banknotes per minutes.

Embodiment 49. The method according to any of embodiments 41-43 wherein the act of transporting comprises transporting U.S. banknotes.

Embodiment 50. The method according to any of embodiments 41-49 wherein the plurality of driven rollers have approximately the same path-side driven roller level generally lying in a first plane and wherein the plurality of pressure rollers have approximately the same path-side pressure roller level generally lying in a second plane; wherein the first and second planes are at least approximately parallel.

Embodiment 51. The method of embodiment 50 wherein the first and second planes are spaced apart such that a positive interference distance exists.

Embodiment 52. The method of embodiment 51 wherein the positive interference distance is approximately 0.03 inches.

Embodiment 53. The method of embodiment 50 wherein the first and second planes are the same.

Embodiment 54. The method of embodiment 50 wherein the first and second planes are spaced apart such that a negative interference distance exists.

Embodiment 55. The method of embodiment 54 wherein the negative interference distance is approximately the same as the thickness of the banknotes to be transported by the banknote transport mechanism.

Embodiment 56. The method of embodiment 54 wherein the negative interference distance is approximately 0.004 inches.

Embodiment 57. The method according to any of embodiments 41-56 wherein the pressure roller shaft comprises one or more pressure rollers positioned laterally aligned with and contacting corresponding ones of the driven rollers.

Embodiment 58. The method according to any of embodiments 41-56 wherein none of pressure rollers are positioned in lateral alignment with and contacting any of the driven rollers.

Embodiment 59. The method according to any of embodiments 41-58 wherein the driven rollers are high-friction rollers and wherein the pressure rollers are low-friction rollers.

Embodiment 60. A banknote transport mechanism comprising: a plurality of driven roller shafts spaced apart in a direction of banknote transport along a transport path, wherein a plurality of laterally offset driven rollers are positioned on each driven roller shaft such that a lateral gap exists between adjacent driven rollers, wherein each driven roller shaft rotates about a respective driven roller axis; a plurality of belt shafts spaced apart in the direction of banknote transport along the transport path, wherein a plurality of laterally offset belt pulleys are positioned on each belt shaft such that a lateral gap exists between adjacent belt pulleys, wherein each belt shaft rotates about a respective pressure roller axis; wherein the belt pulleys and the driven rollers are positioned on opposite sides of a transport path; wherein the driven roller and pressure roller axes are oriented generally perpendicular to the direction of banknote transport along the transport path; further comprising at least one belt positioned about belt pulleys on different belt shafts, wherein at least one pair of the pressure rollers positioned on the different belt shafts and a belt positioned thereabout are laterally positioned in a direction transverse to the direction of banknote transport aligned with the lateral gap between adjacent driven rollers; and wherein the driven rollers cooperate with the belts to transport a banknote in the direction of banknote transport with the banknote being corrugated in a direction generally transverse to the direction of banknote transport.

Embodiment 61. The banknote transport mechanism of embodiment 60 wherein the plurality of driven rollers have approximately the same path-side driven roller level generally lying in a first plane and wherein the plurality of belts have approximately the same path-side belt level generally lying in a second plane; wherein the first and second planes are at least approximately parallel.

Embodiment 62. The banknote transport mechanism of embodiment 61 wherein the first and second planes are spaced apart such that a positive interference distance exists.

Embodiment 63. The banknote transport mechanism of embodiment 62 wherein the positive interference distance is approximately 0.03 inches.

Embodiment 64. The banknote transport mechanism of embodiment 61 wherein the first and second planes are the same.

Embodiment 65. The banknote transport mechanism of embodiment 61 wherein the first and second planes are spaced apart such that a negative interference distance exists.

Embodiment 66. The banknote transport mechanism of embodiment 65 wherein the negative interference distance is approximately the same as the thickness of the banknotes to be transported by the banknote transport mechanism.

Embodiment 67. The banknote transport mechanism of embodiment 65 wherein the negative interference distance is approximately 0.004 inches.

Embodiment 68. The banknote transport mechanism according to any of embodiments 60-67 wherein the driven rollers are rotated at a speed to transport banknotes along the transport path at a rate of at least 600 banknotes per minutes.

Embodiment 69. The banknote transport mechanism according to any of embodiments 60-67 wherein the driven rollers are rotated at a speed to transport banknotes along the transport path at a rate of at least 800 banknotes per minutes.

Embodiment 70. The banknote transport mechanism according to any of embodiments 60-67 wherein the driven rollers are rotated at a speed to transport banknotes along the transport path at a rate of at least 1000 banknotes per minutes.

Embodiment 71. The banknote transport mechanism according to any of embodiments 60-67 wherein the driven rollers are rotated at a speed to transport banknotes along the transport path at a rate of at least 1200 banknotes per minutes.

Embodiment 72. The banknote transport mechanism according to any of embodiments 60-67 wherein the driven rollers are rotated at a speed to transport banknotes along the transport path at a rate of at least 1400 banknotes per minutes.

Embodiment 73. The banknote transport mechanism according to any of embodiments 60-72 wherein the banknote transport mechanism transports U.S. banknotes.

Embodiment 74. The banknote transport mechanism according to any of embodiments 60-73 wherein none of the belts are positioned in lateral alignment with and contacting any of the driven rollers.

Embodiment 75. The banknote transport mechanism according to any of embodiments 60-74 wherein the driven rollers are high-friction rollers and wherein the belts are low-friction belts.

Embodiment 76. A pressure roller housing comprising a base from which a bearing housing extends, the bearing housing having a distal end, the bearing housing having an opening therein configured to accommodate a bearing; a spring arm extending from the base, the spring arm having a distal end; and a bearing clip arm extending from the base, the bearing clip arm having a distal end and one or more bearing retaining flanges positioned near the distal end of the bearing clip arm and extending toward the bearing housing when the bearing clip arm is positioned in an open, non-operational state, and wherein when the bearing clip arm is positioned in a closed operational state, the one or more bearing retaining flanges retain a bearing within the bearing housing.

Embodiment 77. The pressure roller housing of embodiment 76 further comprising one or more locating lugs.

Embodiment 78. The pressure roller housing of embodiment 76 further comprising two locating lugs with a first locating lug located near the base and a second locating lug located near the distal end of the spring arm.

Embodiment 79. A driven roller housing comprising a body having an bearing opening therein configured to accommodate a bearing, the body having an elongated shape having a first end and a second end, the body having an inner surface and an outer surface; one or more locking tabs coupled to the body and each locking tab having an interior end extending past the inner surface of the body and an exterior end extending past the outer surface of the body.

Embodiment 80. The driven roller housing of embodiment 79 wherein the interior end of each locking tab is biased toward the bearing opening.

Embodiment 81. The driven roller housing of embodiment 79 wherein the driven roller housing comprises two locking tabs and the interior ends of the locking tabs are biased toward each other.

Embodiment 82. The driven roller housing of embodiment 81 wherein the locking tabs are pivotally mounted to the body such that when the exterior ends of the locking tabs are moved toward each other, the interior ends of the locking tabs move away from each other.

While the concepts disclosed herein are susceptible to various modifications and alternative forms, specific embodiments thereof have been shown by way of example in the drawings and herein described in detail. It should be understood, however, that it is not intended to limit the inventions to the particular forms disclosed, but on the contrary, the intention is to cover all modifications, equivalents, and alternatives falling within the spirit and scope of the inventions as defined by the appended claims.

What is claimed:

1. A banknote transport mechanism comprising:

a plurality of driven rollers positioned on a driven roller shaft wherein the driven roller shaft rotates about a driven roller axis;

a plurality of low friction rails, each of the plurality of low friction rails including a longitudinal axis generally parallel to a direction of banknote transport; and a rail position adjustment wedge operable to move to adjust a position of the plurality of low friction rails, wherein the driven roller axis is oriented generally perpendicular to the direction of banknote transport along a transport path, wherein each one of the plurality of low friction rails is disposed laterally in a direction generally transverse to the direction of banknote transport between two adjacent ones of the plurality of driven rollers, wherein each of the plurality of low friction rails includes a distal surface which contacts banknotes being transported along the transport path, wherein each of the plurality of driven rollers includes an outer surface that extends into the transport path at or beyond a position of the distal surface of each of the plurality of low friction rails, and which contacts banknotes being transported along the transport path, and wherein the plurality of driven rollers cooperates with the plurality of low friction rails to transport a banknote in the direction of banknote transport, wherein, in order to transport the banknote in the direction of banknote transport, the plurality of low friction rails provide a counter force to create drive friction between the banknote and the plurality of driven rollers to push the banknote in the direction of banknote transport between the plurality of driven rollers and the plurality of low friction rails, with the banknote being corrugated in the direction generally transverse to the direction of banknote transport.

2. The banknote transport mechanism of claim 1 wherein the outer surface of each of the plurality of driven rollers and the distal surface of each of the plurality of low friction rails is spaced relative to each other so as to define a positive interference distance such that the outer surface of each of the plurality of driven rollers extends beyond the distal surface of each of the plurality of low friction rails.

3. The banknote transport mechanism of claim 2 wherein the positive interference distance is approximately 0.03 inches.

4. The banknote transport mechanism of claim 1 wherein the driven roller axis is disposed in a first plane.

5. The banknote transport mechanism of claim 4 wherein the distal surfaces of the low friction rails are parallel to a second plane.

6. The banknote transport mechanism of claim 1 wherein each of the plurality of driven rollers is located in a first plane and the distal surfaces of the low friction rails are parallel to a second plane.

7. The banknote transport mechanism of claim 1 wherein the plurality of driven rollers is rotated at a speed to transport banknotes along the transport path at a rate of at least 1200 banknotes per minutes.

8. The banknote transport mechanism of claim 1 wherein the plurality of driven rollers is rotated at a speed to transport banknotes along the transport path at a rate of at least 1400 banknotes per minutes.

9. A method of transporting banknotes along a transport path using a banknote transport mechanism comprising:

adjusting a position of a plurality of low friction rails using a rail position adjustment wedge; and transporting, using a plurality of driven rollers extending into the transport path at or below the plurality of low friction rails, a banknote in a direction of banknote transport along the transport path, the plurality of low friction rails providing a counter force to create drive friction between the banknote and the plurality of driven rollers to push the banknote in the direction of banknote transport between the plurality of driven rollers and the plurality of low friction rails, wherein, due to the banknote contacting the plurality of driven rollers and the plurality of low friction rails, the banknote is corrugated in a lateral direction generally transverse to the direction of banknote transport while the banknote is generally flat in the direction of banknote transport at a plurality of lateral locations, and wherein each one of the plurality of low friction rails is disposed in the lateral direction generally transverse to the direction of banknote transport between two adjacent ones of the plurality of driven rollers.

10. The method of claim 9 wherein:

the plurality of driven rollers is positioned on a driven roller shaft, wherein the driven roller shaft rotates about a driven roller axis;

each of the plurality of low friction rails includes a longitudinal axis generally parallel to the direction of banknote transport; and the driven roller axis is oriented generally perpendicular to the direction of banknote transport along the transport path.

11. The method of according to claim 10 wherein the plurality of driven rollers includes outer surfaces which contact banknotes being transported along the transport path;

wherein the plurality of low friction rails includes distal surfaces which contact banknotes being transported along the transport path; and wherein the outer surfaces of the plurality of driven rollers and the distal surfaces of the plurality of low friction rails are spaced relative to each other so as to define a positive interference distance such that the outer surfaces of the plurality of driven rollers extend beyond the distal surfaces of the plurality of low friction rails.

12. The method of claim 11 wherein the positive interference distance is approximately 0.03 inches.

13. The method of claim 9 wherein the transporting is performed at a rate of at least 600 banknotes per minutes.

14. The method of claim 9 wherein the transporting is performed at a rate of at least 800 banknotes per minutes.

15. The method of claim 9 wherein the transporting is performed at a rate of at least 1000 banknotes per minutes.

16. The method of claim 9 wherein the transporting is performed at a rate of at least 1200 banknotes per minutes.

17. The method of claim 9 wherein of transporting is performed at a rate of at least 1400 banknotes per minutes.

18. The method of claim 9 wherein the transporting comprises transporting U.S. banknotes.

19. A banknote transport mechanism comprising:

a plurality of driven roller shafts spaced apart in a direction of banknote transport along a transport path, wherein a plurality of driven rollers is positioned on each of the plurality of driven roller shafts, wherein each of the plurality of driven roller shafts rotates about a respective driven roller axis;

a plurality of low friction rails, each of the plurality of low friction rails including a distal surface and a longitudinal axis generally parallel to the direction of banknote transport; and a rail position adjustment mechanism, wherein the respective driven roller axis of each of the plurality of driven roller shafts is oriented generally perpendicular to the direction of banknote transport along the transport path, wherein the respective driven roller axis of each of the plurality of driven roller shafts generally lie in a first plane and the distal surface of each of the plurality of low friction rails generally lies in a second plane parallel to the first plane, wherein the rail position adjustment mechanism is operable to adjust a distance between the plurality of low friction rails and the plurality of driven roller shafts, wherein the plurality of driven rollers of each of the plurality of driven roller shafts is each offset laterally in a direction transverse to the direction of banknote transport from a lateral location of each of the plurality of low friction rails, and wherein the plurality of driven rollers cooperates with the plurality of low friction rails to transport a banknote in the direction of banknote transport with the banknote being corrugated in a direction generally transverse to the direction of banknote transport.

* * * * *